US007562399B2

(12) United States Patent
Parsons et al.

(10) Patent No.: US 7,562,399 B2
(45) Date of Patent: Jul. 21, 2009

(54) TOILET FLUSHER FOR WATER TANKS WITH NOVEL VALVES AND DISPENSERS

(75) Inventors: Natan E. Parsons, Brookline, MA (US); Fatih Guler, Winchester, MA (US); Kay Herbert, Winthrop, MA (US); Xiaoxiong Mo, Lexington, MA (US); David Hadley, Franklin, MA (US)

(73) Assignee: Arichell Technologies, W. Newton, MA (US)

( * ) Notice: Subject to any disclaimer, the term of this patent is extended or adjusted under 35 U.S.C. 154(b) by 0 days.

(21) Appl. No.: 10/961,818

(22) Filed: Oct. 8, 2004

(65) Prior Publication Data

US 2005/0133754 A1 Jun. 23, 2005

Related U.S. Application Data

(63) Continuation of application No. PCT/US03/11360, filed on Apr. 10, 2003, and a continuation-in-part of application No. 10/174,919, filed on Jun. 19, 2002, now Pat. No. 6,752,371, and a continuation-in-part of application No. PCT/US02/38758, filed on Dec. 4, 2002, and a continuation-in-part of application No. PCT/US02/41576, filed on Dec. 26, 2002.

(60) Provisional application No. 60/371,655, filed on Apr. 10, 2002.

(51) Int. Cl.
*E03D 1/00* (2006.01)

(52) U.S. Cl. ..... 4/323; 4/353; 4/366; 137/426; 251/30.01

(58) Field of Classification Search ..... 251/30.01, 251/30.02, 30.03; 4/323, 353, 366; 137/426
See application file for complete search history.

(56) References Cited

U.S. PATENT DOCUMENTS

| | | | | |
|---|---|---|---|---|
| 2,182,873 | A | 12/1939 | King | 137/484.2 |
| 2,320,886 | A | 6/1943 | Quiroz | 137/505.2 |
| 2,389,413 | A | 11/1945 | Carlton | 137/12 |

(Continued)

FOREIGN PATENT DOCUMENTS

| | | |
|---|---|---|
| EP | 312750 | 4/1989 |

(Continued)

OTHER PUBLICATIONS

International Search Report, issued on Jul. 30, 2003 in PCT/US03/11360.

*Primary Examiner*—John Bastianelli
(74) *Attorney, Agent, or Firm*—Ivan David Zitkovsky

(57) ABSTRACT

A tank-type flusher is located in the water storage tank for flushing a toilet. The tank-type flusher includes an intake valve and a flush valve. The intake valve is connected to an external water source and constructed to close water flow to the water storage tank at about a predefined water level in the water tank. The flush valve is constructed to control a flush valve member between a seated state and an unseated state allowing water discharge from the water tank into a toilet bowl. The tank-type flusher may be controlled by a sensor module located at a reference location external to the water storage tank.

20 Claims, 39 Drawing Sheets

U.S. PATENT DOCUMENTS 2,504,555 A * 4/1950 Loether ..... 4/397
2,760,204 A 8/1956 Joanis ..... 4/367
2,858,546 A 11/1958 Tekenos et al. ..... 4/68
2,957,181 A 10/1960 Lamping ..... 4/354
3,060,450 A * 10/1962 Rupert ..... 4/359
3,064,675 A 11/1962 Johnson et al. ..... 137/489.5
3,086,217 A * 4/1963 Barlow ..... 4/367
3,113,756 A 12/1963 Griffo ..... 251/57
3,628,195 A 12/1971 Skousgaard ..... 4/26
3,677,294 A 7/1972 Gibbs et al. ..... 137/572
3,689,025 A 9/1972 Kiser ..... 251/25
3,747,621 A 7/1973 Tine ..... 137/218
3,817,279 A 6/1974 Larson ..... 137/572
3,817,489 A 6/1974 Caron et al. ..... 251/38
3,820,171 A 6/1974 Larson ..... 4/360
3,820,754 A 6/1974 Caron et al. ..... 251/38
3,905,050 A 9/1975 Goza et al. ..... 4/358
4,003,399 A 1/1977 Fischer ..... 4/353
4,034,423 A 7/1977 Milnes ..... 4/366
4,060,857 A 12/1977 Couton ..... 4/26
4,077,602 A 3/1978 Klessig ..... 251/25
4,088,297 A 5/1978 Doyle et al. ..... 251/44
4,141,091 A 2/1979 Pulvari ..... 4/313
4,193,145 A 3/1980 Gross et al. ..... 4/346
4,233,698 A 11/1980 Martin ..... 4/354
4,251,012 A 2/1981 Owens et al. ..... 4/227.5
4,304,015 A 12/1981 Hubatka ..... 4/407
4,357,720 A 11/1982 Stahli ..... 4/378
4,499,615 A 2/1985 Radovsky ..... 4/366
4,573,495 A * 3/1986 Rothe et al. ..... 251/46
4,575,880 A 3/1986 Burgess ..... 4/313
4,646,780 A 3/1987 Spooner ..... 4/353
4,662,395 A 5/1987 Strangfeld ..... 4/354
4,707,868 A * 11/1987 Hennessy ..... 4/362
4,756,031 A 7/1988 Barrett ..... 4/407
4,832,310 A 5/1989 Nestich ..... 251/36
4,941,215 A 7/1990 Liu ..... 4/406
4,955,921 A 9/1990 Basile et al. ..... 4/354
4,977,923 A * 12/1990 Cho ..... 251/30.03
5,003,643 A 4/1991 Chung ..... 4/313
5,005,226 A 4/1991 Basile et al. ..... 4/354
5,046,201 A 9/1991 Steinhardt et al. ..... 4/354
5,169,118 A * 12/1992 Whiteside ..... 251/30.03
5,187,818 A 2/1993 Barrett, Sr. et al. ..... 4/313
5,303,728 A * 4/1994 Senatore ..... 137/113
5,313,673 A 5/1994 Saadi et al. ..... 4/313
5,335,694 A 8/1994 Whiteside ..... 137/625.37
5,341,839 A 8/1994 Kobayashi et al. ..... 137/505.13
5,361,426 A 11/1994 Martin ..... 4/361
5,362,026 A 11/1994 Kobayashi ..... 251/30.02
5,400,446 A 3/1995 Bloemer et al. ..... 4/408
5,427,351 A 6/1995 Korfgen et al. ..... 251/39
5,431,181 A 7/1995 Saadi et al. ..... 31/40
5,435,019 A 7/1995 Badders ..... 4/354
5,448,784 A 9/1995 Smiley
5,464,037 A 11/1995 Younes ..... 137/410
5,469,586 A * 11/1995 Tsutsui et al. ..... 4/415
5,591,409 A 1/1997 Watkins ..... 422/110
5,603,127 A 2/1997 Veal ..... 4/246.1
5,649,686 A 7/1997 Wilson ..... 251/40
5,652,970 A 8/1997 Wodeslavsky ..... 4/378
5,722,454 A 3/1998 Smith et al. ..... 137/503
5,802,628 A 9/1998 Spoeth et al. ..... 4/359
5,857,661 A 1/1999 Amada et al. ..... 251/57
5,884,667 A 3/1999 North ..... 138/43
5,887,848 A 3/1999 Wilson
5,920,919 A 7/1999 Chang ..... 4/378
5,924,142 A 7/1999 Wang ..... 4/227.2
5,926,861 A 7/1999 Frost ..... 4/378
5,946,739 A 9/1999 Descent ..... 4/222
5,970,527 A 10/1999 Martin et al. ..... 4/361
6,000,674 A * 12/1999 Cheng ..... 251/30.02
6,123,315 A 9/2000 Keller ..... 251/41
6,202,227 B1 3/2001 Gurowitz ..... 4/313
6,240,572 B1 6/2001 Van Der Gaag et al. ..... 4/225.1
6,263,519 B1 7/2001 Parsons et al. ..... 4/313
6,321,392 B1 11/2001 Sim ..... 4/225.1
6,321,395 B1 11/2001 Parsons et al. ..... 4/378
6,332,475 B1 * 12/2001 Brougham ..... 137/414
6,357,726 B1 3/2002 Watkins ..... 261/26
6,367,096 B1 * 4/2002 Quintana ..... 4/427
6,370,707 B1 4/2002 Parsons et al. ..... 4/379
6,425,145 B1 7/2002 Parsons et al. ..... 4/379
6,453,479 B1 9/2002 Parsons et al. ..... 4/378
6,478,044 B2 * 11/2002 Howe ..... 251/46
6,499,152 B2 * 12/2002 Johnson ..... 4/302
2004/0025238 A1 2/2004 Parsons et al. ..... 4/378

FOREIGN PATENT DOCUMENTS

GB 447056 5/1936
GB 1332995 10/1973
GB 2277750 11/1994
WO WO 98/06910 2/1998
WO WO 98/10209 3/1998

* cited by examiner

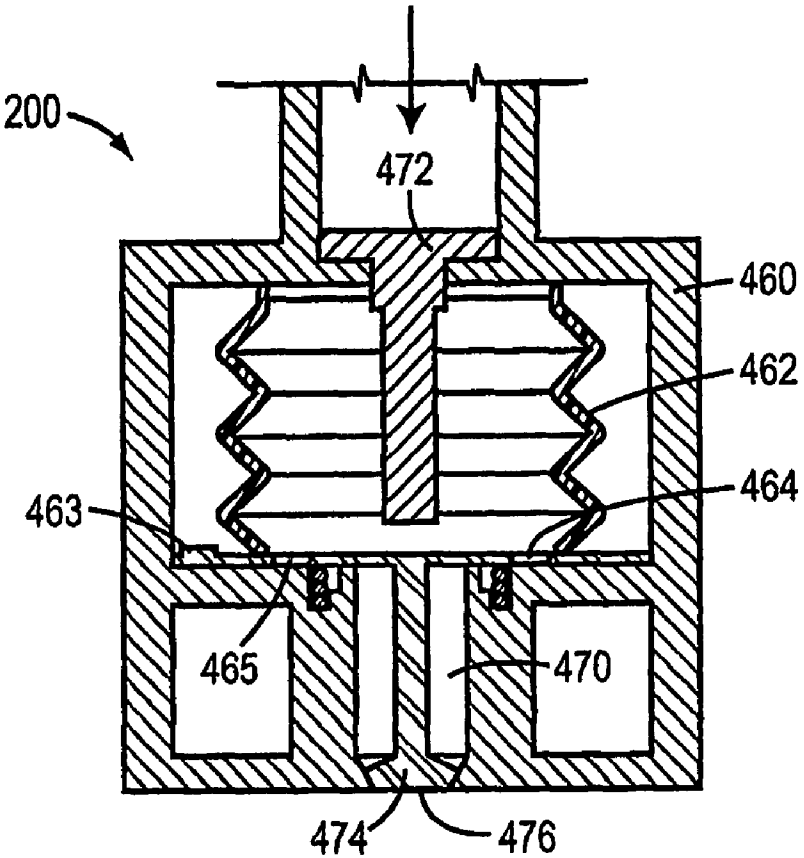
FIG. 4B-II
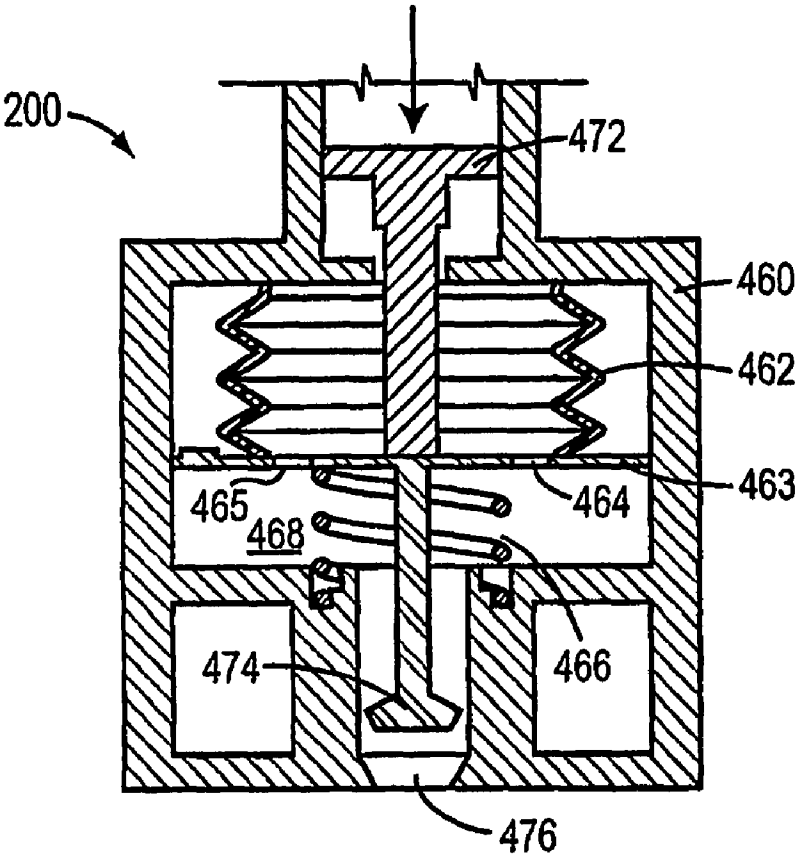
FIG. 4B-I

TOILET FLUSHER FOR WATER TANKS WITH NOVEL VALVES AND DISPENSERS

This application is a continuation of PCT Application PCT/US03/11360, which claims priority from U.S. Provisional Application Ser. No. 60/371,655, filed on Apr. 10, 2002. The PCT/US03/11360 application is also a continuation-in-part of U.S. application Ser. No. 10/174,919, filed on Jun. 19, 2002, now U.S. Pat. No. 6,752,371 is also a continuation-in-part of PCT Application PCT/US 02/38758, filed on Dec. 4, 2002, and is a continuation-in-part of PCT Application PCT/US 02/41576, filed on Dec. 26, 2002. The entire disclosure of the above-cited documents is incorporated by reference as if fully provided herein.

BACKGROUND OF THE INVENTION

1. Field of the Invention

The present invention relates to toilet flushes for water storage tanks.

2. Background Information

The art of toilet flushers is an old and mature one. (We use the term toilet here in its broad sense, encompassing what are variously referred to as toilets, water closets, urinals, etc.) While many innovations and refinements in this art have resulted in a broad range of approaches, flush systems can still be divided into two general types. The first is the gravity type, which is used in most American domestic applications. The gravity type uses the pressure resulting from water stored in a tank to flush the bowl and provide the siphoning action by which the bowl's contents are drawn from it. The second type is the pressurized flusher, which uses line pressure more or less directly to perform flushing.

Some pressure-type flushers are of the tank type. Such flushers employ pressure tanks to which the main water-inlet conduit communicates. Water from the main inlet conduit fills the pressure tank to the point at which air in the tank reaches the main-conduit static pressure. When the system flushes, the water is driven from the tank at a pressure that is initially equal to that static pressure, without reduction by the main conduit's flow resistance. Other pressure-type flushers use no pressure tank, and the main conduit's flow resistance therefore reduces the initial flush pressure.

While flush-mechanism triggering has historically been performed manually, there is also a long history of interest in automatic operation. Particularly in the last couple of decades, moreover, this interest has resulted in many practical installations that have obtained the cleanliness and other benefits that automatic operation affords. As a consequence, a considerable effort has been expended in providing flush mechanisms that are well adapted to automatic operation. Automatic operation is well known in pressure-type flushers of the non-tank variety, but gravity-type flushers and pressurized flushers of the tank variety have also been adapted to automatic operation. For example, European Patent Publication EPO 0 828 103 A1 illustrates a typical gravity arrangement. The flush-valve member is biased to a closed position, in which it prevents water in the tank from flowing to the bowl. A piston in the valve member's shaft is disposed in a cylinder. A pilot valve controls communication between the main (pressurized) water source and the cylinder. When the toilet is to be flushed, only the small amount of energy required for pilot-valve operation is expended. The resultant opening of the pilot valve admits line pressure into the cylinder. That pressure exerts a relatively large force against the piston and thereby opens the valve against bias-spring force.

However, there is still a need for new or improved flushers that can provide a reliable and reproducible water flush, can deliver a more precise amount of water for a full-flush or a half-flush, or can monitor or adjust the flushing action based on the external water line pressure.

SUMMARY OF THE INVENTION

The present invention relates to tank-type toilet flushes and the corresponding methods for operating the flushers. The tank-type toilet flushes may be adapted for automatic or manual operation and may include one or several dispensers for dispensing a cleaning material or a scent material.

According to another aspect, a tank-type flusher includes an intake valve, a flush valve, and a sensor module. The intake valve is connected to an external water source and constructed to close water flow to a water storage tank at about a predefined water level in the water tank. The flush valve is constructed to control a flush valve member between a seated state and an unseated state allowing water discharge from the water tank into a toilet bowl. The sensor module is located at a reference location external to the water storage tank.

The water storage tank may be an external tank or an internal tank located behind a wall. The sensor module includes a light source and a light detector. Alternatively, the sensor module includes only a light detector. The light detector operates in the range of 350 nm to 1500 nm. The sensor module provides a signal to a controller that controls hydraulic actuation of the flush valve.

According to another aspect, a tank-type flusher includes an intake valve (i.e., a tank fill valve), a diaphragm-operated flush valve, and a pressure control mechanism. The intake valve is connected to an external water source and is constructed to close water flow to a water storage tank at about a predefined water level in the water tank. The diaphragm-operated flush valve is constructed to control a flush valve member between a seated state and an unseated state allowing water discharge from the water tank into a toilet bowl. There is a diaphragm, separating a flush-valve chamber and a pilot chamber, arranged to seal the flush-valve chamber and thereby maintain pressure forcing the flush valve member to the seated state preventing the water discharge from the water storage tank to the toilet bowl. The pressure control mechanism is constructed and arranged, upon actuation, to reduce pressure in the pilot chamber of the diaphragm-operated flush valve to cause deformation of the diaphragm and thereby reduce pressure in the flush-valve chamber causing the water discharge.

Depending on the selected embodiment, the tank-type flusher can monitor or adjust the flushing action based on the external water line pressure. The tank-type flusher can also deliver selected water amounts upon demand, i.e., provide a full flush or a half flush. The tank-type flusher can also monitor the water level inside the water storage tank, or can detect a water leak and indicate existence of such leak to a user either visually or by sound.

According to another aspect, an electromagnetic actuator system includes an actuator, a controller, and an actuator sensor. The actuator includes a solenoid coil and an armature housing constructed and arranged to receive in a movable relationship a movable armature. The controller is coupled to a power driver constructed to provide a drive signal to the solenoid coil for displacing the armature and thereby opening or closing a valve passage for fluid flow. The actuator sensor is constructed and arranged to sense the position of the armature and provide a signal to the controller.

Preferably, the actuator sensor includes an electrical sensor constructed to detect voltage, current or phase change between voltage and current, all induced by movement of the armature. The actuator sensor may include a resistor arranged to receive at least a portion of the drive signal, and a voltmeter constructed to measure voltage across the resistor. Alternatively, the actuator sensor may include a coil sensor constructed and arranged to detect directly voltage induced by movement of the armature. This coil sensor may be connected in a feedback arrangement to a signal conditioner providing conditioned signal to the controller. The coil sensor may be formed by two coils, each constructed and arranged to detect directly the voltage induced by movement of the armature. Alternatively, the actuator sensor may include an optical sensor constructed to detect movement of the armature.

According to yet another aspect, an actuator system includes an electromagnetic actuator, an armature sensor, an external object sensor (e.g., a motion sensor or a presence sensor), and a controller with a control circuit. The actuator includes an armature and a coil constructed to displace the armature by application of a coil drive. The armature sensor is constructed to detect displacement of the armature. The control circuit is constructed to apply to the coil the coil drive upon receiving a signal originated from the external object sensor.

According to yet another aspect, a water leak detector includes a stationary or floatable level sensor and a controller. The level sensor provides to the controller a level signal corresponding to the water level inside the storage tank. The controller correlates the level signal to other data related to water use. Based on this correlation, the controller generates a warning signal if the water level drops without intentional water use (e.g., desired flushing action of a flush valve) or intentional water filling (e.g., desired filling action of an intake valve).

Preferably, the controller controls operation of an electromagnetic actuator. The electromagnetic actuator includes a solenoid coil and an armature housing for a movable armature. The controller is also coupled to a power driver constructed to provide a drive signal to the solenoid coil for displacing the armature and thereby opening or closing a valve passage for fluid flow. This, in turn, generates a signal provided to the flush valve or the fill valve (i.e., intake valve). The controller may provide the drive signal based on a manual input (e.g., a button pressed by a user) or automatic input (e.g., a signal from a presence sensor or a motion sensor).

Preferred embodiments of the-above aspects include one or more of the following features: The intake valve (i.e., tank fill valve) includes a float constructed and arranged without any fixed coupling to any valve member. The intake valve includes a float that freely floats within a float cage. The intake valve includes a float arranged to float within a float cage and to block a relief orifice at the predefined water level.

Alternatively, the intake valve may be completely independent of the float for measuring the water level in a storage tank. The float may be located at any location in the storage tank and may include an electric, magnetic or optical sensor for sensing one or several predefined water levels. After sensing a water level, the float sensor may provide a signal to a system controller. Alternatively, the float may be replaced by a "stationary" level sensor constructed as an electric, magnetic or optical sensor for sensing one or several predefined water levels. The electric sensor may be an inductive, resistive or capacitive sensor. The magnetic sensor may include one or several stationary reed switches and a movable magnet.

The pressure control mechanism is controlled by a solenoid. The flush valve member is constructed to move linearly within a flush valve housing. The flush-valve chamber is arranged to receive water pressure from the external source and is arranged to prevent the water discharge utilizing at least a portion of the water pressure.

According to another aspect, a tank-type flusher includes an intake valve (i.e., a fill valve), and a diaphragm-operated flush valve. The intake valve is constructed to close water flow from an external water source to a water storage tank when there is a predefined water level in the water tank. The intake valve includes a float constructed and arranged to freely float within a float cage. The diaphragm-operated flush valve includes a flush-valve chamber, wherein the diaphragm-operated flush valve is constructed to open upon actuation to discharge water into a toilet bowl from the water tank.

According to yet another aspect, a tank-type flusher includes an intake valve, and a diaphragm-operated flush valve. The intake valve is connected to an external water source and is constructed to close water flow to a water storage tank at about a predefined water level in the water tank. The flush valve is constructed to control position of a flush valve member movable between a seated state and an unseated state allowing water discharge from the water tank into a toilet bowl, wherein the flush valve member is biased to the unseated state by a bias member and is forced to the seated state by at least a portion of water pressure from the external source.

Preferred embodiments of this aspect include one or more of the following features: The intake valve and the flush valve are located within a single housing. The flush-valve chamber is arranged to receive a water pressure from the external source and is arranged to prevent the water discharge utilizing at least a portion of the water pressure.

The diaphragm-operated flush valve may be controlled by a solenoid. The water tank may be an exposed water tank or a concealed water tank located behind a wall. The intake valve enables a variable water level in the tank.

The tank-type flusher may include a vacuum breaker arranged to prevent transfer of water from the tank to a water supply.

The tank-type flusher may include a manual actuator constructed and arranged to actuate the flush valve. The manual actuator may be a push button actuator. The push button actuator is constructed to actuate the flush valve enabling a dual water volume flush. The push button actuator is constructed to actuate hydraulically the flush valve.

The tank-type flusher may include an automatic actuator constructed and arranged to actuate the flush valve. The automatic actuator is constructed to be triggered by a sensor. The sensor may register presence of an object or movement of an object. The sensor may be an optical sensor. The automatic actuator may be constructed to actuate the flush valve enabling a dual water volume flush. The automatic actuator may be located outside of the water tank and is constructed to actuate hydraulically the flush valve.

The tank-type flusher may include a check valve arranged to reduce variation of closing pressure depending on water line pressure. The tank-type flusher may include a pressure compensated flow regulator. The tank-type flusher may include a viper seal co-operatively arranged with the flush valve to prevent water leaking into the toilet bowl. The tank-type flusher may include a vent for controlling odor.

We have invented novel gravity-type and pressure-type flush mechanisms. In the case of the gravity-type flush valve, we have recognized that operation can be made more repeatable by simply employing a configuration that is the reverse of the one described in the above-mentioned European patent publication. Specifically, we bias our flush valve to its unseated state, in which it permits flow from the tank to the bowl, and we use line pressure to hold the flush valve shut rather than to open it. We have recognized that this approach makes it very simple to have a repeatable valve-opening profile. Also, high line pressure actually aids in preventing leakage through the flush valve, rather than tending to reduce the effectiveness of the flush-valve seal. Since the toilet's suction generation is principally dependent on that profile, and since our approach makes the bias mechanism essentially the sole determinant of that profile, our approach enables this aspect of flush operation to be largely independent of line pressure.

We have also recognized that pressure-type flush systems adapted for automatic operation can be simplified by providing a pressure-relief passage that extends through the flush-valve member itself. Specifically, part or the entire valve member is disposed in a pressure chamber, into which line pressure is admitted. This pressure overcomes a bias force and holds the valve member in its seated position, in which it prevents flow from the pressurized-liquid source into the bowl. To open the flush valve, it is necessary to relieve the pressure in the pressure chamber by venting it into some un-pressurized space. Rather than follow the conventional approach of providing an additional pressure-relief exit from the flush mechanism, we use the flush outlet for pressure relief by providing a pressure-relief conduit that extends from the pressure chamber through the flush-valve member itself. A pressure-relief mechanism ordinarily prevents flow through this pressure-relief conduit, but it permits such flow when the toilet is to be flushed.

In both pressure- and gravity-type systems, much of the mechanism employed to operate the flush valve is typically local to the wet region. That is, it is inside the pressure vessel in the case of a pressure-type system, and it is in the tank below the high-water line in case of a gravity-type system. For automatic operation, though, at least some part, such as a lens used as part of an object sensor to collect light reflected from the object, is disposed at a remote location. So there is some communication between the local and remote regions. This communication may be totally hydraulic, wherein a pressure-relief line extends from the local region to a remote region outside the pressure vessel or outside the part of the tank interior. A remote valve controls a pressure-relief line for controlling the flush valve's operation. In this embodiment, there is no need for a sealed enclosure for the electrical components.

Another important aspect of the present inventions is a novel algorithm for operating an automatic flusher. According to one preferred embodiment, the automatic flusher employs an optical object sensor having a light source and a light detector in the visible or IR range. The detector provides an output on the basis of which a control circuit decides whether to flush a toilet (or a urinal). After each pulse of transmitted radiation from the source, the control circuit determines if the resultant percentage of reflected radiation differs significantly from the last, and determines whether the percentage change was positive or negative. From the determined subsequent data having a given direction and the sums of the values, the control circuit determines whether a user has approached the toilet and then withdrawn from it. Based on this determination, the controller operates the flusher's valve. That is, the control circuit determines the flush criteria based on whether a period in which the reflection percentage decreased (in accordance with appropriate withdrawal criteria) has been preceded by a period in which the reflection percentage increased (in accordance with appropriate approach criteria). In this embodiment, the control circuit does not base its determination of whether the user has approached the toilet based on whether the reflection percentage has exceeded a predetermined threshold, and it does not base a determination of whether the user has withdrawn from the toilet on whether the reflection percentage has fallen below a predetermined threshold.

In typical application, if the user is standing or sitting in front of the detector for at least eight seconds, the flusher is activated after the user moved out of the optical range. If the detector detects a user in a near position for more than eight seconds (including moving in and the stationary time), the flusher controller changes the status from ready to flushing status. After the detector detected the user moving away and out of range, the controller issues a flushing command to the flusher. The time thresholds can be adjusted depending on the application and the environment.

According to another embodiment, after each emitted IR pulse, the control circuit determines whether the user has approached the toilet based on whether the reflection percentage has exceeded a predetermined threshold. Here, similarly, the control circuit determines whether the user has withdrawn from the toilet based on whether the reflection percentage has fallen below a predetermined threshold, for each selected pulse intensity. The predetermined thresholds are selected based on the environment (e.g., wall reflective surfaces, light in the bathroom, detector orientation).

Another important aspect of the present inventions uses the automatic flusher that employs an optical object sensor having only a light detector for detecting light in the visible or IR range, and preferably in the visible to near-IR range.

BRIEF DESCRIPTION OF THE DRAWINGS

FIGS. 4B-I and 4B-II are schematic cross-sectional views of a dispenser for dispensing a cleaner or scent fluid.

DETAILED DESCRIPTION OF ILLUSTRATIVE EMBODIMENTS

Figure 1:
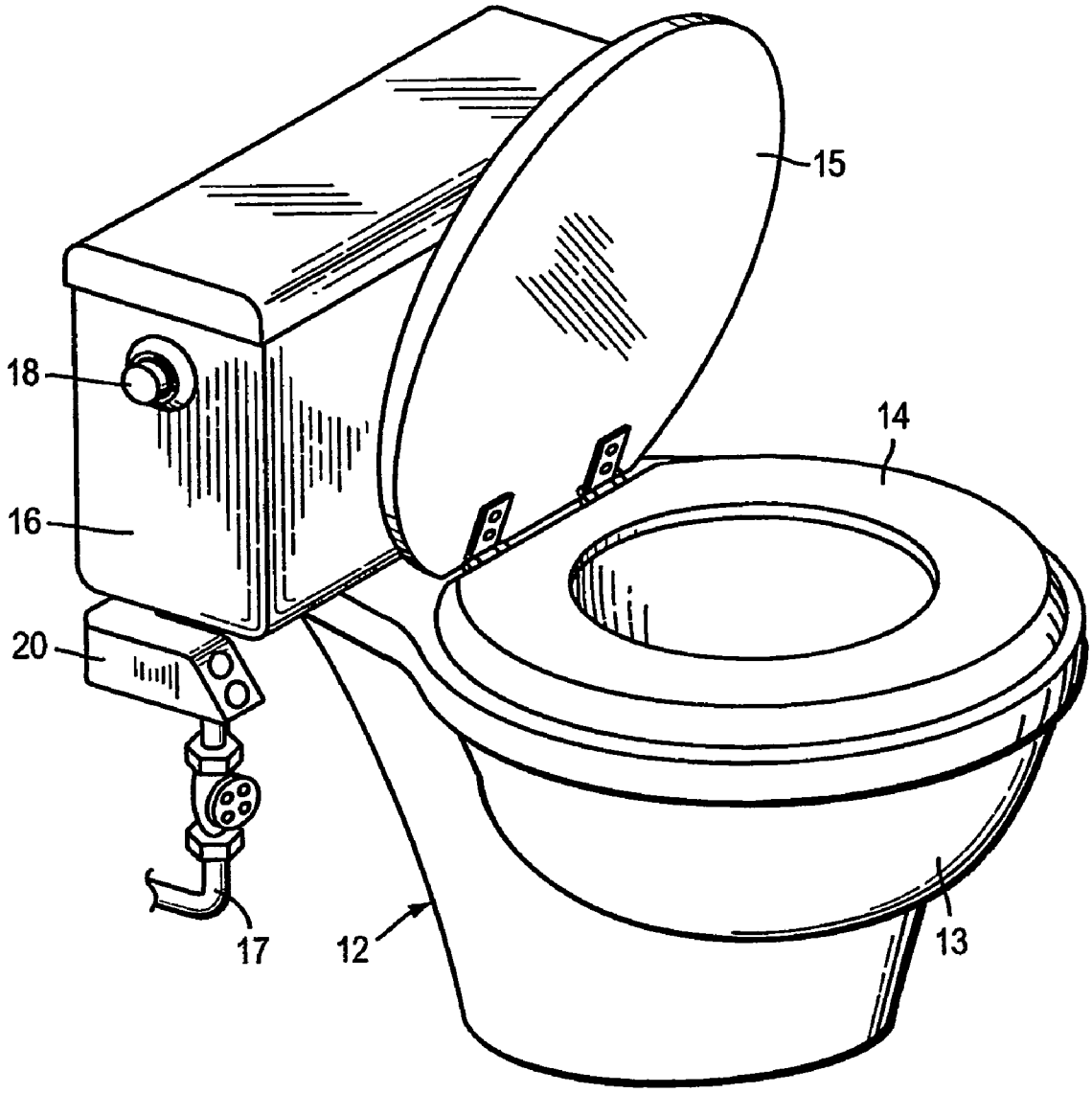
FIG. 1 is a perspective view of a toilet with a water storage tank and an object sensor.

FIG. 1 is a perspective view of a toilet 12 with a bowl 13, a seat 14, a water tank 16, an automatic detection module 20, and a manual override button 18. Automatic module 20 includes an optical detection system described in connection with FIG. 1D or any other object sensor. The object sensor provides the signal to a controller that controls a driver of a latching actuator as described in connection with FIGS. 2, 2A, and 2B. The latching actuator is coupled to a hydraulic line that operates the pilot mechanism of the gravity flusher located inside tank 16, as shown in FIG. 3.

Referring still to FIG. 1, automatic module 20 is coupled at a point where the input water line is connected to water tank 16. This point is selected because it provides a unique reference point for all types of tank type toilets used in the U.S. Automatic detection module 20 provides a signal to a controller which controls hydraulic actuation of the gravity-type flusher.

Figure 1A:
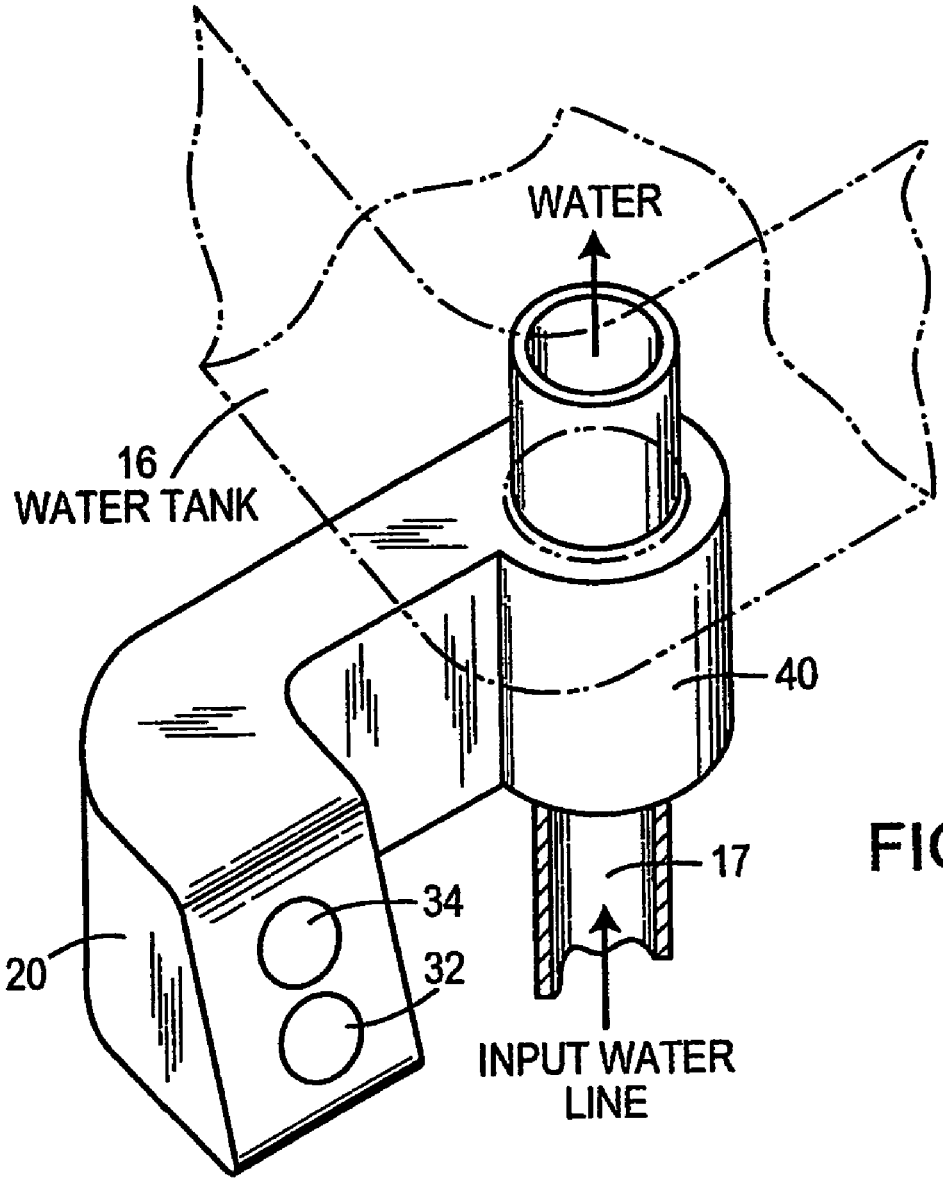
FIGS. 1A, 1B, and 1C are perspective views of the object sensor located at the input to the water storage tank.

FIG. 1A is a perspective view of detection module 20 including an optical source, emitting light pulses through a window 32, and an optical detector, receiving reflected pulses through a window 34. The body of the automatic detection module 20 may include all electronic elements described in connection with any one of the embodiments shown in FIGS. 2, 2A, and 2B. Furthermore, automatic detection module 20 may include an input valve located inside enclosure 40 and designed to control the flow of water from input pipe 17 to storage tank 16. This input valve can replace a fill valve 102 described below in connection with flushers 100 and 100A.

Figure 1B:
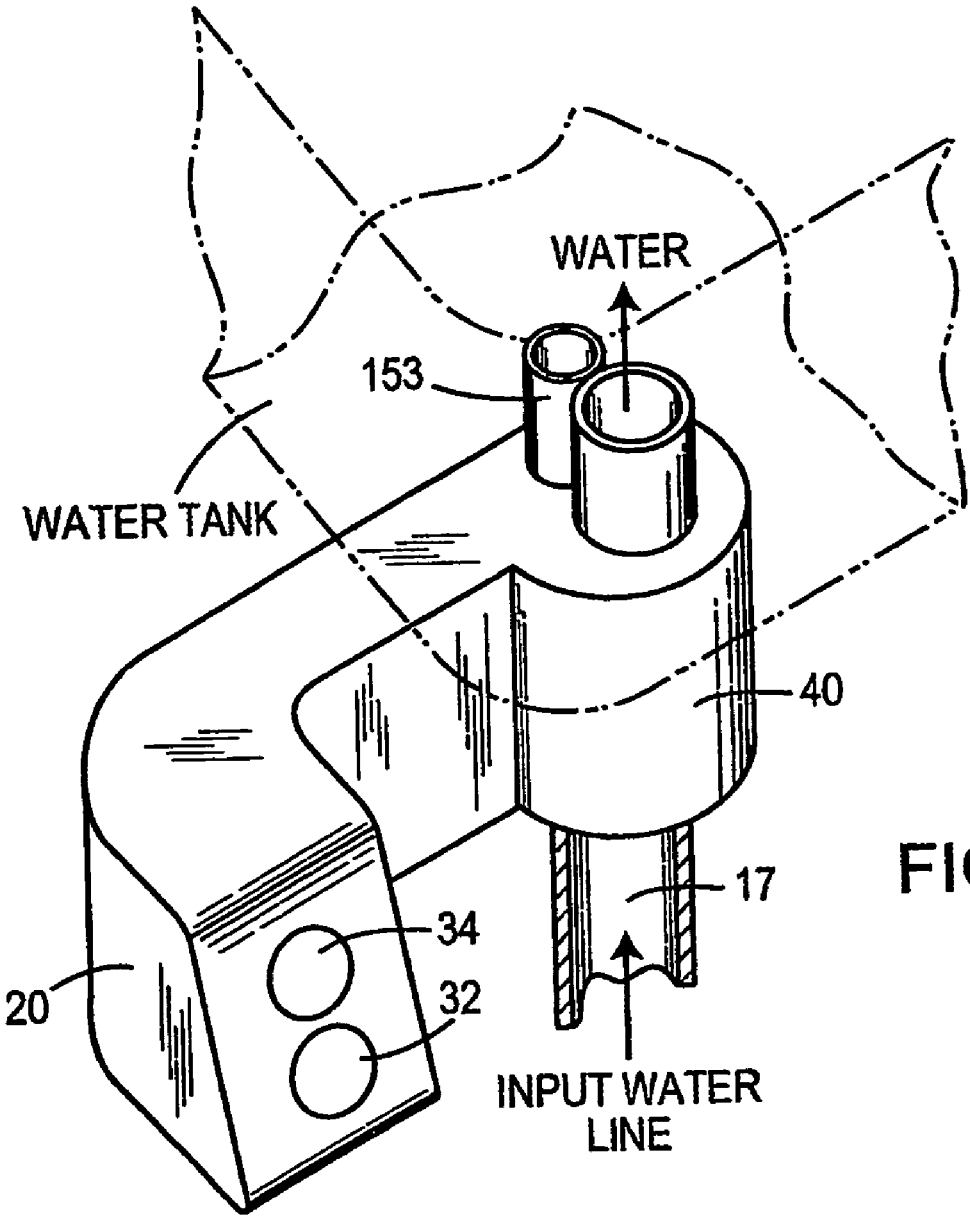

FIG. 1B is a perspective view of another embodiment of detection module 20. Detection module 20 has an optical source for emitting light pulses through window 32 and an optical detector for receiving reflected pulses through window 34. The body 40 also includes a separate actuator (e.g., actuator shown in FIG. 3D) for controlling water pressure in a hydraulic line 153 for controlling a flush valve 104 of the gravity-type flushers 100 and 100A described below.

Figure 1C:
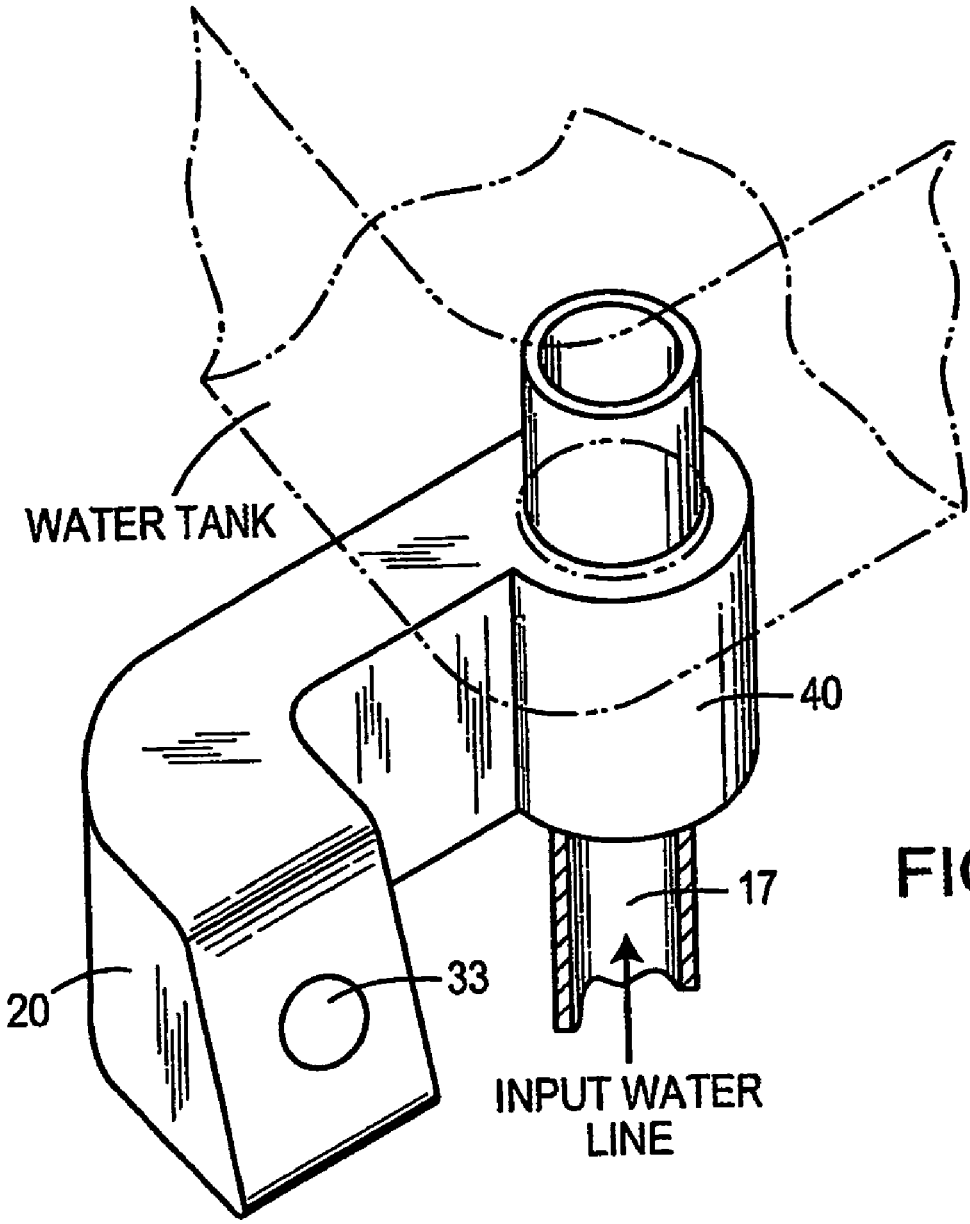

Referring to FIG. 1C, according to another embodiment, automatic detection module 20 includes only an optical detector for receiving reflected pulses through an optical window 33. In this embodiment, there is no optical source, and the detector detects visible or near-infrared light arriving at optical window 33. The amount of light depends on the ambient light (i.e., background) and depends on any object "casting a shadow" (i.e., measured signal). If an object is located close to optical window 33, the optical detector detects a smaller amount of light. There are several embodiments of optical window 33. For example, optical window 33 may be just a light transparent material, or a focusing lens, or a lens changing transmission properties depending on the ambient light (e.g., a photochromatic lens).

Figure 1D:
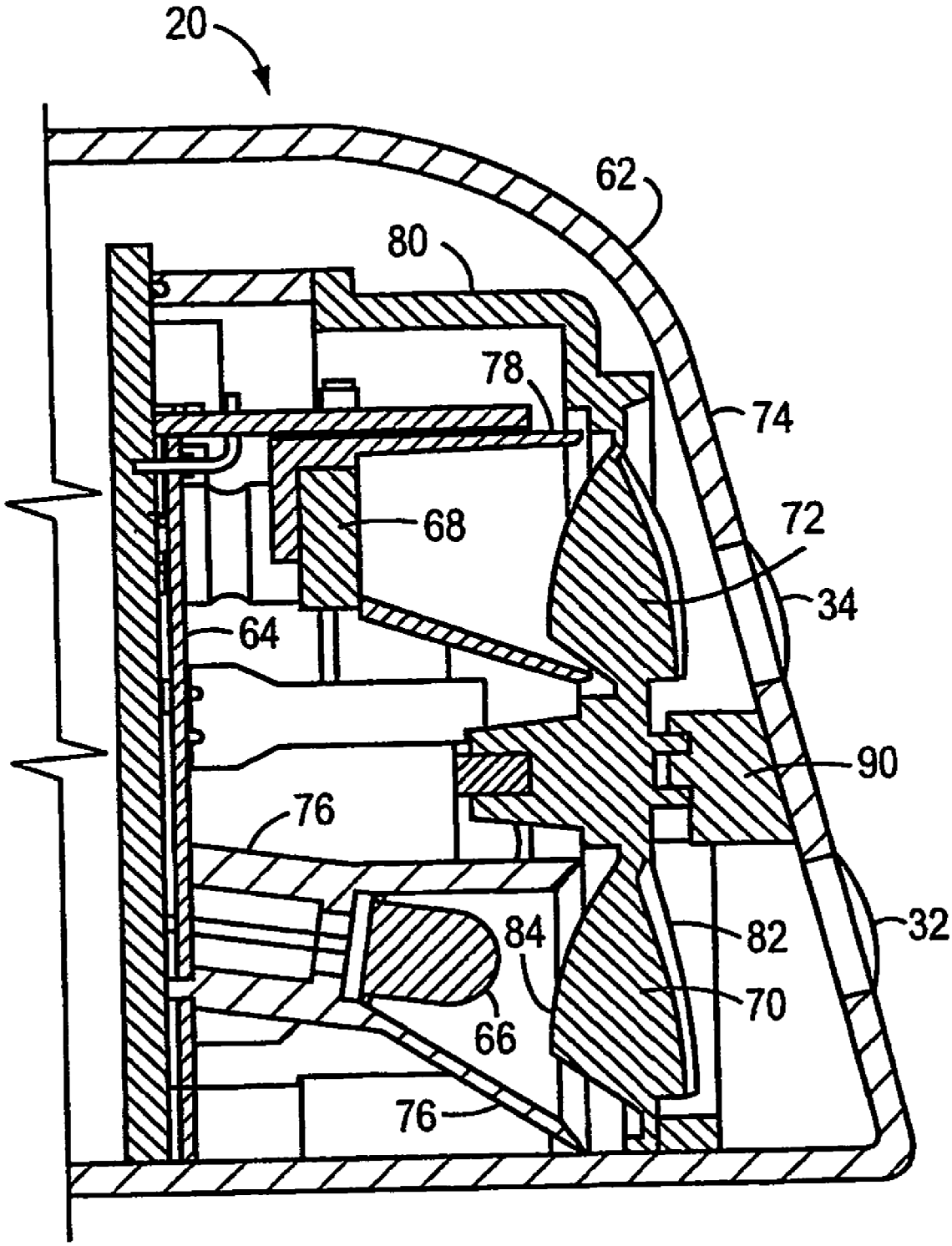
FIG. 1D is a cross-sectional view showing schematically the optical object sensor shown in FIGS. 1A and 1B.

FIG. 1D is a cross-sectional view showing schematically the optical object sensor shown in FIGS. 1A and 1B. This active optical sensor (detector) includes a light source 66 (i.e., an IR transmitter) and a light detector 68 (i.e., receiver). IR transmitter66 provides light to a transmitter lens 70, and IR receiver received light collected by a receiver lens 72. Lenses 70 and 72 are optically aligned with the respective light windows 32 and 34. Alternatively, both lenses 70 and 72 may be formed integrally as part of the housing 62, which affords manufacturing advantages over arrangements in which the lenses are provided separately from the housing. However, in other embodiments, the lenses may be separate, which affords greater flexibility in material selection for both the lens and the circuit housing.

Referring still to FIG. 1D, module 20 includes a sensor circuit board 64, a light-emitting diode 66, a photodiode 68, a transmitter-lens 70, and a receiver lens 72, all located in a housing 62. Transmitter-lens 70 focuses infrared light from light-emitting diode 66 through infrared-transparent window 32 having a selected radiation-power distribution. Receiver lens 72 focuses received light onto photodiode 68, wherein this arrangement provides a selected pattern of sensitivity to light reflected from different targets. The emitted radiation-power distribution and the sensitivity pattern of photodiode 68 are shown, for example, in U.S. Pat. No. 6,212,697, which is incorporated by reference. The optical sensor also includes an opaque blinder 90 mounted in front of lens 70 to form a central aperture for infrared-light transmission from the light-emitting diode 66, and to block stray transmission that could contribute to cross talk. To prevent cross talk, the optical sensor may include opaque stops and other elements such as blinder 90.

Both light-emitting diode 66 and photodiode 68 are mounted on circuit board 64, wherein light-emitting diode 66 is located within a transmitter hood 76 and photodiode 68 is located within a receiver hood 78. Transmitter and receiver hoods 76 and 78 are opaque and tend to reduce noise and cross talk. Lenses 70 and 72 may be manufactured as a part of front housing 40, located inside housing 62, using transparent material such as Lexan OQ2720 polycarbonate. Lens 70 has front and rear polished surfaces of different shapes to provide an optimal shape of the emitted beam. Similarly lens 72 may have different front and rear polished surfaces to provide optimal light detection.

Figure 2:
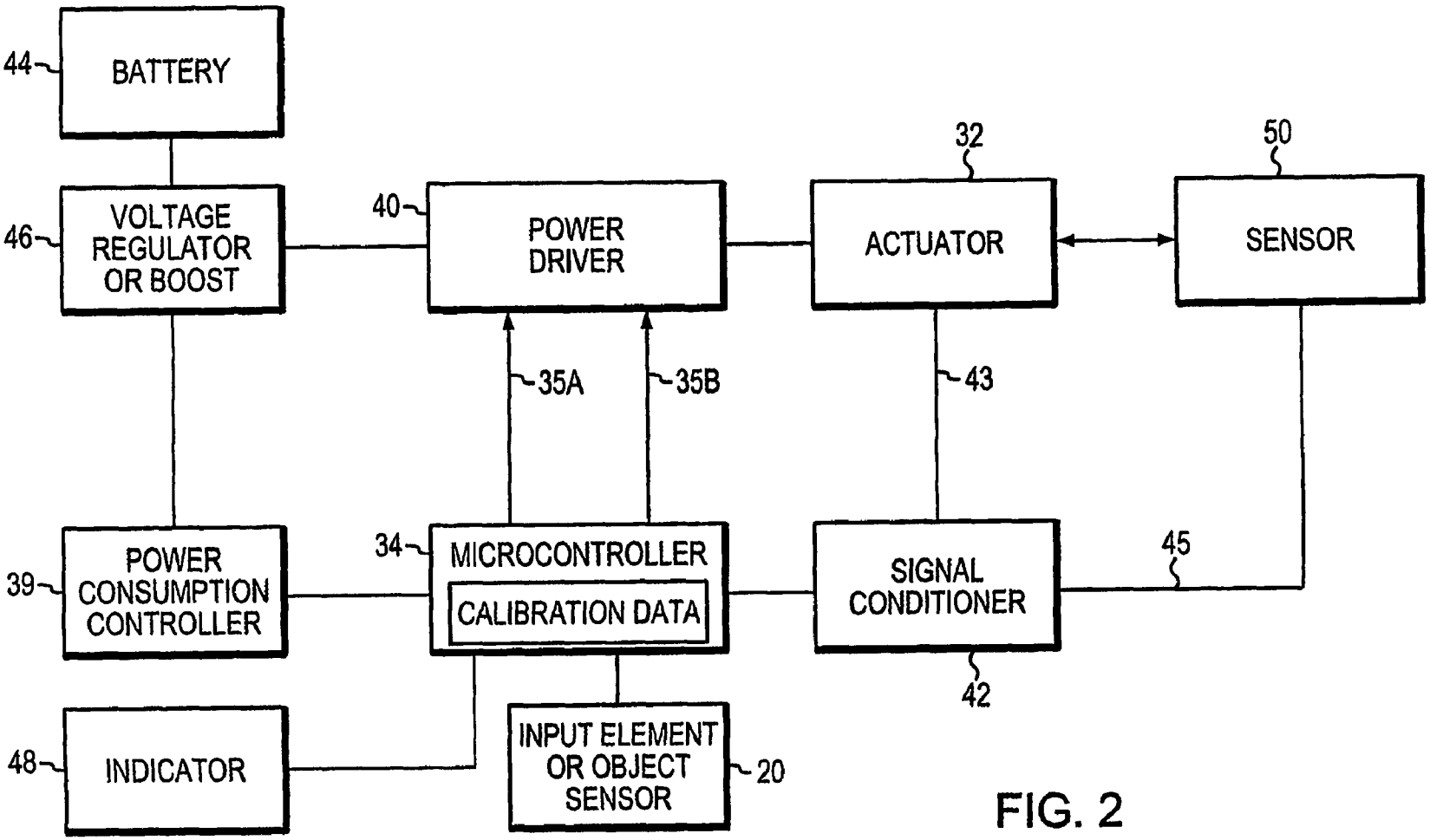
FIGS. 2, 2A, and 2B are block diagrams of control systems for controlling an actuator operating an automatic flusher located in the storage tank shown in FIG. 1.
Figure 2A:
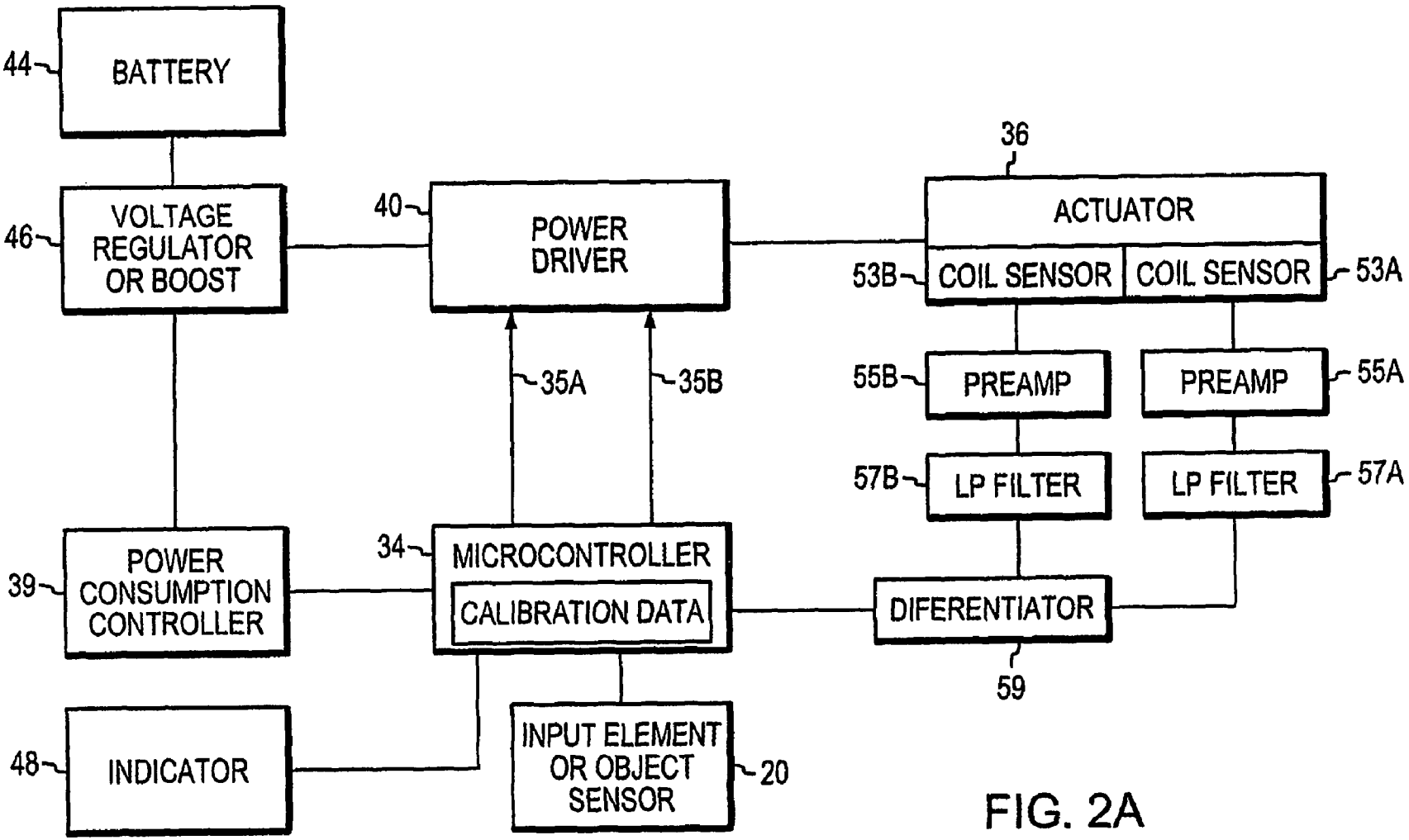
Figure 2B:
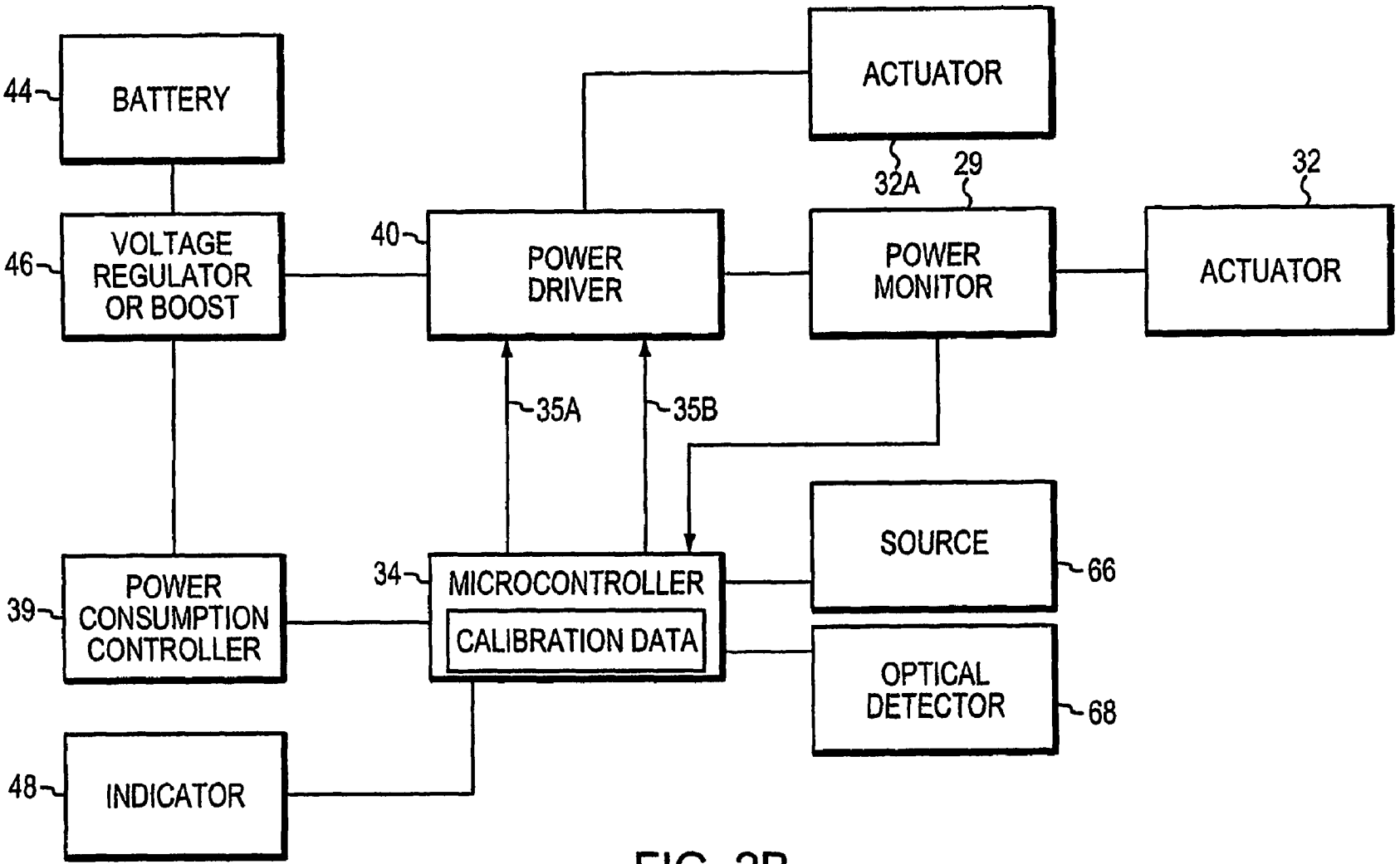
Figure 3:
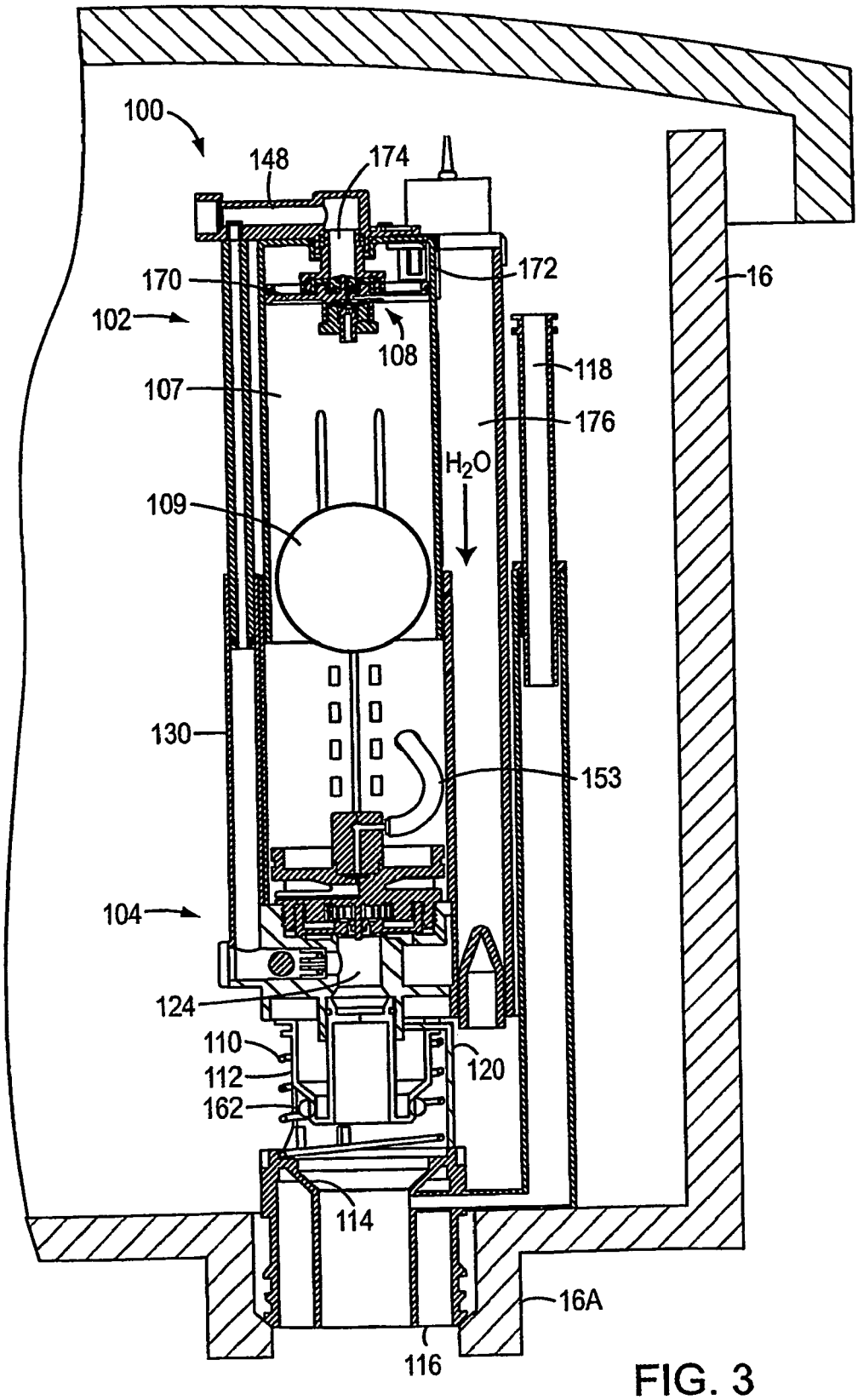
FIG. 3 is a cross-sectional view of a first embodiment of a gravity-type flusher located in the storage tank shown in FIG. 1.

Referring to FIGS. 2, 2A and 2B, microcontroller 34 controls the entire flushing cycle for the automatic flusher embodiment. On the other hand, in a manual flusher embodiment, the operation is controlled by depressing a button 18. The manual operation is described in PCT Application PCT/US01/43273, which is incorporated by reference in its entirety. Button 18 actuates a hydraulic mechanism connected to hydraulic line 153, which in turn controls flush valve 104 of the gravity-type flusher.

FIG. 2 schematically illustrates a flusher controller comprising an actuator 32, a controller or microcontroller 34, an input element (e.g., optical sensor 20 or any type of a switch), a solenoid driver 40 receiving power from a battery 44 regulated by a voltage regulator 46. Microcontroller 34 is designed for efficient power operation. To save power, microcontroller 34 is initially in a low frequency sleep mode and periodically addresses the input element to see if it was triggered. After triggering, microcontroller provides a control signal to a power consumption controller 39, which is a switch that powers up voltage regulator 46 (or a voltage boost 46), the input element or sensor 20, and a signal conditioner 42. (To simplify the block diagrams of FIGS. 2 and 2A, connections from power consumption controller 39 to input element or sensor 38 and signal conditioner 44 are not shown)

Microcontroller 34 receives an input signal from an input element (or external sensor) 20, which provides an actuation or control input for actuator 32. Specifically, microcontroller 34 provides control signals 35A and 35B to power driver 40, which drives the solenoid of actuator 32. Power driver 40 receives DC power from battery 44 and voltage regulator 46 regulates the battery power to provide a substantially constant voltage to power driver 40. An armature sensor 50 registers or monitors the armature position of actuator 32 and provides a control signal 45 to signal conditioner 42.

Armature sensor 50 provides data to microcontroller 34 (via signal conditioner 42) about the motion or position of the actuator's armature and this data is used for controlling power driver 40. Armature sensor 50 may be an electromagnetic sensor (e.g., a pick up coil) a capacitive sensor, a Hall effect sensor, an optical sensor, a pressure transducer, or any other type of a sensor.

Preferably, microcontroller 34 is an 8-bit CMOS microcontroller TMP86P807M made by Toshiba. The microcontroller has a program memory of 8 Kbytes and a data memory of 256 bytes. Programming is done using a Toshiba adapter socket with a general-purpose PROM programmer. The microcontroller operates at 3 frequencies ($f_c$=16 MHz, $f_c$=8 MHz and $f_s$=332.768 kHz), wherein the first two clock frequencies are used in a normal mode and the third frequency is used in a low power mode (i.e., a sleep mode). Microcontroller 34 operates in the sleep mode between various actuations. To save battery power, microcontroller 34 periodically samples input element or object sensor 20 for an input signal, and then triggers power consumption controller 39. Power consumption controller 39 powers up signal conditioner 42 and other elements. Otherwise, object sensor 20, voltage regulator 46 (or voltage boost 46) and a signal conditioner 42 are not powered to save battery power. During operation, microcontroller 34 also provides indication data to an indicator 48.

FIG. 2A schematically illustrates another embodiment of the flusher controller. The flusher control system includes again microcontroller 34, power switch, and solenoid driver 40 for controlling an actuator 36. Preferably, actuator 36 is a latching actuator that includes at least one drive coil wound on a bobbin and an armature that preferably is made of a permanent magnet. Actuator 36 also includes coil sensors 53A and 53B (e.g., separate coils having only a few turns for detection by induction). Various embodiments of actuator 32 are described in U.S. Application 60/362,166, filed on Mar. 5, 2002, entitled "Controlling Fluid Flow", PCT Application PCT/US 01/51098 filed on Oct. 25, 2001, entitled "Apparatus and Method for Controlling Fluid Flow", and U.S. Pat. Nos. 6,293,516; 6,305,662, all of which are incorporated by reference in their entireties.

Microcontroller 34 provides control signals 35A and 35B to power driver 40, which drives the solenoid for moving the armature. Solenoid driver 40 receives DC power from battery 44 and voltage regulator 46 regulates the battery power to provide a substantially constant voltage to power driver 40. Coil sensors 53A and 53B pickup induced voltage signal due to movement of the armature and provide this signal to a conditioning feedback loop that includes preamplifiers 55A, 55B and flow-pass filters 57A, 57B. That is, coil sensors 53A and 53B are used to monitor the armature position of actuator 36.

Microcontroller 34 is designed for efficient power operation. Between actuations, microcontroller 34 goes automatically into a low frequency sleep mode and all other electronic elements (e.g., input element or object sensor 20, power driver 40, voltage regulator or voltage boost 46, signal conditioner 44) are powered down. Upon receiving an input signal from, for example, object sensor 20, microcontroller 34 turns on a power consumption controller 39, which powers up signal conditioner 46. Circuit diagrams of the flusher controller are provided in U.S. Application 60/362,166, which is incorporated by reference.

FIG. 2B schematically illustrates another embodiment of the control electronics that may be located on the circuit board 64. The flusher control system includes again microcontroller 34, providing control signals to power driver 40, which in turn delivers drive current to solenoids of actuators 32 and 32A. The drive current delivered for controlling actuator 32 is monitored by a power monitor 29 providing a control signal to microcontroller 34. Preferably, actuators 32 and 32A are latching actuators. Microcontroller 34 directs delivery of drive current to light-emitting diode 66 for increasing the light intensity of the emitted pulses, as described below. Microcontroller 34 also receives a detection signal from an amplifier associated with a photodiode 68, as described below.

Figure 3A:
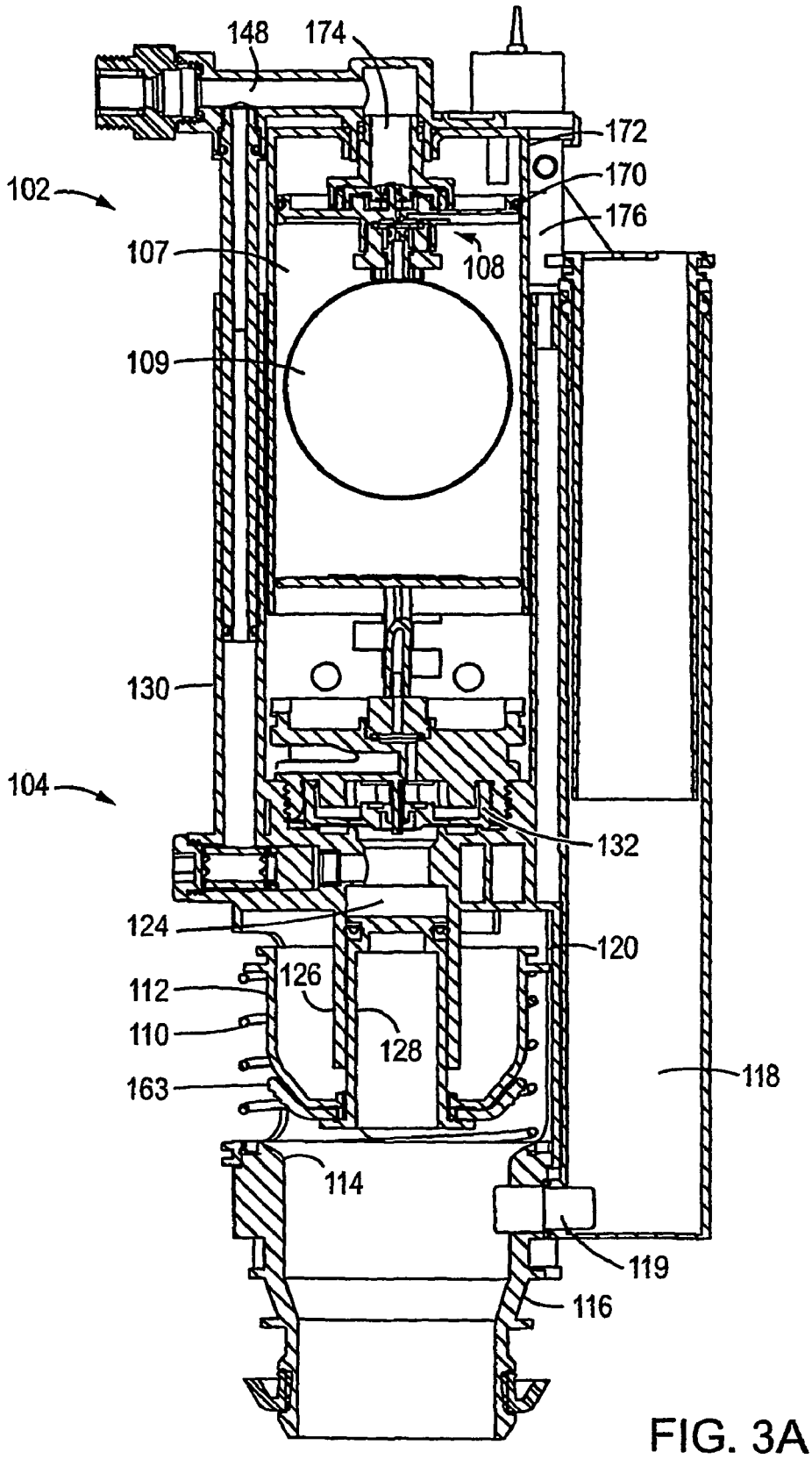
FIG. 3A is an enlarged cross-sectional view of the gravity-type flusher shown in FIG. 3, including a flush valve and a fill valve.
Figure 3B:
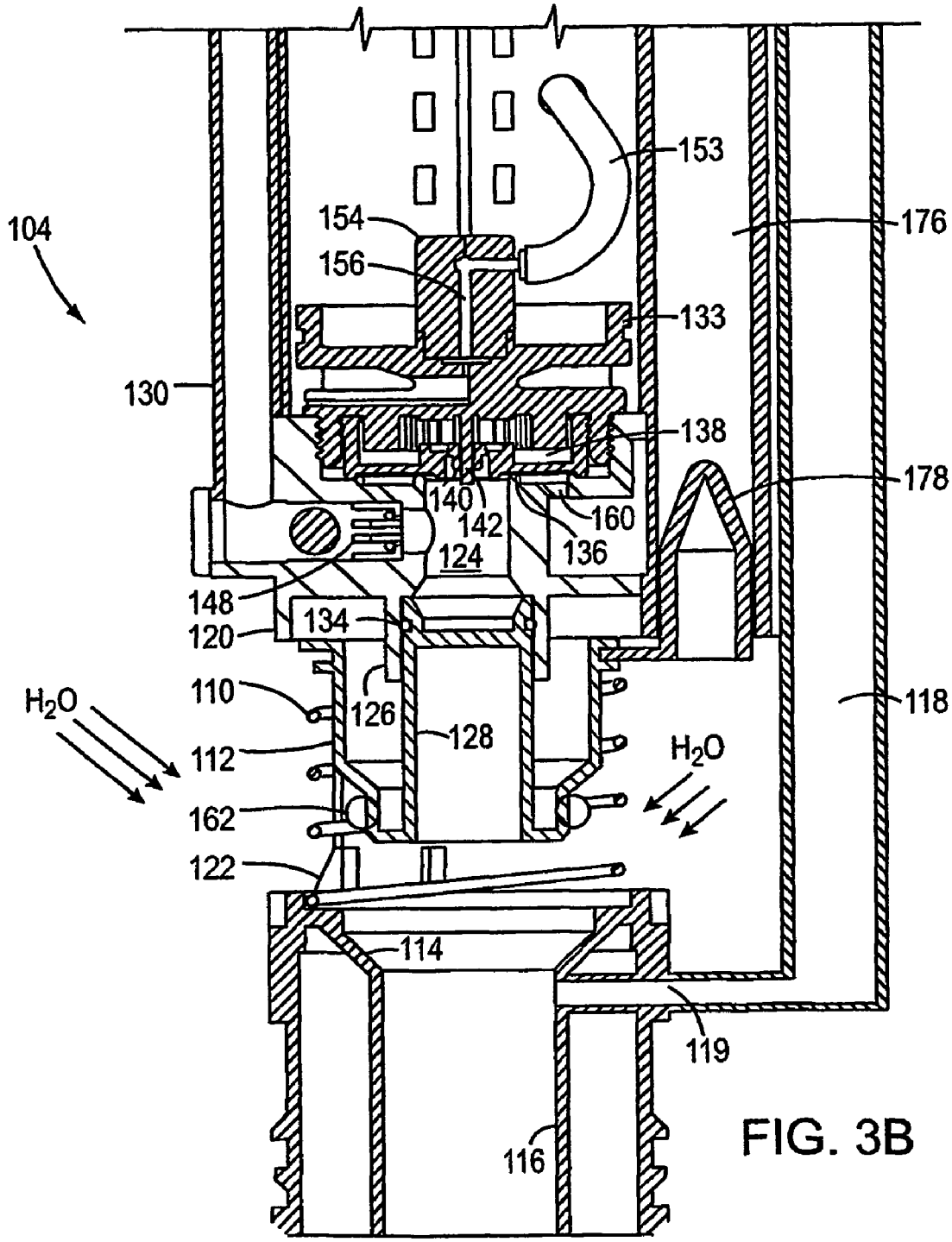
FIG. 3B is a detailed cross-sectional view of the flush valve used in the gravity-type flusher shown in FIG. 3.

FIGS. 3, 3A and 3B illustrate a first embodiment of a gravity-type flusher 100 including a fill valve 102 and a flush valve 104 constructed in a unitary structure. Flusher 100 is hydraulically actuated by actuator 32 or 36 controlled by microcontroller 34. Upon actuation, flush valve 104 facilitates water flow from storage tank 16 to bowl 13, and fill valve 102 facilitates filling of storage tank 16 from water line 17.

Flush valve 104 includes a flush-valve member 112, a flush diaphragm 132, and a set of passages. Flush-valve member 112 moves up and down between an opened state and a closed state, respectively. Within flush valve 104, a bias spring 110 forces flush-valve member 112 to the open position. That is, bias spring 110 keeps flush-valve member 112 separated from a flush-valve seat 114, formed on the inlet of a flush conduit 116 disposed at the bottom of a toilet tank 16A. As FIG. 3B shows in more detail, a lower main housing half 120, mounted by struts 122 on flush conduit 116, includes a pressure chamber 124 above flush-valve member 112. Housing 120 includes a cylinder 126 slidably arranged with a piston portion 128 of flush-valve member 112. Chamber 124 is ordinarily under pressure because of fluid communication provided by a pressure line 130 and a pressurized-water supply connected to passage 148. Passage 148 includes a check valve (preventing back flow) and a flow rate controller (i.e., a flow restrictor). The flow restrictor is calibrated to provide slow but consistent water flow to chamber 124. This creates controlled closure by the external line pressure. Diaphragm 132 seals chamber 124 on the top at passage 136 (FIG. 3B). When the force created by water supply at pressure chamber 124 prevails over the force of spring 110, the line pressure holds valve member 112 in a seated position.

Pressure chamber 124's pressure ordinarily prevails because a pilot-valve diaphragm 132 secured in housing half 120 by a pilot-valve cap 133 ordinarily cooperates with the valve member's seal ring 134 to prevent escape of pressurized water from chamber 124. The pilot-valve diaphragm 132 is resiliently deformable, so the pressure that prevails within chamber 124 would tend to lift it from engagement with a pilot-valve seat 136 and thus allow pressure relief if a similar pressure did not prevail over a larger area within a pilot chamber 138. The reason why this pressure prevails within pilot chamber 138 is that a small orifice (or groove) 140, through which a pilot-valve pin 142 formed by cap 133 extends, permits water to bleed (through a relatively high flow resistance) into pilot chamber 138 from pressure chamber 124. Thus, valve member 112 remains in the seated position (not shown) between flushes.

Actuator 32 or 36 communicates with a passage 156, which in turn communicates with pilot chamber 138. To cause the system to flush, actuator 32 or 36 lowers pressure in pilot chamber 138, which deflects diaphragm 132 upwards enabling water flow at regions 136. The flow resistance through orifice 140 in pin 142 is much higher than through the bleed orifice communicating with passage 156, so the pressure within pilot chamber 138 is lower than pressure in chamber 124. This lower pressure drop creates an opposite force that raises diaphragm 132 off its seat, as shown in FIG. 3B. Diaphragm 132 serves as a pressure-relief valve that lowers the water pressure within chamber 124. As a consequence, bias spring 110 overcomes the force exerted by the pressure within chamber124. The flush-valve member 112 therefore rises (i.e., member 128 slides up within cylinder 126), lifting its O-ring seal 162 off the main valve seat 114 and thereby allowing the tank to empty as shown in FIG. 3B by a set of arrows.

Importantly, O-ring 162 may be replaced by a rubber seal or a plastic seal having a viper-shaped blade 163 (shown in FIG. 3A). The viper-shaped blade is designed both to provide a seal on seat 114 and to remove any deposits located on the surface of seat 114. The design and the action of the viper-shaped blade further helps in preventing water leaks.

Referring again to FIGS. 3 and 3A, float valve assembly 102 uses a diaphragm-operated valve 108 and a float 109 located within a cage 107 to control water flow to tank 16. Fill valve 102 includes a diaphragm 170 mounted on a diaphragm pin 140 and separating pilot chamber 138 from pressure chamber 124 in communication with water supply provided by input line 17 (FIG. 1). Diaphragm pin 190 includes a groove 192, which provides communication between pilot chamber 179 and pressure chamber 180. In the closed state, diaphragm 170 seals chamber 180. In the open state, diaphragm 170 deflects to provide a passage from chamber 180 to passages 182 and 184 (shown in FIG. 5A). Fill-valve diaphragm 170 is held between a valve cap and a valve plug threadedly secured to the valve cap and also sealed to the float-valve frame 172. At rest, resilient diaphragm 170 sits against a valve seat that the valve cap forms. When diaphragm valve 108 is opened, water from line 17 flows through main valve passage 174 and fill tube 176 inside tank 16. So long as ball float 109 does not plug a pressure-relief orifice, the pressure within passage 180 is higher than pressure inside pilot chamber 179, which causes such a deformation of the resilient diaphragm 170 so that water from chamber 180 can flow around the valve seat through a valve-cap opening 182 (see FIG. 5A) passage 184 and openings in the float-valve frame into fill tube 176.

Detailed description is provided in PCT Application PCT/US01/43273, filed on Nov. 20, 2001, entitled "Toilet Flusher with Novel Valves and Controls" which is incorporated by reference.

Referring again to FIGS. 3 and 3A, fill tube 176 is designed for controlled filling of tank 16. Since the line pressure is what closes flush-valve member 112, significant tank-filling flow might impair that valve's closing performance. If flush-valve member 112 remains in the unseated state, water being filled flows from tank 16 to bowl 13. Therefore, there is a flow restrictor 178 (FIG. 3B) so that when the flush-valve member 112 is in its fully unseated position, water cannot flow at any significant rate from fill tube 175 into tank 16. Flow restrictor 178 is mounted on the flush-valve member and protrudes into the fill tube's (176) outlet as to restrict the tube's flow area greatly. This has the beneficial effect of maintaining high pressure in the manifold 148 and thus pressure line 130. The flow-restrictor operation just described tends to make the flush valve's operation more predictable in duration than it would otherwise be. Importantly, tank filling does not adversely affect the pressure that operates to close flush-valve member 112. However, the pressure from the water source 17 can vary. This pressure variation can create undesired variations in the delay between the remote valve's closing and that of the flush valve.

The pressure in the pressure line and the size of orifice 140 (in the diaphragm valve) affect the speed at which the manifold pressure closes the pilot valve and thus imposes on the flush valve the pressure that closes it. In other words, flow restrictor 178 ensures that there is enough pressure to close flush valve 104 with significant speed. When flush valve 104 does close, movement of member 112 retracts flow restrictor 178 from fill tube 176 and thereby allowing the tank to fill rapidly.

Flush valve 104 also includes a check valve and a flow-rate controller 150 located inside passage 148. The check valve prevents back flow of water from chamber 124. Flow-rate controller 150 is a flow restrictor calibrated to provide slow but consistent water flow to chamber 124. The particular type of flow rate controller 150 is not critical, but may be one of the deformable-ring variety. The flow rate controller creates controlled closure by the external line pressure. The external line pressure acts against spring 110 to keep flush valve member 112 in the closed position.

Pressurizer conduit 130 includes a check valve 152 preventing back flow from chamber 124 so that the pressure holding flush valve 104 closed is not lost when pressure in line 17 drops. In the absence of check valve 152, such a pressure drop or loss would cause flush valve 104 to open, thus causing an unintended water flush from storage tank 16.

Both gravity-type flushers 100 and 100A are constructed to comply with applicable EU standards and US standards. Specifically, gravity-type flushers 100 and 100A are constructed to comply with the standard entitled "Dual Flush Devices for Water Closets," issued in 1994 as ASME A112.19.10-1994, and the proposed ASME A112.19.10-2002, both of which are incorporated by reference.

Figure 3C:
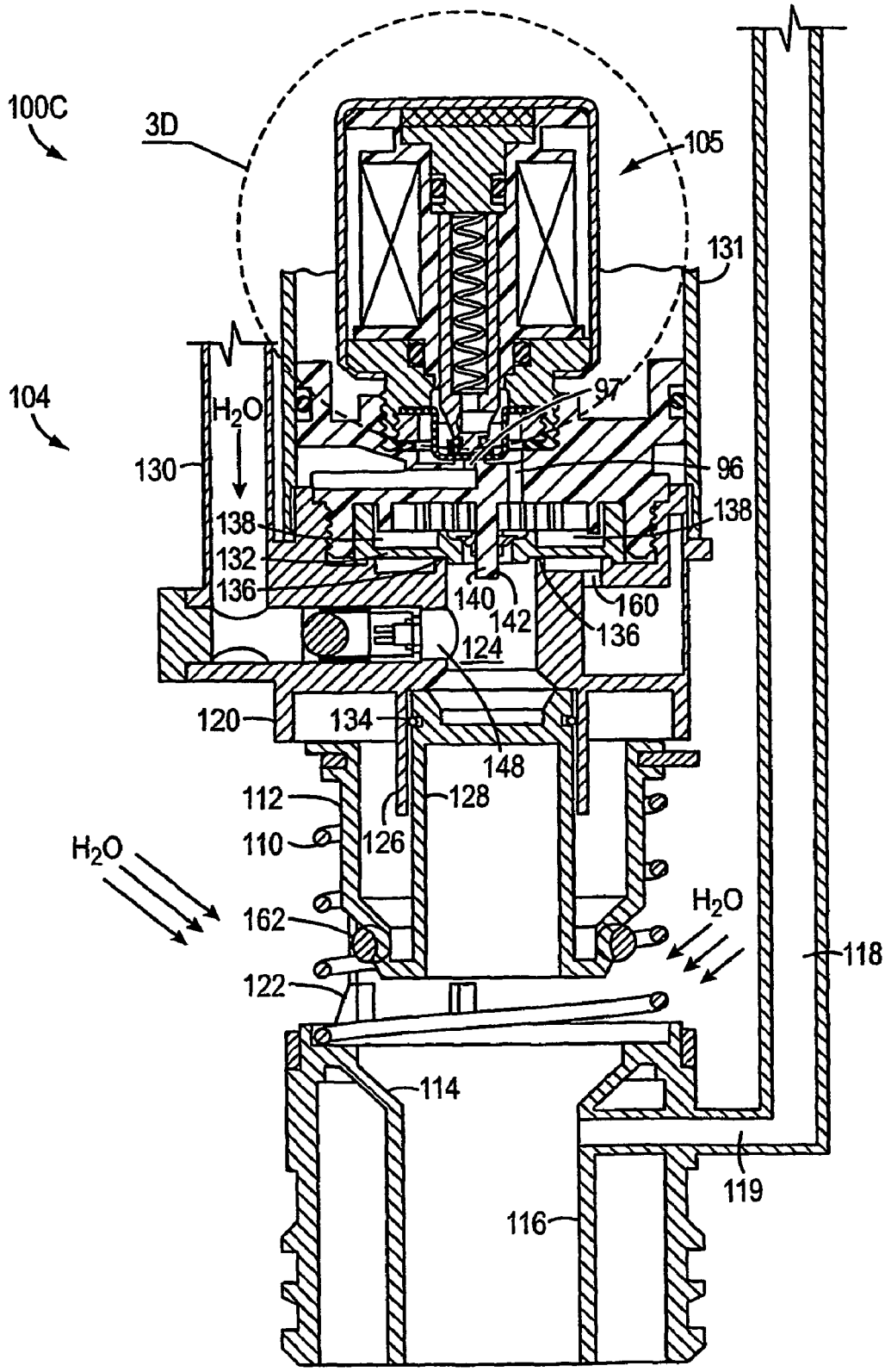
FIG. 3C is a cross-sectional view of another embodiment of the gravity-type flusher having the flush valve directly controlled by an electromagnetic actuator mounted onto the flusher body.

FIG. 3C is a cross-sectional view of another embodiment of the gravity-type flusher having flush valve 104 directly controlled by an electromagnetic actuator (FIG. 3D) mounted and sealed inside the flusher body. As described above, flush valve 104 includes flush-valve member 112, flush diaphragm 132, and a set of passages. Flush-valve member 112 moves up and down between the opened state and the closed state, respectively. Within flush valve 104, bias spring 110 forces flush-valve member 112 to the open position. Housing 120 includes a cylinder 126 slidably arranged with a piston portion 128 of flush-valve member 112. Chamber 124 is ordinarily under pressure because of fluid communication provided by a pressure line 130 and a pressurized-water supply connected to passage 148 (including a check valve). Diaphragm 132 seals chamber 124 on the top at passage 136 (FIG. 3B). When the force created by water supply at pressure chamber 124 prevails over the force of spring 110, the line pressure holds valve member 112 in a seated position.

Pressure chamber 124's pressure ordinarily prevails because a pilot-valve diaphragm 132 secured in housing half 120 by a pilot-valve cap 133 ordinarily cooperates with the valve member's seal ring 134 to prevent escape of pressurized water from chamber 124. The pilot-valve diaphragm 132 is resiliently deformable, so the pressure that prevails within chamber 124 would tend to lift it from engagement with a pilot-valve seat 136 and thus allow pressure relief if a similar pressure did not prevail over a larger area within a pilot chamber 138. The reason why this pressure prevails within pilot chamber 138 is that a small orifice (or groove) 140, through which a pilot-valve pin 142 formed by cap 133 extends, permits water to bleed (through a relatively high flow resistance) into pilot chamber 138 from pressure chamber 124. Thus, valve member 112 remains in the seated position (not shown) between flushes.

To open flush valve 104 (i.e., to cause flush-valve member 112 to lift off seat 114), microcontroller 34 (FIGS. 2, 2A, 2B) initiates delivery of drive current to actuator coil 428 (FIG. 3D) to open. This permits the pressure within the control-valve chamber 124 to be relieved through the pilot-valve inlet and outlet passages. Water leaves control chamber 124. Because of the high resistance to flow through the bleed groove between orifice 140 and pin 142, the resultant pressure loss in the control-valve chamber 124 is not immediately transmitted to the cap neck's interior, so the net force on diaphragm 132 is now upward and unseats it. The bottom surface of the pilot-valve member can provide a diaphragm stop that includes an annular diaphragm-stop ring from which diaphragm-stop teeth extend radially inward. This prevents the flush valve diaphragm 132 from being deformed excessively by the upward force exerted on it.

Once diaphragm 132 has been unseated, fluid can flow from the cap neck's interior 124 over valve seat 136 and out the control-valve ports. This relieves the pressure within cylinder chamber that had previously kept the flush-valve member 112 seated. The flush-valve spring 110 can therefore unseat the flush-valve member, and water flows from the tank interior through flush-conduit ports 122 and flush passage 116 into the toilet bowl. Overflow tube 118 delivers excess water from storage tank 16 via passage 119 to flush passage 116.

Figure 3D:
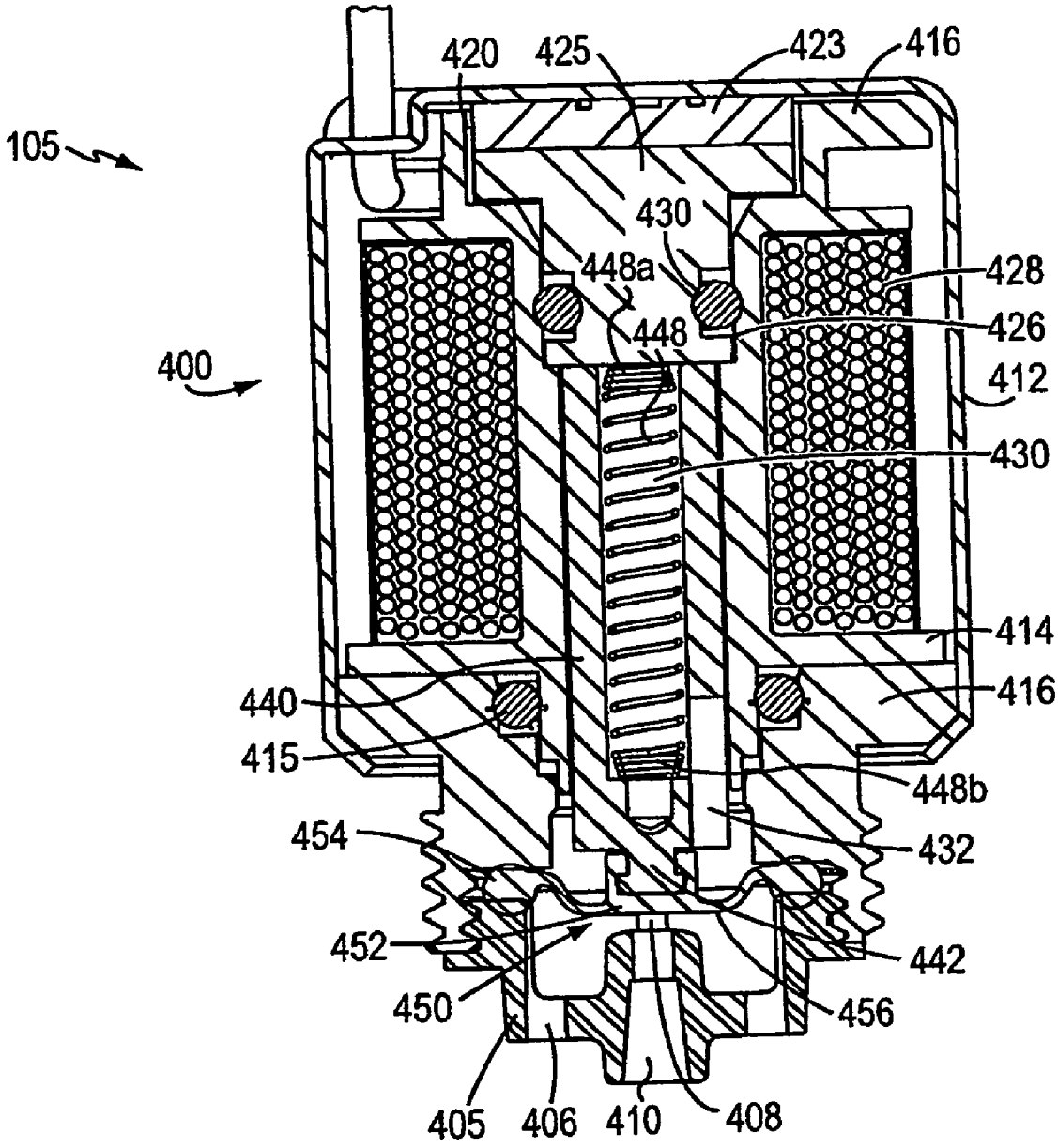
FIG. 3D is a detailed cross-sectional view of the electromagnetic actuator shown in FIG. 3C.

The above-described automatic flushers are controlled by actuators described in PCT applications PCT/US01/51098 and PCT/US02/38758, both of which are incorporated by reference, and may utilize various embodiments of the actuator. Referring to FIG. 3D, isolated actuator 400 includes an actuator base 416, a ferromagnetic pole piece 425, a ferromagnetic armature 440 slideably mounted in an armature pocket formed inside a bobbin 414. Ferromagnetic armature 440 includes a distal end 442 (i.e., plunger 442) and an armature cavity 430 having a coil spring 448. Coil spring 448 includes reduced ends 448*a* and 448*b* for machine handling. Ferromagnetic armature 440 may include one or several grooves or passages 432 providing communication from the distal end of armature 440 (outside of actuator base 416) to armature cavity 430 and to the proximal end of armature 440, at the pole piece 425, for easy movement of fluid during the displacement of the armature.

Isolated actuator body 400 also includes solenoid windings 428 wound about solenoid bobbin 414 and magnet 423 located in a magnet recess 420. Isolated actuator body 400 also includes a resiliently deformable O-ring 415 that forms a seal between solenoid bobbin 414 and actuator base 416, and includes a resiliently deformable O-ring 431 that forms a seal between solenoid bobbin 414 and pole piece 425, all of which are held together by a solenoid housing 412. Solenoid housing 412 (i.e., can 412) is crimped at actuator base 416 to hold magnet 423 and pole piece 425 against bobbin 414 and thereby secure windings 428 and actuator base 416 together.

Isolated actuator 400 also includes a resilient membrane 450 that may have various embodiments shown and described in PCT Application PCT/US02/38758. As shown in FIG. 3D, resilient membrane 450 is mounted between actuator base 416 and a piloting button 405 to enclose armature fluid located a fluid-tight armature chamber in communication with an armature port 432. Resilient membrane 450 includes a distal end 452, O-ring like portion 454 and a flexible portion 456. Distal end 452 comes in contact with the sealing surface in the region 408. Resilient membrane 450 is exposed to the pressure of regulated fluid provided via conduit 406 in piloting button 405 and may therefore be subject to considerable external force. Furthermore, resilient membrane 450 is constructed to have a relatively low permeability and high durability for thousands of openings and closings over many years of operation.

Referring still to FIG. 3D, actuator base 416 includes a wide base portion substantially located inside can 412 and a narrowed base extension threaded on its outer surface to receive a shipping fluid cap (described in PCT/US02/38758) or for coupling to a valve body as shown in FIG. 3C. The inner surface of the base extension threadedly engages complementary threads provided on the outer surface of piloting button 405. Membrane 450 includes a thickened peripheral rim 454 located between the base extension lower face and piloting button 405. This creates a fluid-tight seal so that the membrane protects the armature from exposure to external fluid flowing in the main valve.

Resilient membrane 450 encloses armature fluid located in a fluid-tight armature chamber in communication with an armature port 432 formed by the armature body 440. Furthermore, resilient membrane 450 is exposed to the pressure of regulated fluid in main valve and may therefore be subject to considerable external force. However, armature 440 and spring 430 do not have to overcome this force, because the conduit's pressure is transmitted through membrane 450 to the incompressible armature fluid within the armature chamber. The force that results from the pressure within the chamber therefore approximately balances the force that the conduit pressure exerts.

Referring still to FIG. 3D, armature 440 is free to move with respect to fluid pressures within the chamber between the retracted and extended positions. Armature port 432 enables the force-balancing fluid displaced from the armature chamber's lower well through the spring cavity 430 to the part of the armature chamber from which the armature's upper end (i.e. distal end) has been withdrawn upon actuation. Although armature fluid can also flow around the armature's sides, arrangements in which rapid armature motion is required should have a relatively low-flow-resistance path such as the one that port 432 helps form. Similar considerations favor use of an armature-chamber liquid that has relatively low viscosity. Therefore, the isolated operator (i.e., actuator 400) requires for operation only low amounts of electrical energy and is thus uniquely suitable for battery operation.

In the latching embodiment shown in FIG. 3D, armature 440 is held in the retracted position by magnet 423 in the absence of a solenoid current. To drive the armature to the extended position therefore requires armature current of such a direction and magnitude that the resultant magnetic force counteracts that of the magnet by enough to allow the spring force to prevail. When it does so, the spring force moves armature 440 to its extended position, in which it causes the membrane's exterior surface to seal against the valve seat (e.g., the seat of piloting button 405). In this position, the armature is spaced enough from the magnet that the spring force can keep the armature extended without the solenoid's help.

To return the armature to the illustrated, retracted position and thereby permit fluid flow, current is driven through the solenoid in the direction that causes the resultant magnetic field to reinforce that of the magnet. As was explained above, the force that the magnet 423 exerts on the armature in the retracted position is great enough to keep it there against the spring force. However, in the non-latching embodiment that doesn't include magnet 423, armature 440 remains in the retracted position only so long as the solenoid conducts enough current for the resultant magnetic force to exceed the spring force of spring 448.

Advantageously, diaphragm membrane 450 protects armature 440 and creates a cavity that is filled with a sufficiently non-corrosive liquid, which in turn enables actuator designers to make more favorable choices between materials with high corrosion resistance and high magnetic permeability. Furthermore, membrane 450 provides a barrier to metal ions and other debris that would tend to migrate into the armature cavity and eventually obstruct the movement of armature 440.

Diaphragm membrane 450 includes a sealing surface 452, which is related to the seat opening area, both of which can be increased or decreased. The sealing surface 452 and the seat surface of piloting button 405 can be optimized for a pressure range at which the valve actuator is designed to operate. Reducing the sealing surface of 452 (and the corresponding tip of armature 440) reduces the plunger area involved in squeezing the membrane, and this in turn reduces the spring force required for a given upstream fluid-conduit pressure. On the other hand, making the plunger tip area too small tends to damage diaphragm membrane 450 during valve closing over time. Preferable range of tip-contact area to seat-opening area is between 1.4 and 12.3. The present actuator is suitable for variety of pressures of the controlled fluid, including pressures of about 150 psi. Without any substantial modification, the valve actuator may be used in the range of about 30 psi to 80 psi, or even water pressures of about 125 psi.

Figure 3E:
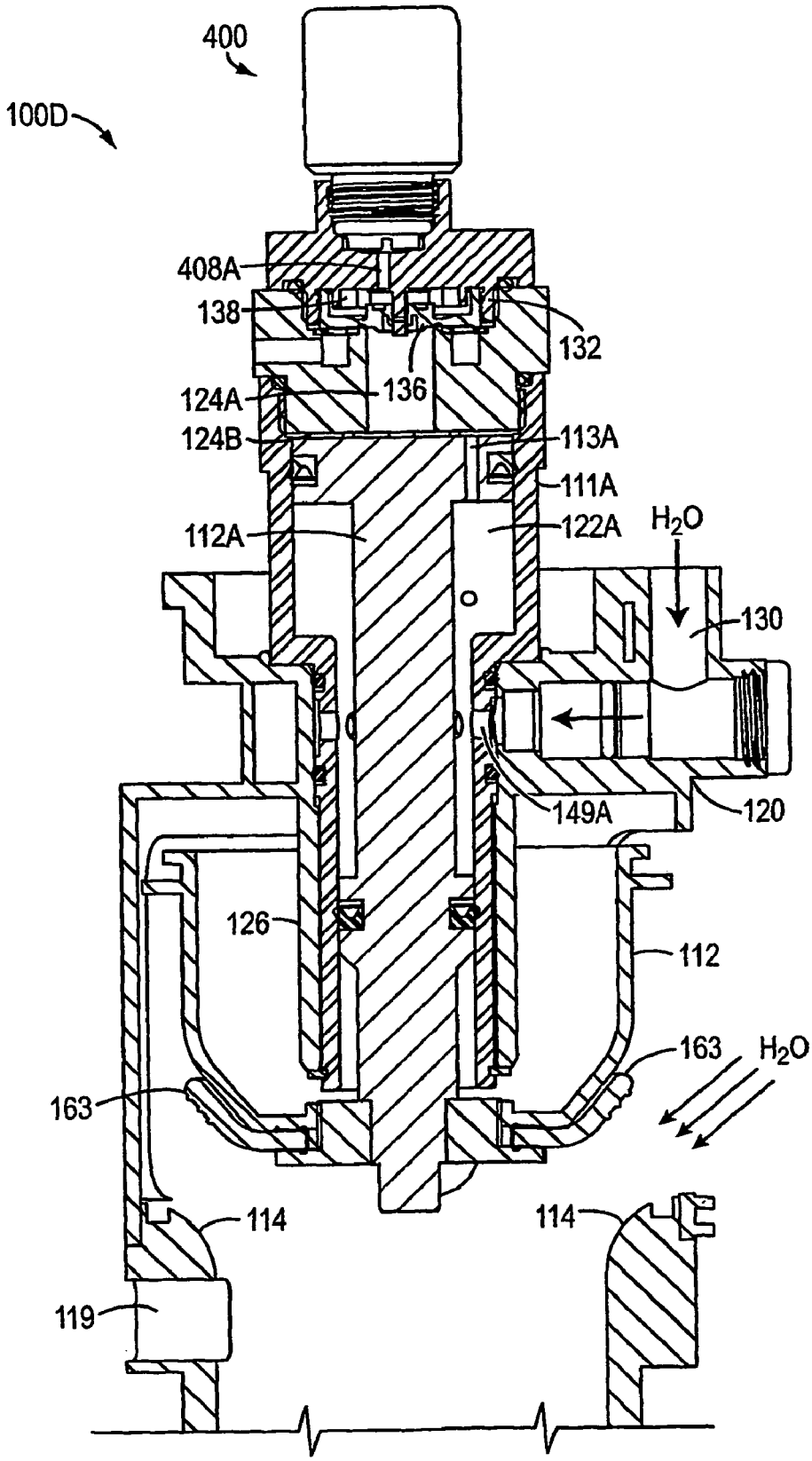
FIG. 3E is a cross-sectional view of another embodiment of the gravity-type flusher having the flush valve directly controlled by an electromagnetic actuator mounted onto the flusher body.

Piloting button 405 has an important novel function for achieving consistent long-term piloting of the diaphragm valve shown in FIGS. 3C and 3E. Solenoid actuator 400 together with piloting button 405 are installed together as one assembly into the electronic faucet; this minimizes the pilot-valve-stroke variability at the pilot seat in region 408 with respect to the closing surface which variability would otherwise affect the piloting operation. This installation is faster and simpler than prior art installations.

The assembly of operator 400 and piloting button 405 is usually put together in a factory and is permanently connected thereby holding diaphragm membrane 450 and the pressure loaded armature fluid (at pressures comparable to the pressure of the controlled fluid). Piloting button 405 is coupled to the narrow end of actuator base 416 using complementary threads or a sliding mechanism, both of which assure reproducible fixed distance between distal end 452 of diaphragm 450 and the sealing surface of piloting button 405. The coupling of operator 400 and piloting button 405 can be made permanent (or rigid) using glue, a set screw or pin. Alternatively, one member may include an extending region that is used to crimp the two members together after screwing or sliding on piloting button 405.

FIG. 3E shows another embodiment of the gravity-type flusher having the flush valve controlled by actuator 400 (or 32 in FIG. 2). Gravity-type flusher 100D is a modified version of the gravity-type flushers shown in FIGS. 3, 3A and 3C. Gravity-type flusher 100D includes body 111A constructed and arranged to receive a movable piston 112A. Movable piston 112A is sealed with respect to the inner surface of flusher body 111A using several O-rings (as known in the art). Gravity-type flusher 100D includes a lower chamber 122A formed between movable piston 112A and the flusher body 111A, and includes an upper control chamber 124A. Control chamber 124A is in communication with a control chamber 124B, which is located just above and in contact with movable piston 112A. A control passage 113A provides fluid communication between lower chamber 122A and upper control chamber 124B. Control chamber 122A is in communication with the external water line via a passage 149A and conduit 130. Passage 149A includes a check valve for preventing back flow.

In the open state shown in FIG. 3E, flush valve member 112 is in the unseated position. Here, the pressure in control chamber 124A is significantly lower than the input water pressure in chamber 122A since the diaphragm valve is open and there is water flow from diaphragm pilot chamber 138 by valve seat 136. That is, water flows via conduit 130 through the check valve and passage 149A to chamber 122A. From chamber 122A water flows via control passage 113A to the upper chambers 124A and 124B. From control chamber 124A, water flows by diaphragm valve seat 136 to the water tank.

To close flush valve 104, actuator 400 closes control passage 408A. This increases pressure inside diaphragm control chamber 138, which receives water flow through the bleed orifice provided by the pin, as described above. By increasing the water pressure inside diaphragm control chamber 138, diaphragm 132 seals upper chamber 124A at the seating surface 136. However, water still flows via conduit 130 through the check valve and passage 149A to chamber 122A.

From chamber 122A water flows via control passage 113A to the upper chambers 124A and 124B, where water pressure increases. After the upper chamber 124A is sealed there is a pressure build-up up to the line pressure in chambers 124A and 124B. Since water pressure inside chamber 124B acts practically over the entire top surface of movable piston 112A there is a large downward force. This force is larger than the upward force created by pressure inside chamber 122A. The net force difference forces movable piston 112A to its lower position, thereby moving flush valve member 112 to the seated position. In this seated position, rubber seal 163 seals the flush valve at the valve seat 114. In this embodiment, gravity-type flusher 100D does not use bias spring 110 used in the embodiments shown in FIGS. 3, 3A, 3C, 5 and 5B. Actuator 400 opens and closes flush valve 104, by causing pressure increase or decrease inside control chambers 124A and 124B.

Figure 4:
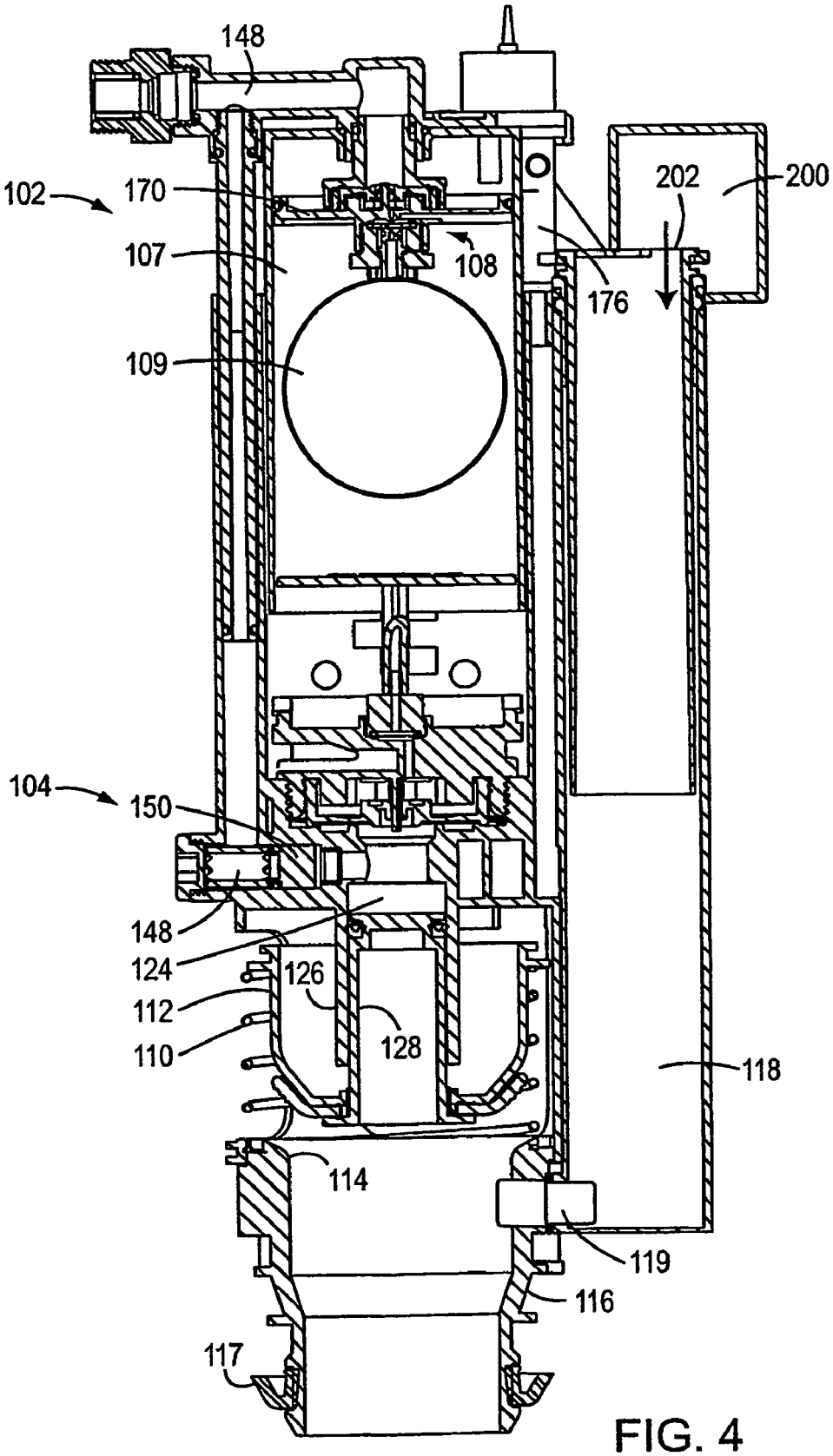
FIG. 4 is a cross-sectional view of the gravity-type flusher of FIG. 3 including a cleaner dispenser.

FIG. 4 illustrates in a cross-sectional view flusher 100 with a cleaner dispensing unit 200 mounted on the top of overflow tube 118. According to the first preferred embodiment, cleaner dispensing unit 200 includes a motor powered by a battery. The dispenser motor may be a 100 mW-200 mW motor powered by a 1.5 to 3V battery for dispensing a cleaning liquid via a port 202 down overflow tube 118 to flush tube 116 and toilet bowl 13. The cleaning solution is located inside cleaner dispensing unit 200 and this doesn't get diluted inside water tank 16. After each flush, microcontroller 34 can actuate the motor of cleaner dispensing unit 200 to deliver the cleaning solution as described above. Advantageously, microcontroller 34 can also count and store the number of cleaner dispensations. Each dispensing unit 200 has an approximate number of cleaner dispensations. Thus, microcontroller 34 can determine the empty state of dispensing unit 200 and can signal the need of a refill or the need to change cleaner dispensing unit 200.

A preferred embodiment of dispensing unit 200 is shown in FIGS. 4B-I and 4B-II. Dispensing unit 200 may be connected to the external water pressure and controlled hydraulically. Alternatively, this operation is controlled mechanically using an electric motor and a set of separate batteries. FIGS. 4B-I and 4B-II illustrate the operation of a cleaner dispenser 200 shown in FIG. 4 (or similarly a scent dispenser 210 shown in FIG. 4A). Cleaner dispenser 200 includes a 460 enclosing a flexible member 462 holding a cleaning fluid (or a scent fluid). The cleaning fluid is in communication with dosing ports 464 and 465 providing communication to a dosing chamber 468 and dispensing chamber 470. The dispenser also includes an actuator 472 and a dispensing piston 474 for delivering the cleaning fluid (or a scent fluid) via a dispensing port 476. Actuator 472 can be actuated either hydraulically (e.g., using outside water pressure) or mechanically. Upon actuation actuator 472 displaces piston 474, which in turn pushes the cleaning solution out through delivery port 476 into overflow tube 118 (in FIGS. 4 and 4A as shown by arrow 202).

FIG. 4B-I shows cleaner dispenser 200 in the "loading" position wherein the cleaning fluid is delivered by gravity via dosing ports 464 and 465 into dosing chamber 468 and dispensing chamber 470. There are numerous designs for the dosing ports (such as orifices or membranes). Due to the relatively high viscosity or the arrangement of the dispensing port (e.g., membranes or orifices), the cleaning fluid does not substantially leave dispensing chamber 470 before it is pushed out by piston 474. (Minor leaks of the fluid are acceptable since this open position occurs during or right after the toilet flush.)

FIG. 4B-II shows cleaner dispenser 200 in the closed position, after dispensation. In this position the flexible member 462 is extended and dosing ports 464 and 465 are closed. After actuation, dispensing piston 474 moves to the extended position thereby pushing the cleaning solution via dispensing port 476 into overflow tube 118. The movement is controlled by the movement of actuator 472, controlled hydraulically (using the water line pressure), pneumatically or mechanically. Alternatively, this operation is controlled mechanically using an electric motor and a set of separate batteries.

The entire process is repeated, wherein prior to dispensation, dosing chamber 468 and the dispensing chamber 470 are "charged" with the cleaning fluid (during or right after a toilet flush). Upon dispensation to dispensing chamber 470, the fluid is ejected via dispensing port 476, as described above. The dispenser can remain in the closed position for most of the time.

Figure 4A:
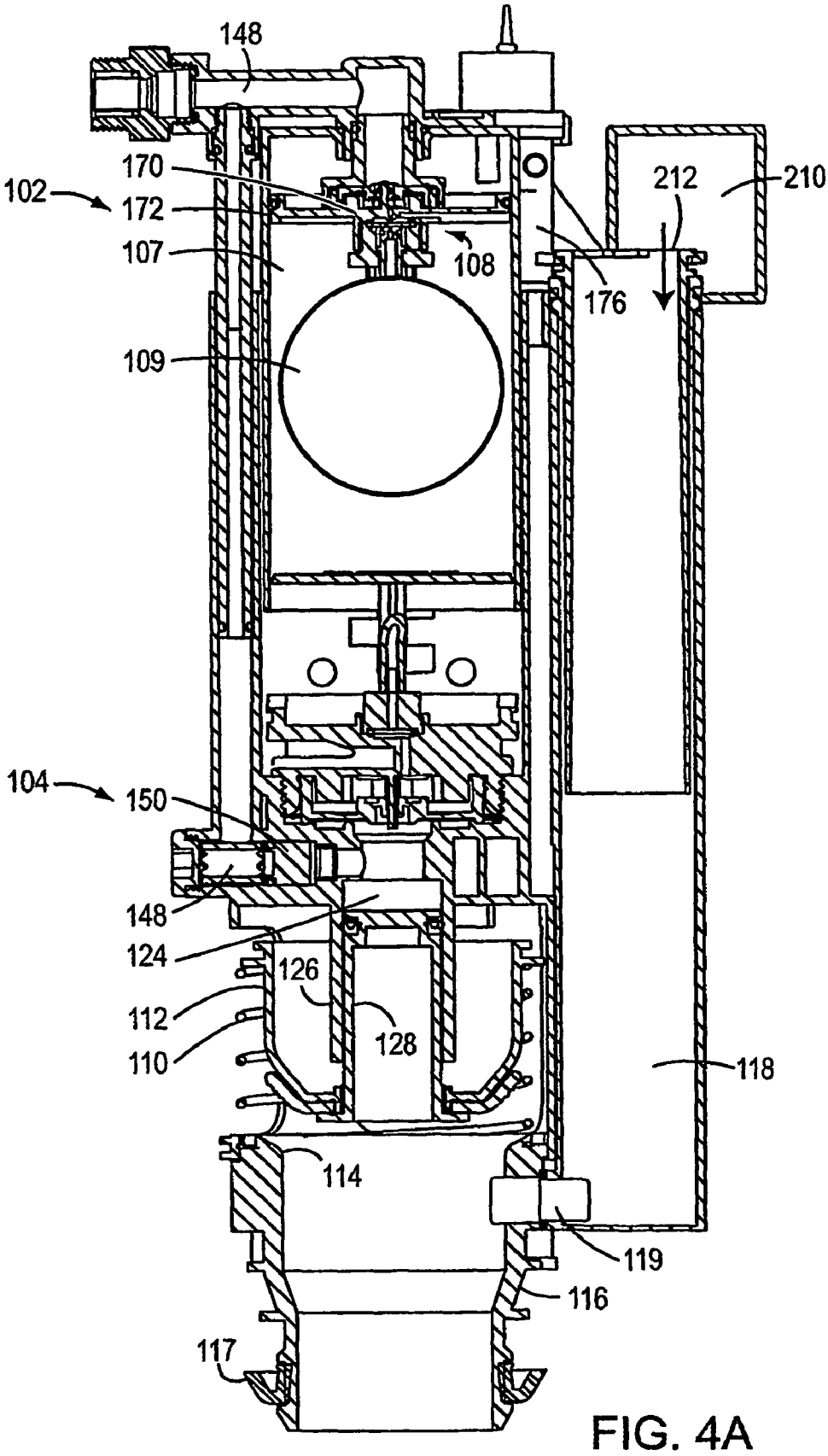
FIG. 4A is a cross-sectional view of a first embodiment of a gravity-type flusher of FIG. 3 including a scent dispenser.

FIG. 4A illustrates tank-type flusher 100 with a scent dispensing unit 210 mounted on overflow tube 118. Scent dispensing unit 210 may have a similar design as the above-described cleaner dispensing unit 200. Scent dispensing unit 210 may include a motor or a valve for actuating scent delivery via a passage 212. Scent dispensing unit 210 may be actuated upon user's input, or automatically using selected algorithms performed by microcontroller 34. For example, object sensor 20 may detect arrival of a user at toilet 12, and may provide a signal to microcontroller 34. Microcontroller 34 may then actuate scent-dispensing unit 210 for delivering scent into overflow tube 118 well before initiating the above-described flush cycle. Based on a selected algorithm, microcontroller 34 may initiate actuation of scent delivery unit 210 several times during the presence of a user at toilet 12. Furthermore, microcontroller 34 can activate scent-dispensing unit 210 after performing the above-described flush cycle. This way, the system enables targeted efficient delivery of scent during use of toilet 12.

Scent dispensing unit 210 may dispense scent that can be fragrance or an odor-eliminating chemical. The dispensation can be achieved by creating airflow by a fan powered by the motor, which fan forces the scent into toilet bowl 13 through overflow tube 118. Scent delivery unit 210 may also dispense a liquid scent in form of a liquid, or a solid in a powder or crystal form. Solid crystals may be forced into overflow tube 118 by air pressure. Alternatively, the solid may be mixed with water and delivered by water pressure from a jet using venturi effect. Alternatively, a fluid scent of cleaner can be dispensed using the energy provided by water delivered to the toilet via overflow tube 118 after each flush (as is performed with any flusher currently on the market). In this embodiment the dispensed fluid is stored in a container. The after-flush water is piped through this container using a venturi shaped nozzle; this flow creates suction effect discharging the scent or cleaning fluid from the storage container.

All communication connections, including the connections to object sensor module 20, push button or capacitive switch 18, or dispensing units 200 and 210, may be realized using a wireless approach. The push-button or sensing circuitry in such an approach can be located remotely to provide signal to microcontroller 34. The remote circuitry would include a wireless transmitter, and the local circuitry would include a wireless receiver responsive to the transmitter. For example, the transmitter and receiver may communicate by way of low-frequency—say, 125 kHz—electromagnetic waves. Such electromagnetic waves may be modulated by pulse trains so encoded as to minimize the effects of spurious reception from other sources. It may be preferable in wireless approaches for at least the local receiver to be located above the water line, but this is not required.

Figure 5:
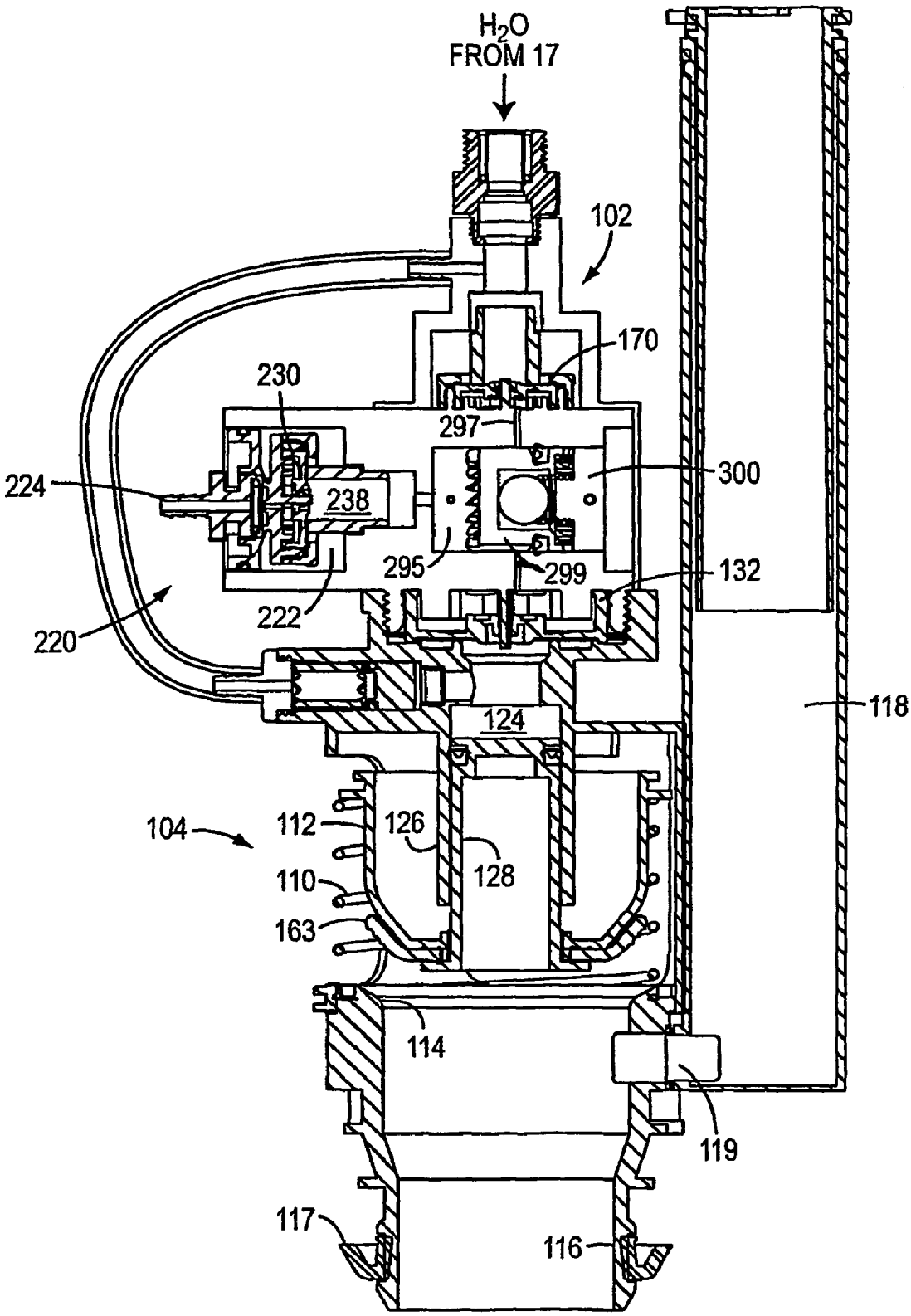
FIG. 5 is a cross-sectional view of another embodiment of a gravity-type flusher using a three way valve for controlling the flush valve and the fill valve.
Figure 5A:
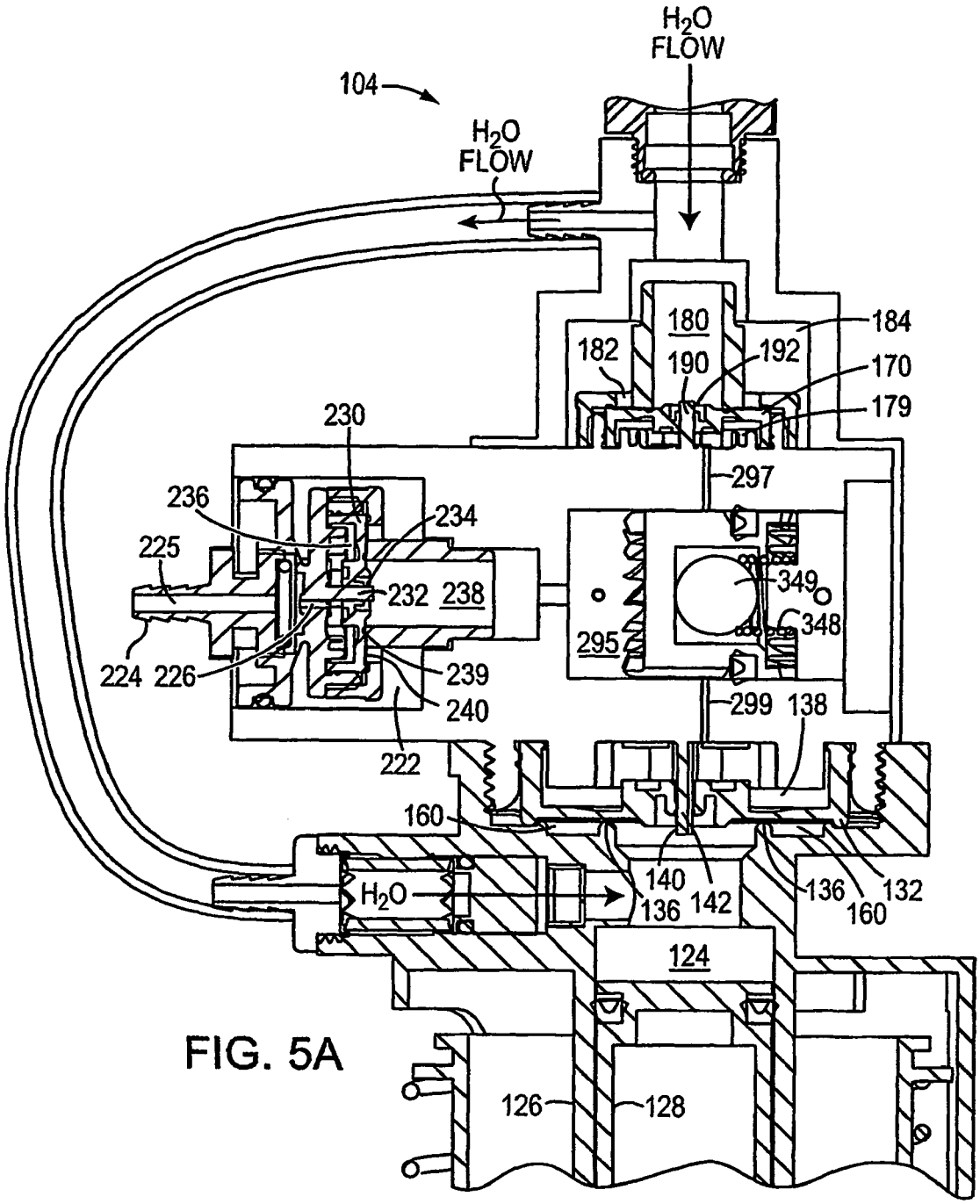
FIG. 5A is an enlarged cross-sectional view of the gravity type flusher shown in FIG. 5.

FIGS. 5 and 5A are cross-sectional views of a second embodiment of a tank-type flusher 100B. Tank-type flusher 100B includes fill valve 102, flush valve 104, a control valve 220, and a 3-way valve 300. Fill valve 102 and flush valve 104 operate substantially as described in connection with tank-type flusher 100, but are now controlled by 3-way valve 300. Alternatively, 3-way valve 300 may be replaced by 2 actuators arranged to control separately fill valve 102 and flush valve 104. The two actuators may be connected to and actuated by microcontroller 34.

Control valve 220 is located inside a cavity 222. Control valve 220 includes a coupling 224, a control passage 226, and a diaphragm 230 mounted on a pin 232. Pin 232 includes a groove 234. Diaphragm 230 separates a pilot chamber 236 from a pressure chamber 238. Pressure chamber 238 is in communication with a chamber 295, which includes 3-way valve 300. Coupling 224 is constructed and arranged to receive a hydraulic line having pressure controlled by actuator 32 or 36 (FIGS. 2 and 2A). Water pressure from actuator 32 or 36 is transmitted via a coupling passage 225 to a passage 226 and to pilot chamber 236. Pilot chamber 236 is in communication with pressure chamber 238 via groove 234. Therefore, water pressure in chambers 236 and 238 is the same. Due to a larger surface area inside pilot chamber 236 there is net force from pilot chamber 236 toward pressure chamber 238, which force keeps control valve 220 closed at regions 239.

Upon actuation, actuator 32 or 36 relieves pressure inside the hydraulic line coupled to coupling passage 225, which, in turn, reduces pressure in pilot chamber 236. The reduced pressure in pilot chamber 236 causes deflection of diaphragm 230 at regions 239. This deflection of diaphragm 230 enables water flow at regions 239 through passages 240 into chamber 222. The pressure reduction in pressure chamber 238 creates pressure reduction in chamber 295, which causes a state change of 3-way valve 300. Thus, actuator 32 or 36 changes the state of 3-way valve 300. The operation of 3-way valve 300 is described in detail in connection with FIGS. 6 through 6K. In short, by changing its state, 3-way valve 300 changes pressure either in a control passage 297 to fill valve 102, or changes pressure in a control passage 299 to flush valve 104.

Actuator 32 or 36 changes the state of 3-way valve 300 as follows: 3-way valve 300 is constructed and arranged to have initially both fill valve 102 and flush valve 104 closed. Upon actuation and opening of control valve 220, 3-way valve 300 changes its state to provide communication with passage 299 and thus causes opening of flush valve 104. Next, upon closing control valve 220, 3-way valve 300 changes its state to close communication with passage 299 and thus close flush valve 104, while fill valve 102 remains closed. Next, upon opening control valve 220, 3-way valve 300 changes its state to provide communication with passage 297 and thus causes opening of fill valve 102, while flush valve 104 remains closed. Finally, upon closing control valve 220, 3-way valve 300 changes its state to close communication with both control passage 297 and control passage 299.

Control passages 297 and 299 are arranged for controlling fill valve 102, and flush valve 104, respectively. Upon reducing pressure in control passage 297, pressure drops in a pilot chamber 179 of fill valve 102, which deflects diaphragm 170 and opens water flow from chamber 180 via passages 182 to a water passage 184 in communication with water to storage tank 16. Diaphragm pin 190 includes a groove 192, which provides communication between passage 182 and pilot chamber 179. Upon closing control passage 297, pressure slowly builds up in pilot chamber 179 via groove 192. After some time, the water pressure is equalized between pilot chamber 179 and pressure chamber 180. Upon this pressure equalization, diaphragm 170 deflects back and seals passage 182, thus closing fill valve 102.

Control passage 299 is used to control operation of flush valve 104. When 3-way valve 300 opens control passage 299, water pressure drops in pilot chamber 138 of flush valve 104. This pressure drop deflects diaphragm 132 and opens flush valve 104. Specifically, when diaphragm 132 is deflected away from regions 136, water flows from chamber 124 at regions 136 through passages 160. The pressure reduction inside chamber 124 causes flush valve member 112 to move from its seated state to its unseated state under the force created by bias spring 110, as described in connection with FIG. 3B. In the unseated state of flush valve member 112, water flows from storage tank 16 through flush conduit 116 into toilet bowl 13.

Referring again to FIG. 5A, when 3-way valve 300 changes its state and closes control passage 299, flush valve member 112 starts moving into its seated state. Specifically, upon closing control passage 299, pressure slowly builds up in pilot chamber 138 via groove 142. When the pressure is equalized between pilot chamber 138 and pressure chamber 124, diaphragm 132 deflects and seals chamber 124 at regions 136. The pressure in chamber 124 creates a force acting against bias spring 110, which force moves flush valve member 112 to its closed state, as described in connection with FIG. 3B.

Figure 5B:
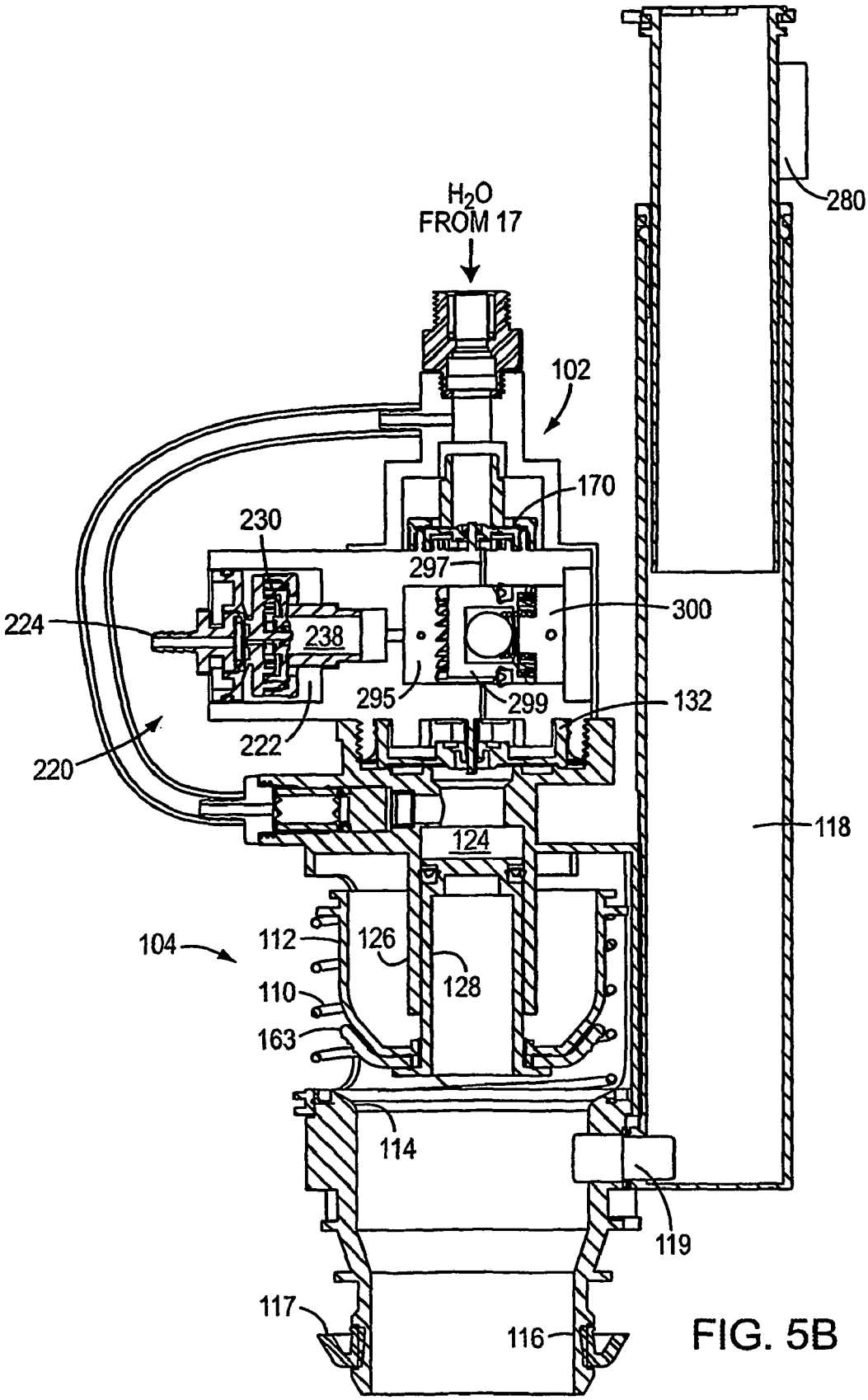
FIG. 5B is a cross-sectional view of the gravity-type flusher of FIG. 5, including a water level sensor.

FIG. 5B is a cross-sectional views of tank-type flusher 100A including a water level detector 280 mounted on overflow tube 118. Water level detector may include an electric, magnetic or optical sensor for sensing one or several predefined water levels. The electric sensor may be an inductive, resistive or capacitive sensor. After sensing a water level, the float sensor may provide a signal to a system controller.

Figure 5C:
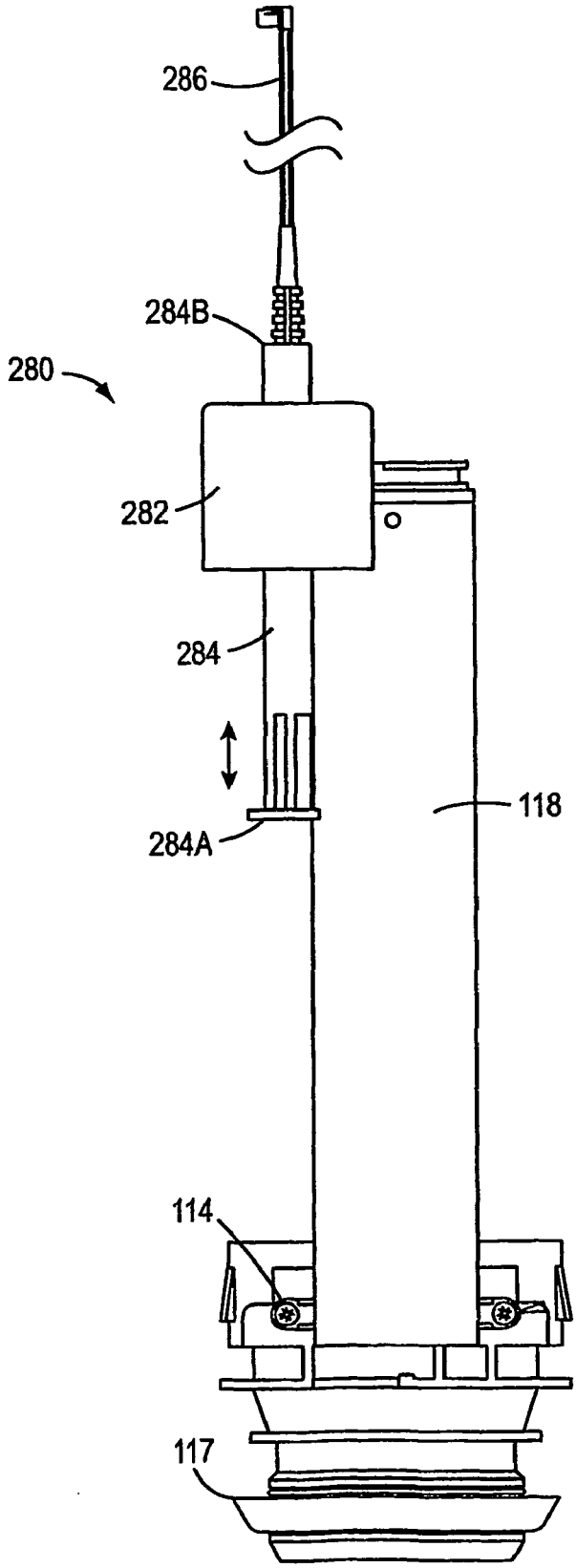
FIG. 5C is a more detailed view of the water level sensor shown in FIG. 5.

According to a preferred embodiment, FIG. 5C illustrates a novel water level sensor for use with any of the above-described gravity-type flushers. Water level sensor 280 includes a housing 282 attached to overflow tube 118. Housing 282 is cooperatively arranged with a float 284 moving up and down within housing 282 depending on the water level. Housing 282 includes a reed sensor coupled to the system electronics (shown in FIG. 2, 2A or 2B) via electrical connectors 286. Float 284 includes a set of magnets linearly disposed over the entire length of the float from the lower end 284A to the upper end 284B. The reed sensor is constructed and arranged to register individual magnets and provide the corresponding signal to microcontroller 34. As the water level increases, the top end 284B rises as float 284 moves within housing 282. During the movement of float 284, the reed sensor registers the individual magnets and thus provides information about the water level inside water tank 16. Microcontroller 34 processes the signal from the reed sensor and thus registers the water level.

Based on the water level information, microcontroller 34 can direct closure of fill valve 102 at the preselected water level. Furthermore, microcontroller 34 can direct opening or closing of flush valve 104 at the selected water level thereby providing a metered flush volume.

Furthermore, the system of FIG. 2, 2A or 2B is arranged together with water level sensor 280 to provide a water leak detector. During the failure of any or the water seals (e.g., water seal 163) water can leak from inside tank 16 into the toilet bowl. Over time float 284 drops within housing 282 as water leaks out. Microcontroller 34 detects reduction of water level without providing any prior flush command, i.e., detects the leak. Microcontroller 34 not only detects the leak, but also can calculate the leak rate. Based on the leak rate and characteristic over time, the microcontroller can indicate a possible type of failure. Indicator 48 (FIG. 2) provides a visual or audio indication about the water leak to a user.

Referring again to FIG. 5, similarly as described in connection with FIGS. 4 and 4A, flusher 100C may include a cleaner dispensing unit 200, mounted on the top of overflow tube 118, or may include scent dispensing unit 210, mounted on the top of overflow tube 118, or may include both units.

Figure 6:
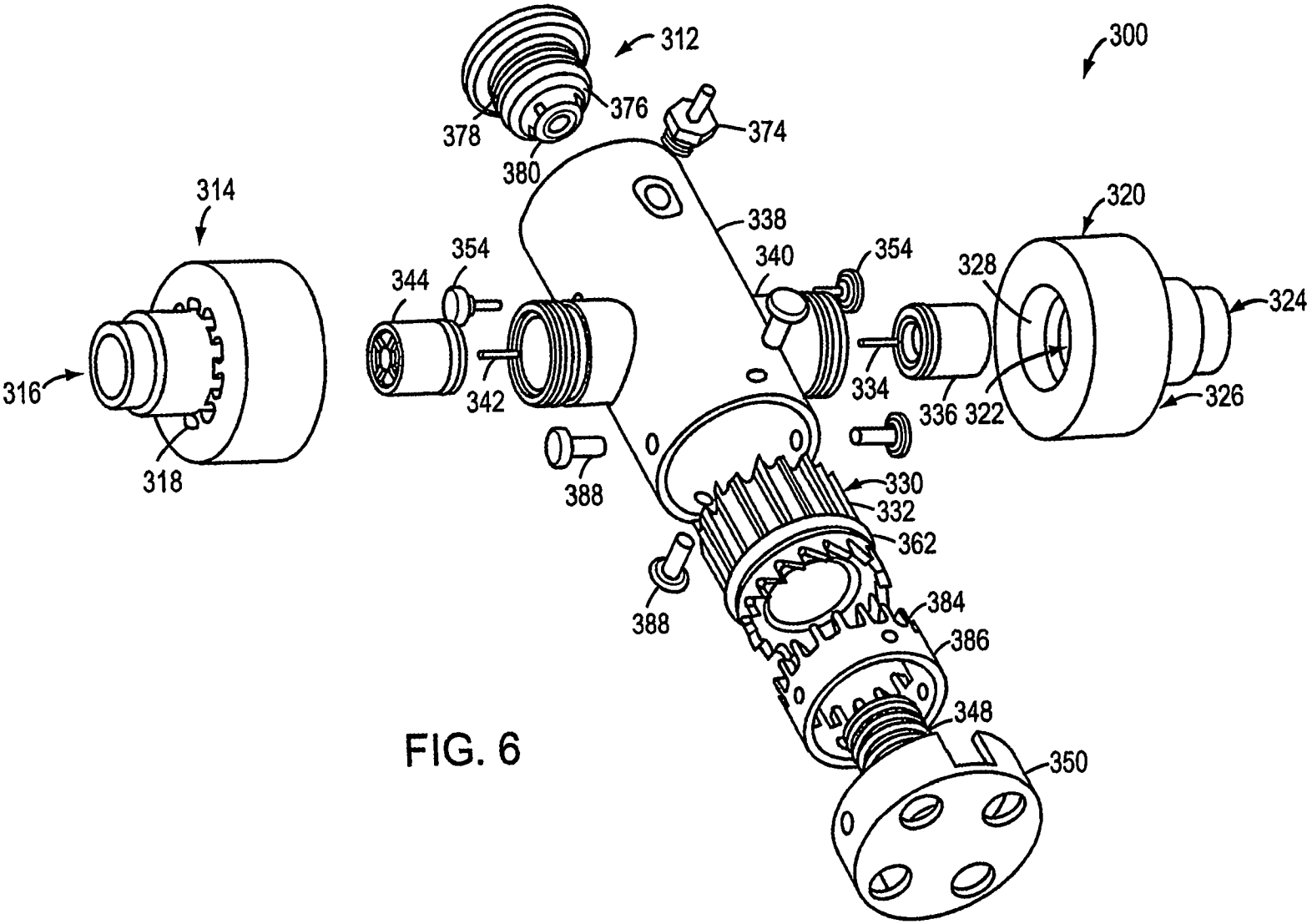
FIG. 6 is an exploded view of an embodiment of the present invention used as a three-way pilot valve to control flow in two main valves.

FIG. 6 is an exploded view of an embodiment of the present invention used as a three-way pilot valve to control flow in two main valves, which illustrate fill valve 102 and flush valve 104. Specifically, three-way valve 300 opens and closes a diaphragm valve inside 314 (representing fill valve 102) and a diaphragm valve inside 320 (representing flush valve 104), by actuating a control valve 312 (representing control valve 220) using actuator 32 or 36.

When valve 320 is in its closed position, a flexible diaphragm 322 (or diaphragm 132 in flush valve 104) is seated on a valve seat (seat 136 in flush valve 104) and thereby prevents flow from its inlet 324 (chamber 124 in flush valve 104) to its outlets 326 (outlet 160 in flush valve 104). The diaphragm remains seated despite the inlet pressure because the diaphragm 322 has a bleed orifice (i.e., groove 140 described above) that permits the pressure at the inlet 324 to build up within a pilot chamber 328 on the diaphragm's other side. On that side, the pressure prevails over a greater diaphragm area than it does on the inlet side, so it forces the flexible diaphragm to remain seated: it keeps valve 320 closed.

As will be explained in more detail below, valve 320 is opened from this state when the fluted surface 330 of an index member 332 is brought into a position in which it causes an operating pin 334 to unseat a check valve 336. Unseating check valve 336 relieves valve 320's pilot-chamber pressure into the interior of a manifold 338 through an inlet port 340. Index-member surface 330 will at the same time be so positioned as to permit another operating pin 342 to remain in a retracted position, where it permits a further check valve 344 to remain seated. That check valve thereby prevents relief of valve 314's pilot-chamber pressure, so valve 314 remains closed.

As will also be explained below, repeatedly opening and closing control valve 312 causes the index member 332 to advance through successive index positions, in some of which it instead closes both valves or opens valve 314 and closes valve 320. As will be seen presently, this results because member 332 is the index member of a reciprocation stepper. In the illustrated embodiment, moreover, it is also the reciprocation member, although the present invention's teachings can be implemented without employing the same member for both functions.

Figure 6A:
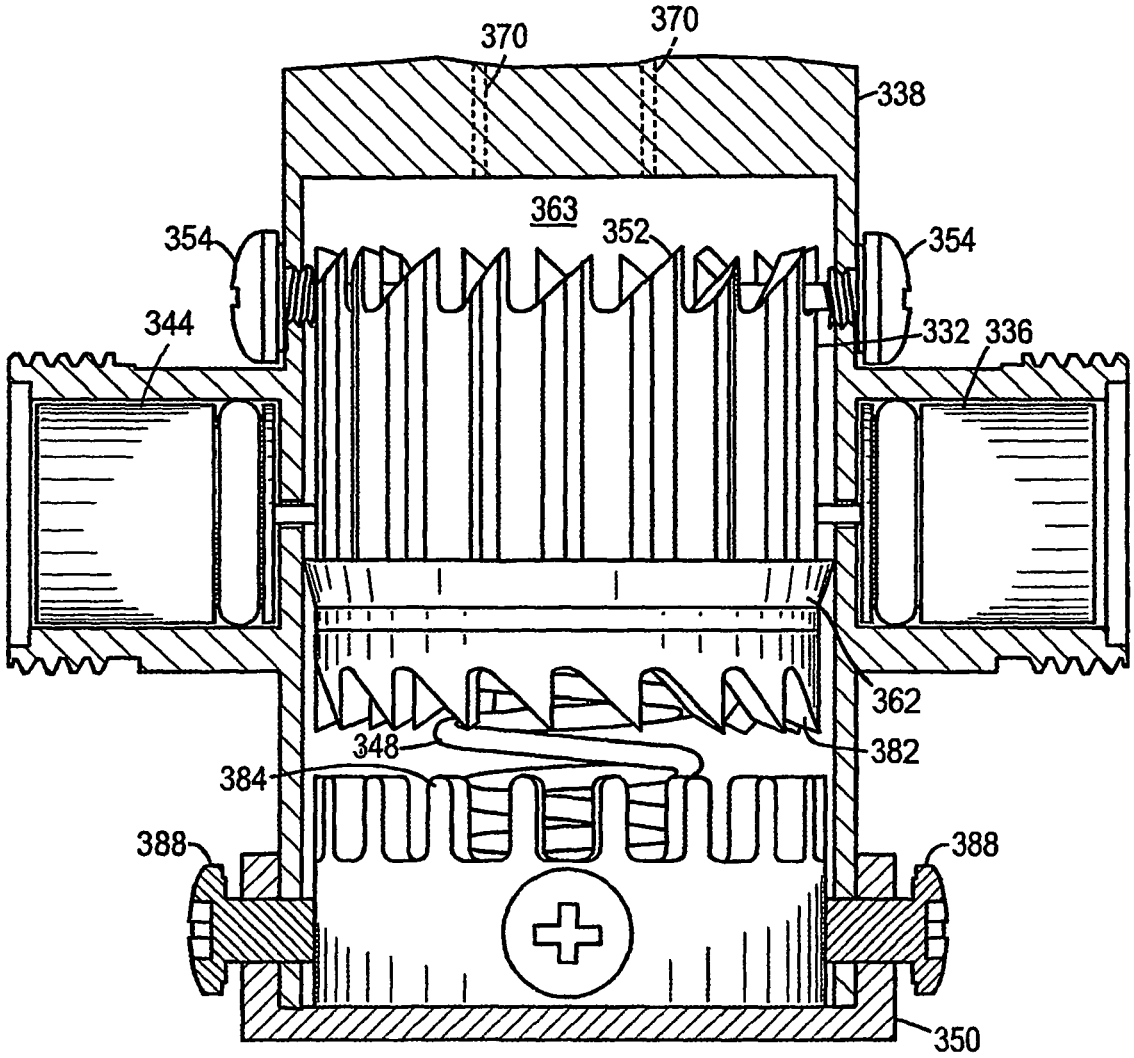
FIG. 6A is a front elevational view, partly broken away, of that multi-flow-state pilot valve with its index member in its relaxed reciprocation position.
Figure 6B:
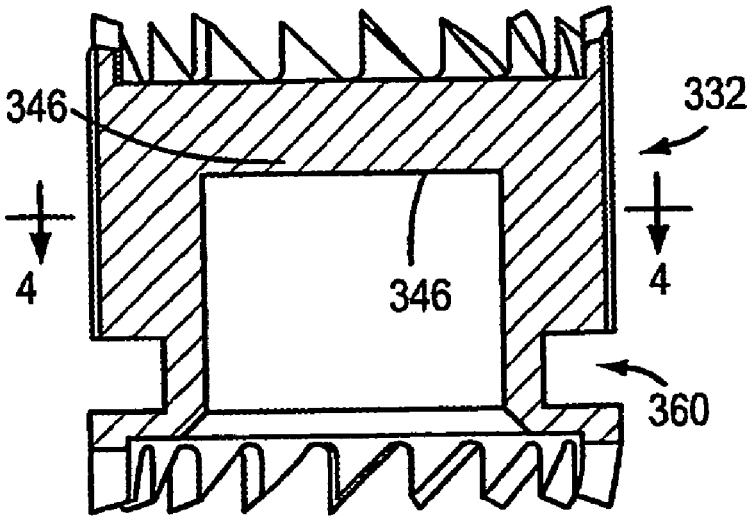
FIG. 6B is a vertical section through that pilot valve's index member.

FIG. 6A is a partially broken away elevational view of the manifold 338 into which the index member 332 has been assembled. As FIG. 6B illustrates, index member 332 forms an interior stop surface 346. In the state that FIG. 6A depicts, a bias spring 348 compressed by an end cap 350 has urged the index member 332 into an upward position, in which a generally sawtooth-shaped cam-follower surface 352 bears against cam pins 354 secured in holes that the manifold 338 forms. There may be a ball 349 (shown in FIG. 5A) in contact with bias spring 348 to reduce the corresponding friction.

Figure 6C:
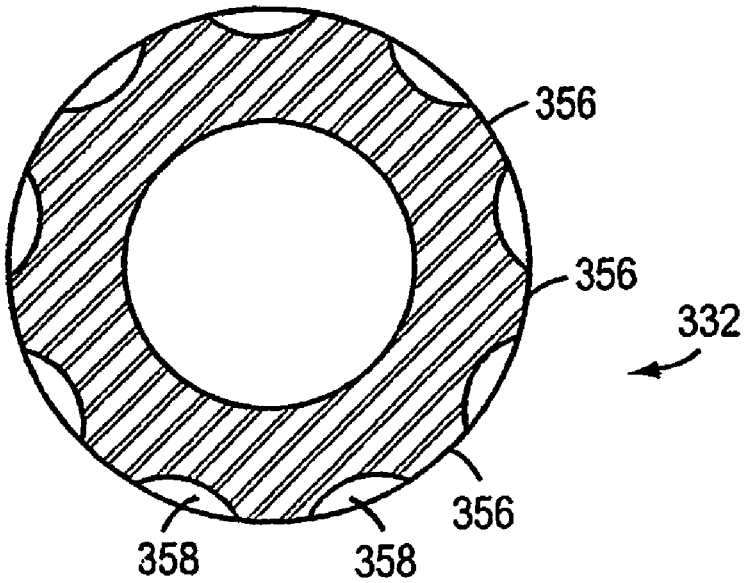
FIG. 6C is a cross section taken at line 4-4 of FIG. 6B.

FIG. 6C shows that the index member 332 forms a plurality of longitudinally extending lands 356. As will presently be explained in more detail, one of FIG. 6's actuating pins 334 and 342 is aligned with one of those lands, while other is not. The operating pin aligned with a land opens its corresponding check valve 336 or 344 and thereby admits fluid into the space that the longitudinal inter-land recess 358 (FIG. 6C) forms between the index member 332 and the manifold 338's interior wall.

Figure 6F:
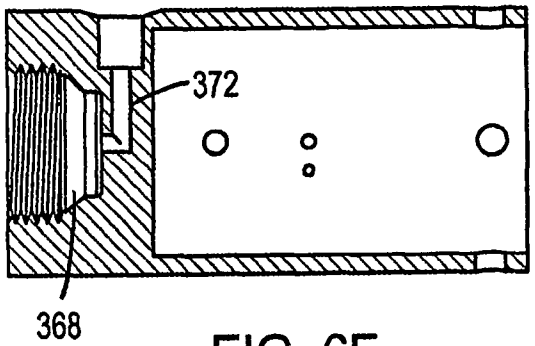
FIG. 6F is a cross-sectional view of the manifold taken at line 7-7 of FIG. 6D.
Figure 6D:
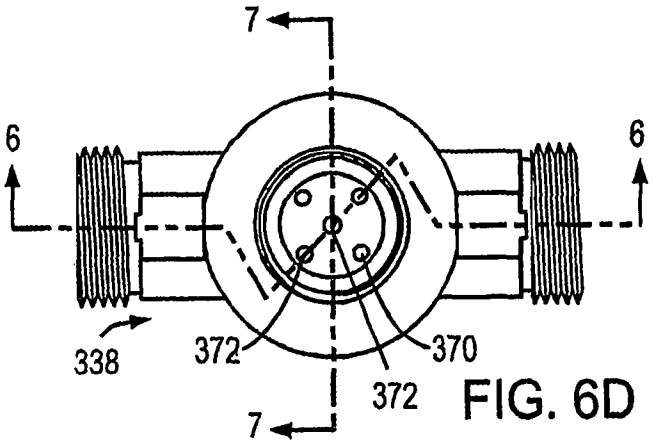
FIG. 6D is a plan view of the pilot valve's manifold.
Figure 6E:
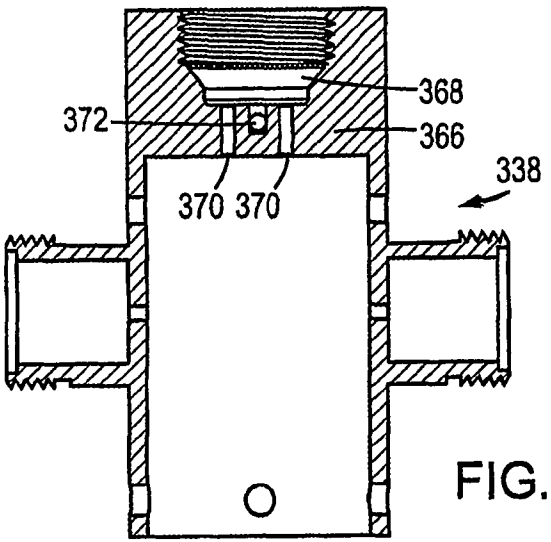
FIG. 6E is a cross-sectional view of the manifold taken at line 6-6 of FIG. 6D.

As FIG. 6B shows, the index member 332 forms an annular groove 360. As FIGS. 6 and 6A show, that groove receives a lip seal 362. Seal 362 prevents flow downward in FIG. 6A, but it does not prevent upward flow. If the manifold chamber 363 that the manifold 338's interior wall cooperates with the seal and FIG. 6B's top index-member wall 364 to form were completely closed, the pressure from the open port would simply be communicated to that chamber and thus not relieve the pressure in valve 314's pilot chamber. In the state that FIG. 6A is intended to represent, though, the manifold chamber is not closed, because a pressure-relief path prevents any elevated pressure from prevailing in the manifold chamber. Specifically, FIGS. 6D, 6E, and 6F show that the manifold 338's upper wall 366 forms a control chamber 368 into which four inlet ports 370 lead and from which an outlet port 372 leads to the manifold exterior through FIG. 6's drain fitting 374.

Now, the control-valve assembly 312 of FIG. 6 forms the control chamber 368's upper wall. Its outer O-ring 376 prevents leakage through the screw threads 378 by which the control-valve assembly 312 is secured to the manifold 338. And an inner O-ring 380 is so disposed as to prevent flow from the inlet ports 370 of FIG. 6's control chamber 368 to its outlet port 372 except through the control valve 312 itself. But that valve is open in the state that FIG. 6A is intended to represent, and the flow resistance through that valve is low enough when it is open to keep the manifold pressure too low to overcome the force that FIG. 6A's spring 348 exerts. So long as that valve is open, therefore, the index member 332 remains in the relaxed reciprocation state that FIG. 6A depicts. Preferably, the control valve 312 is of the latching type, which requires power only to change state, not to remain in either state. So keeping valve 312 open requires no power.

Figure 6G:
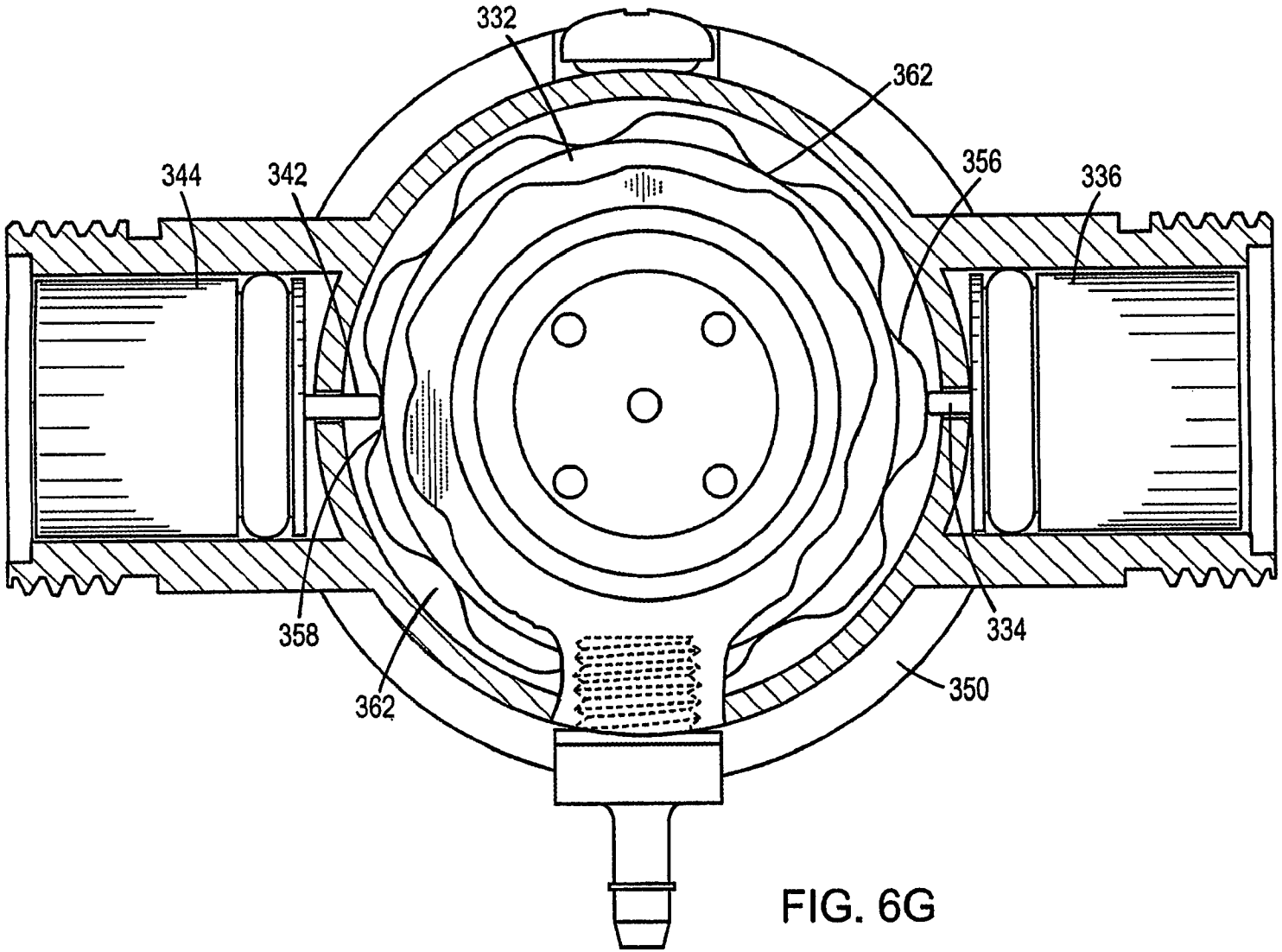
FIG. 6G is a plan view of the pilot valve, with its control valve removed and manifold shown in section, depicting the flow state in which the pilot valve permits flow from its right inlet port through its outlet port.

If the index member 332 is not only in the reciprocation state that FIG. 6A depicts but also in the index position shown in FIG. 6G, one of the lands 356 is aligned with the right port's actuator pin 334. The land thereby holds the pin in a position in which it keeps check valve 336 unseated, so fluid can flow through the right port into the manifold chamber. At the same time, the other actuator pin 342 is aligned with a recess 358, so check valve 344 remains seated and does not permit flow into the manifold chamber through the left port.

The index member 332's index position thus determines the states of the left and right ports, the control valve 312 determines the state of the top port, and the control valve 312 cooperates with the index member 332 to determine the three-way valve's overall flow state. FIG. 6G is intended to represent the flow state in which fluid can flow to the top port from the right port but not from the left port. And, in the application illustrated in FIG. 6, where the three-way valve serves as a pilot valve, the three-way valve keeps main valve 314 open and main valve 320 closed in this flow state. As will be seen, this is one of three flow states that the illustrated embodiment can assume. In this flow state, fluid can flow from the three-way valve's right port to its outlet.

Figure 6H:
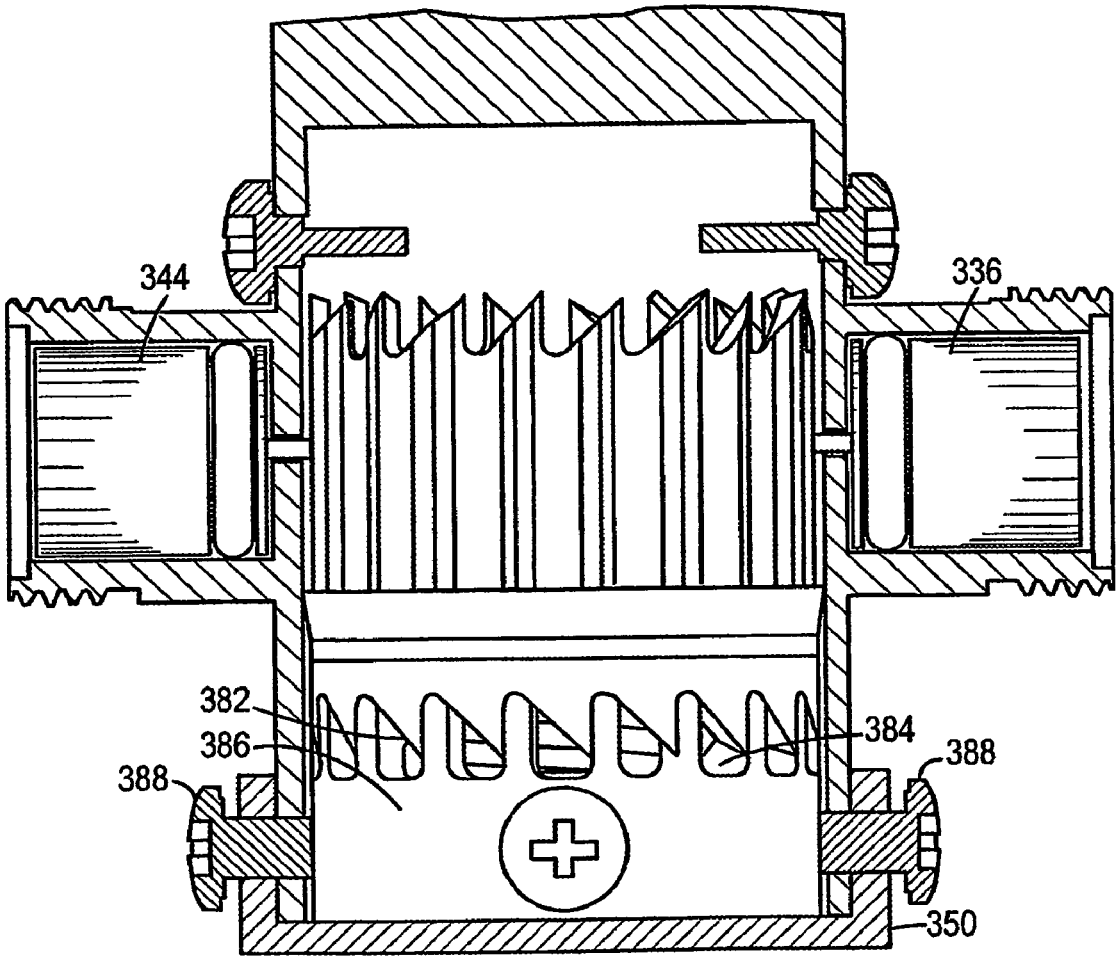
FIG. 6H is a view similar to FIG. 6A but with the index member in its extended reciprocation position.
Figure 6I:
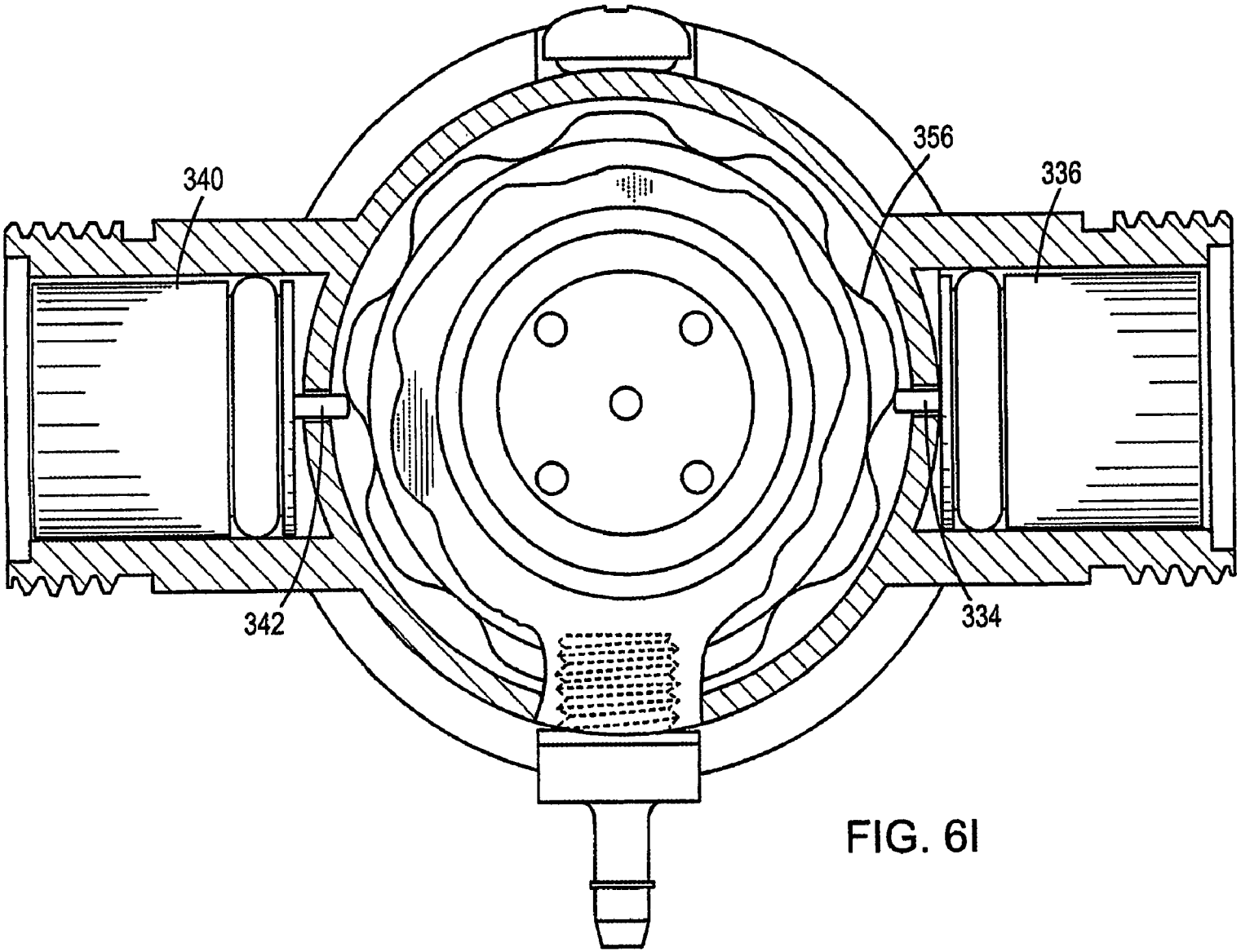
FIG. 6I is a view similar to FIG. 6G but depicting a flow state that the pilot valve can assume when the index member is in the reciprocation state that FIG. 6H depicts.

Now let us assume that a control circuit to be described below so operates the control valve 312 as to close it and thereby prevent flow out of the manifold chamber. Since flow has thus stopped, the pressure drop resulting from flow resistance in the path through the right port into the manifold chamber is eliminated. The manifold pressure therefore becomes high enough to force the index member 332 down into the position that FIG. 6H depicts. As it translates axially to assume that position, the index member 332's generally sawtooth-shaped lower cam-follower surface 382 encounters the cam surface 384 of a lower cam member 386, which is secured to the manifold 338 by the screws 388 that hold the end cap 350 in place. This causes the index member 332 to rotate to an index position, illustrated in FIG. 6I, in which neither of the actuator pins 334 and 342 is completely aligned with a land 356.

Both check valves 336 and 340 therefore allow inlet-fluid pressure to be communicated into the manifold chamber, from which now-closed control valve 312 prevents pressure relief. Control valve 312's closure has thus switched the three-way valve from the first flow state, in which it permitted flow from the right port into the manifold chamber and out the top port, to a second flow state, in which no flow occurs. In the illustrated application, in which the three-way valve serves as a pilot valve, diaphragm valves 314 and 320 that it controls are therefore closed. The "cross talk" between the two controlled ports is not a significant concern. Other applications may require that cross talk be prevented, though. This can be done by placing further, oppositely oriented check valves in series with the illustrated check valves.

Figure 6J:
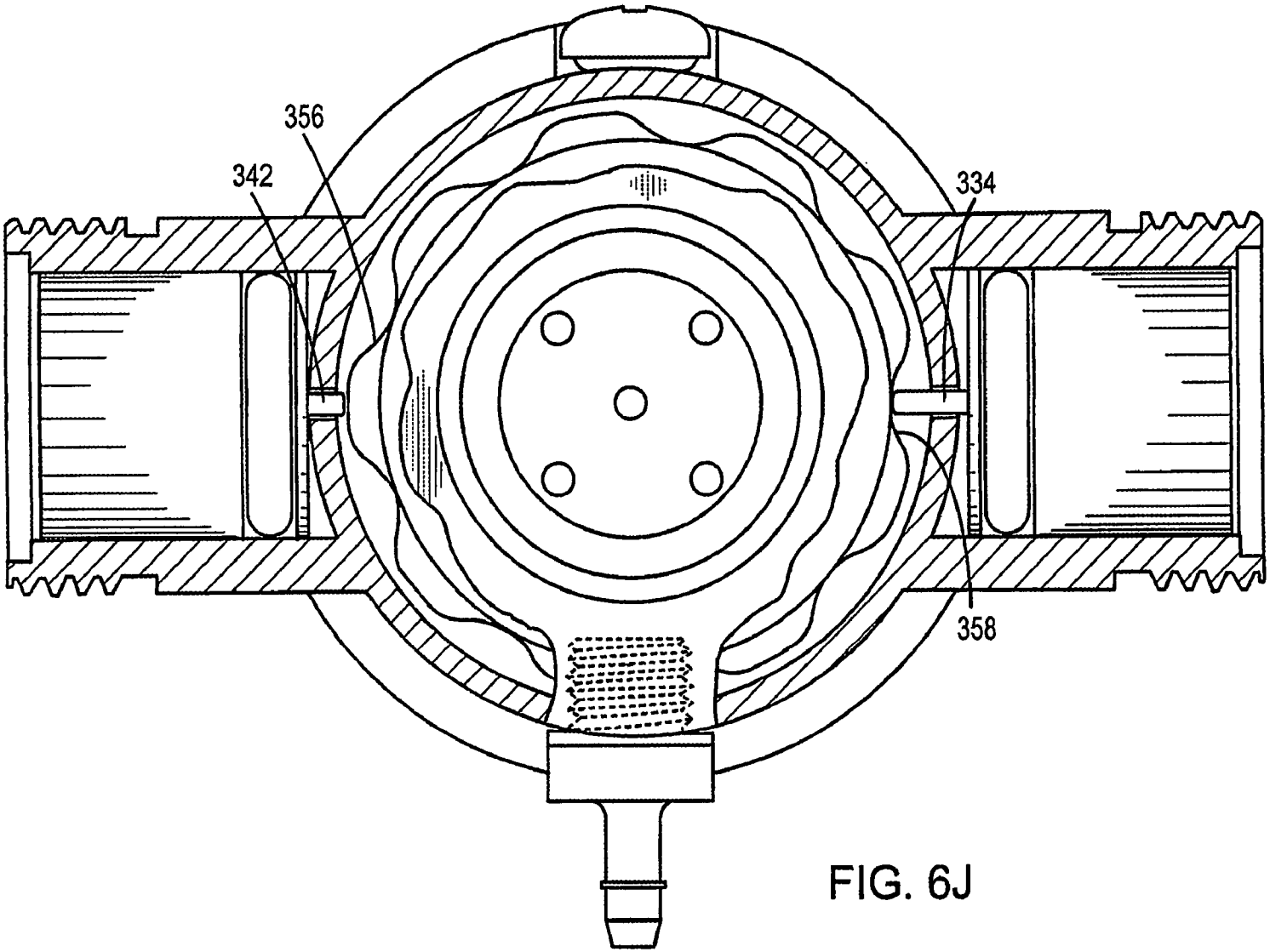
FIG. 6J is a view similar to FIG. 6G but showing the flow state in which the pilot valve permits flow to its outlet from its left inlet rather than from its right inlet.

Now assume that control valve 312 is actuated to return it to its open position, in which it again relieves the manifold pressure. Bias spring 348 returns the index member 332 to the relaxed reciprocation state, which FIG. 6A depicts, but not to the index position it was in the last time it assumed the relaxed reciprocation state. In returning to that state, the index member's upper cam-follower surface 352 encounters cam pins 354, and the index member 332 is rotated to another of its index positions, one that FIG. 6J depicts. That index position results in a different, third flow state. Specifically, it is now actuator pin 342 that is aligned with a land 356, while actuator pin 334 is aligned with a recess 358. So check valve 332 is closed, check valve 344 is open, and flow out through the manifold outlet 374 is now permitted from the left port rather than, as it was the last time the index member was in its relaxed reciprocation state, from the right port.

In summary, repeated operation of control valve 312 (or control valve 220) between its two states has advanced 3-way valve 300 through three different flow states, described above in connection with FIG. 5A.

Figure 6K:
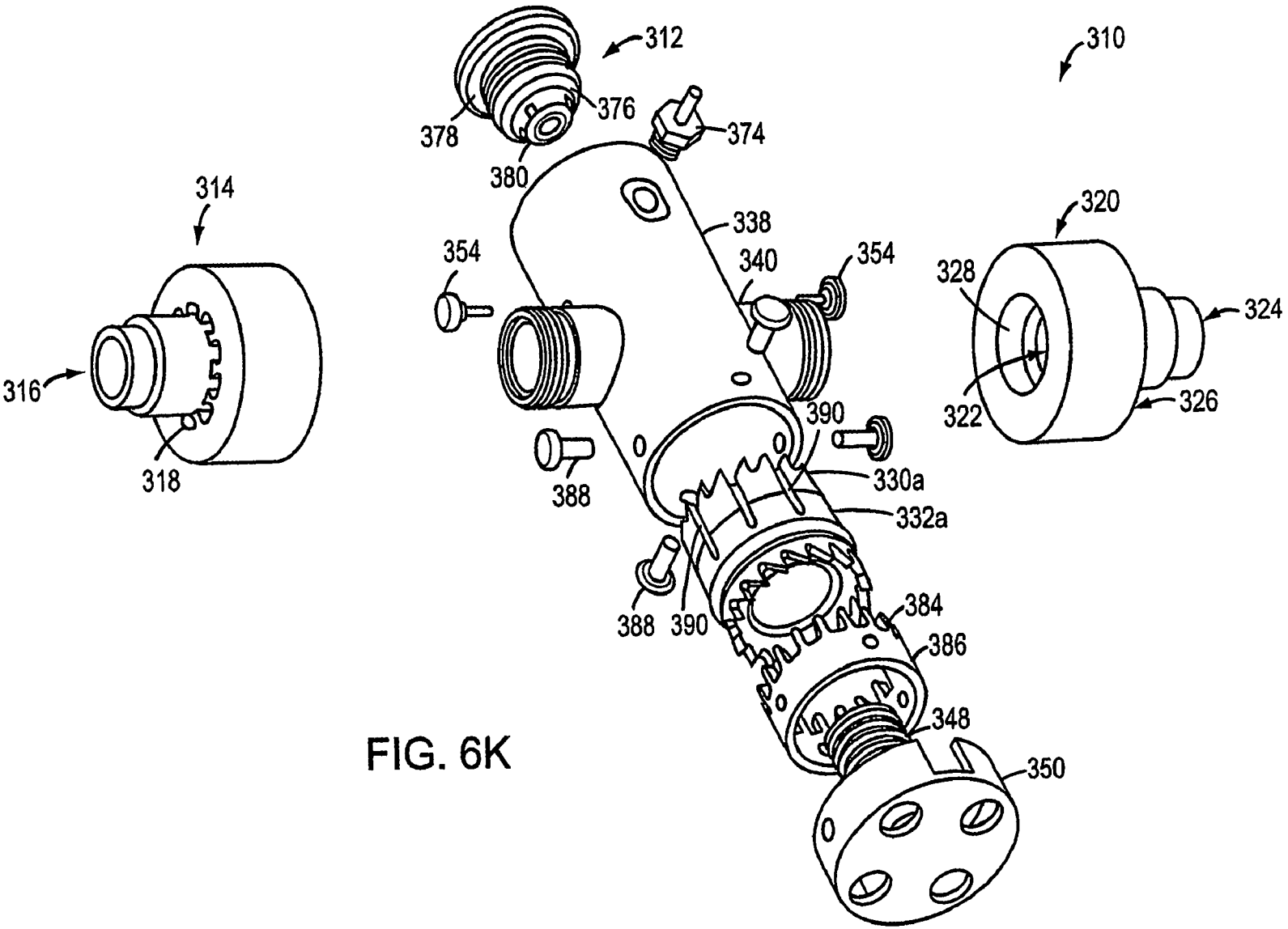
FIG. 6K is an exploded view of an alternative embodiment of the present invention.

FIG. 6K shows an alternative embodiment. With two exceptions, this embodiment is the same as the one that FIG. 6 depicts, and identical reference numerals identify identical parts. The first exception is that the controlled ports in FIG. 6K do not include FIG. 6's check valves 336 and 344 or actuating pins 334 and 342. The second exception is that the surface 330*a* of its index member 332*a* differs from FIG. 6's index-member surface 330.

Specifically, surface 330*a* does not have the gradual undulations that characterize the previously shown surface 330. Instead, surface 330*a* is substantially cylindrical but forms discretely positioned grooves 390, whose purpose is selectively to permit flow through the various controlled ports. The portion of index member above its lip seal 362 is divided into two segments having different outer diameters. The lower segment's diameter is nearly equal to the manifold wall's inner diameter, and the upper segment's outer diameter is smaller and therefore leaves a significant clearance between it and the manifold wall.

In the extended reciprocation state, the port orifices 392 and 394 by which fluid flows through the controlled ports face the index member's upper, smaller-outer-diameter portion. Because of the clearance left by this portion between it and the manifold wall, the pressure to which the controlled ports provide communication prevails in the manifold chamber 363. Here again, check valves may be added to the ports to prevent cross talk.

When valve 312 thereafter opens and thereby relieves the manifold pressure, the spring force again translates index member 332*a* upward. As before, the index member 332*a* is so cammed as to rotate. In this embodiment, that rotation brings one of FIG. 6K's grooves 390 into registration with one of the port orifices. Regarding the index position, it is the right port orifice 394 with which a groove registers. No groove is disposed in registration with the left port orifice 392, though, so the lower, larger-outer-diameter index-member portion closes the left port.

Figure 7A:
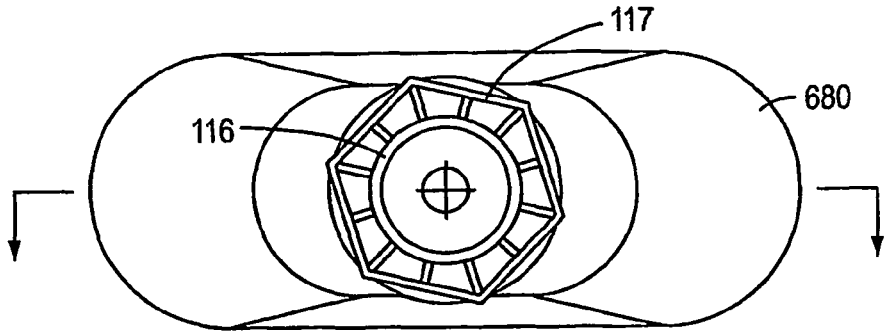
FIG. 7 is a cross-sectional view of the gravity-type flusher using a water barrier also shown in FIG. 7A, used inside the water storage tank shown in FIG. 1.
FIG. 7B is a schematic view of the gravity-type flusher using another type of a water barrier.
Figure 7:
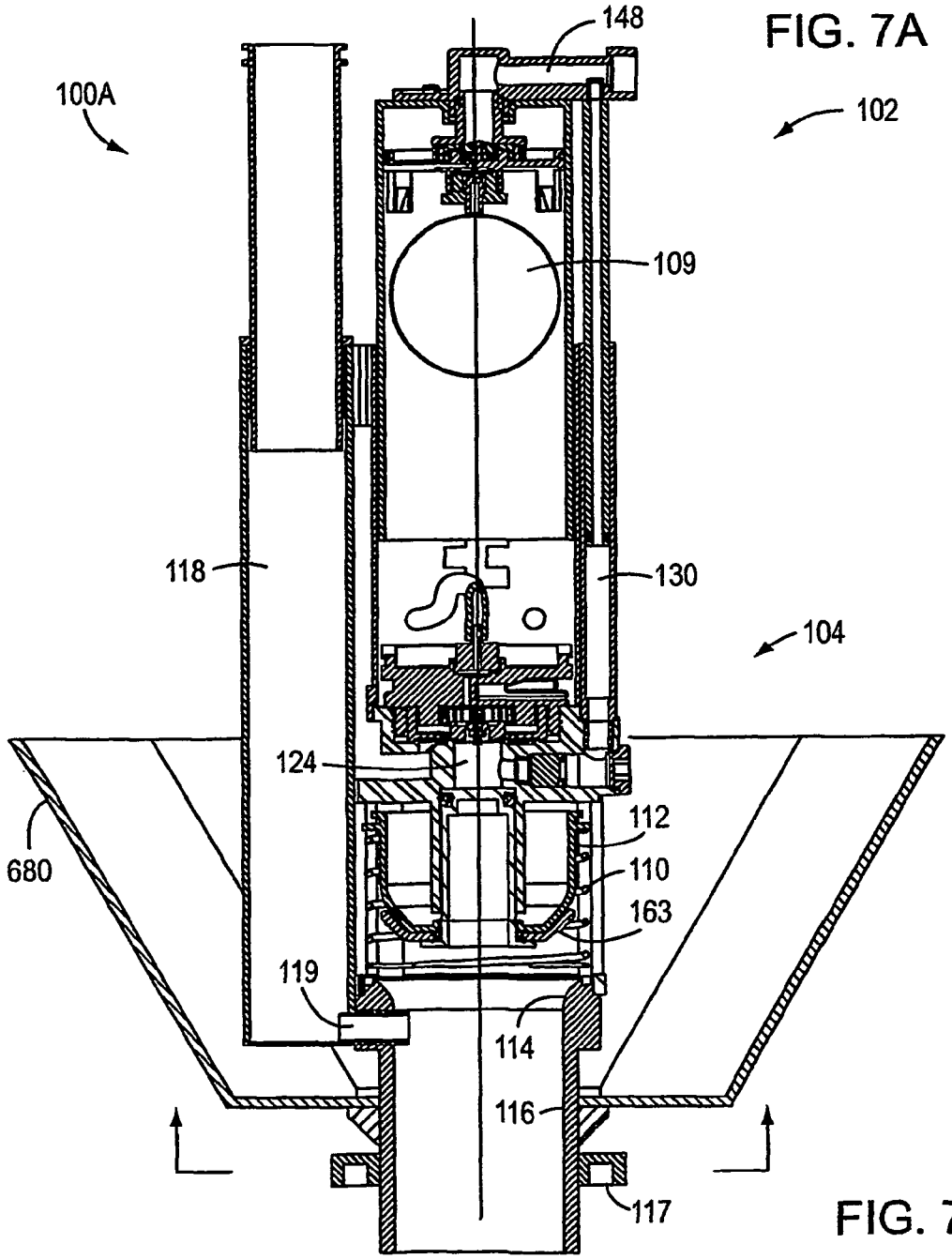
Figure 7B:
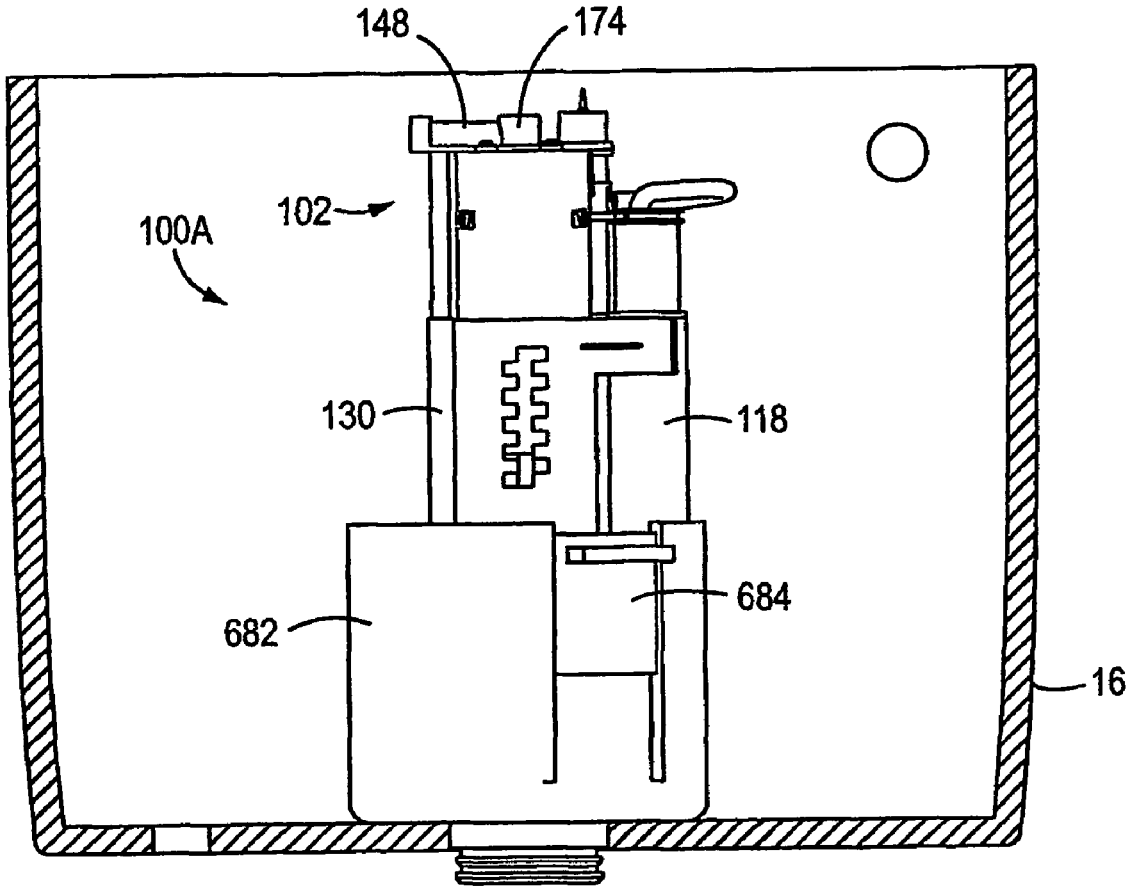

FIGS. 7 and 7B illustrate gravity-type flusher 100A using a water barrier inside water storage tank 16 (shown also in FIG. 1). Gravity-type flusher 100A is the same as described above. Water barriers 680 and 682 provide a reduced flush volume or a variable flush volume. Specifically, referring to FIGS. 7 and 7A, barrier 680 is mounted onto the flusher's body just above retaining nut 117. During the above-described flushing action, only water located inside and above water barrier 680 is delivered to the toilet bowl. The amount of water, of course, depends on the height of the barrier. Flusher 100A with water barrier 680 may be used to retrofit existing water storage tanks where flush volume reduction is desired.

FIG. 7B illustrates gravity-type flusher 100A with an adjustable water barrier 682 for providing flushes with adjustable water amounts. Adjustable water barrier 682 includes a movable wall 684 slidable between a lower position (i.e., barrier closed position), and an upper position (i.e., barrier opened position). Primarily, in the manual embodiment, water barrier 682 is used to provide a full flush, by raising barrier wall 684, or a half flush by keeping the barrier closed.

FIGS. 8, 8A, 8B and 8C illustrate an algorithm for detecting an object such as pants of a person using toilet 12 (i.e. "pants" detection algorithm). Algorithm 500 is designed for use with active optical sensor 62 having light source 66 and light detector 68 (shown in FIG. 1D). Microcontroller 34 directs a source driver to provide an adjustable IR emitter current intensity for the light source 66 (e.g., an LED) while maintaining a fixed amplifier gain for the light detector (e.g., a PIN diode or another photosensitive element).

In general, algorithm 500 detects the movement of a user by using up to 32 different IR beam intensities scanned, while maintaining the amplifier gain fixed. For each intensity IR pulse (emitted from the light source), a reflected IR signal is detected, and this cycle is performed in succession. For example, the IR current needs to be higher when sensing targets far away from the active optical sensor. On the other hand, this algorithm can identify a user moving in or out by using a comparison of detected IR current changes. The IR emitter current is changed form high to low, which shows the detected target or user is moving toward the flusher.

Figure 8:
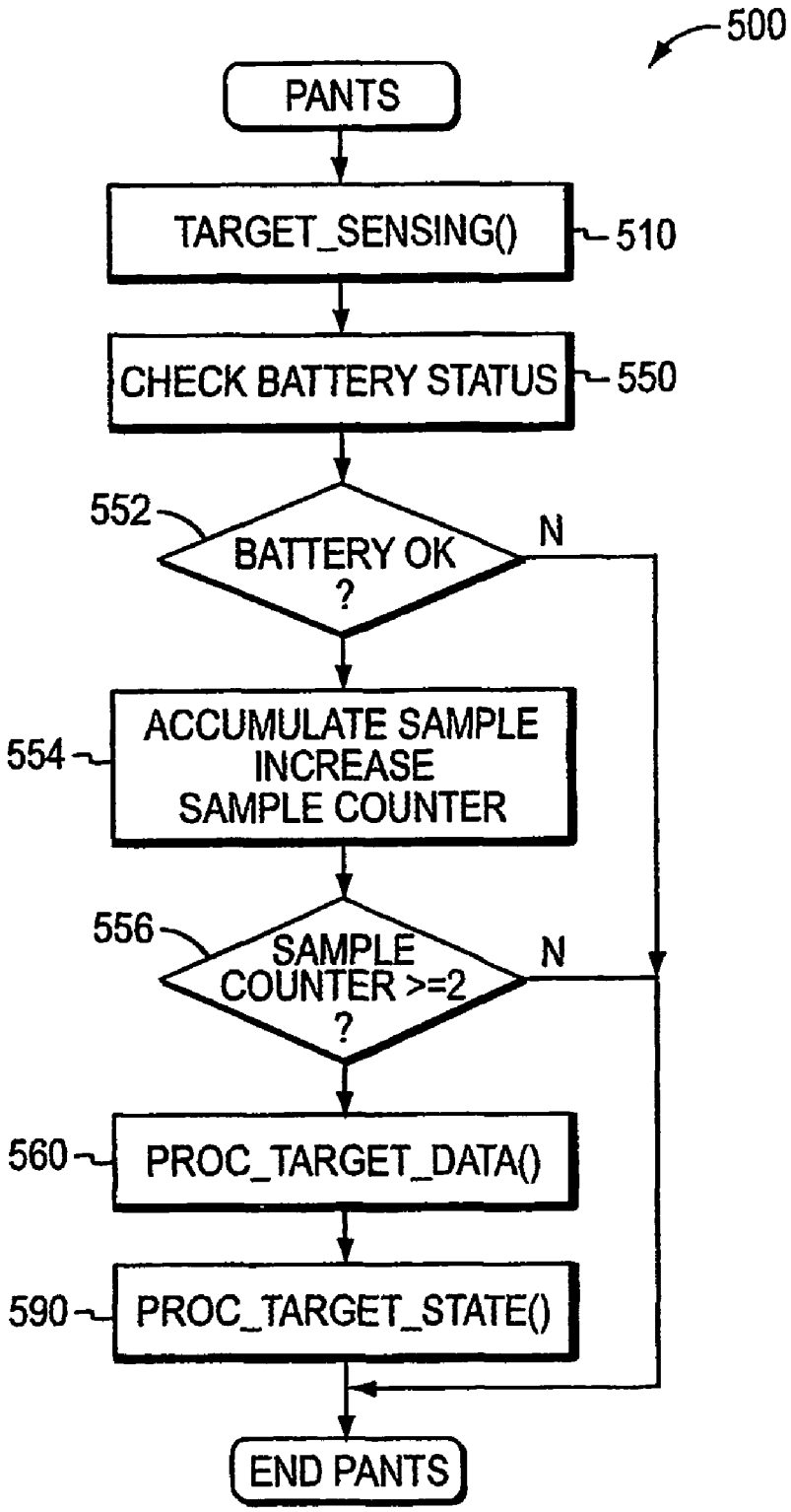
FIGS. 8, 8A, 8B and 8C illustrate an algorithm for use with the optical sensor shown in FIG. 3D designed to control the flushers shown in FIGS. 3 through 5B.
Figure 8A:
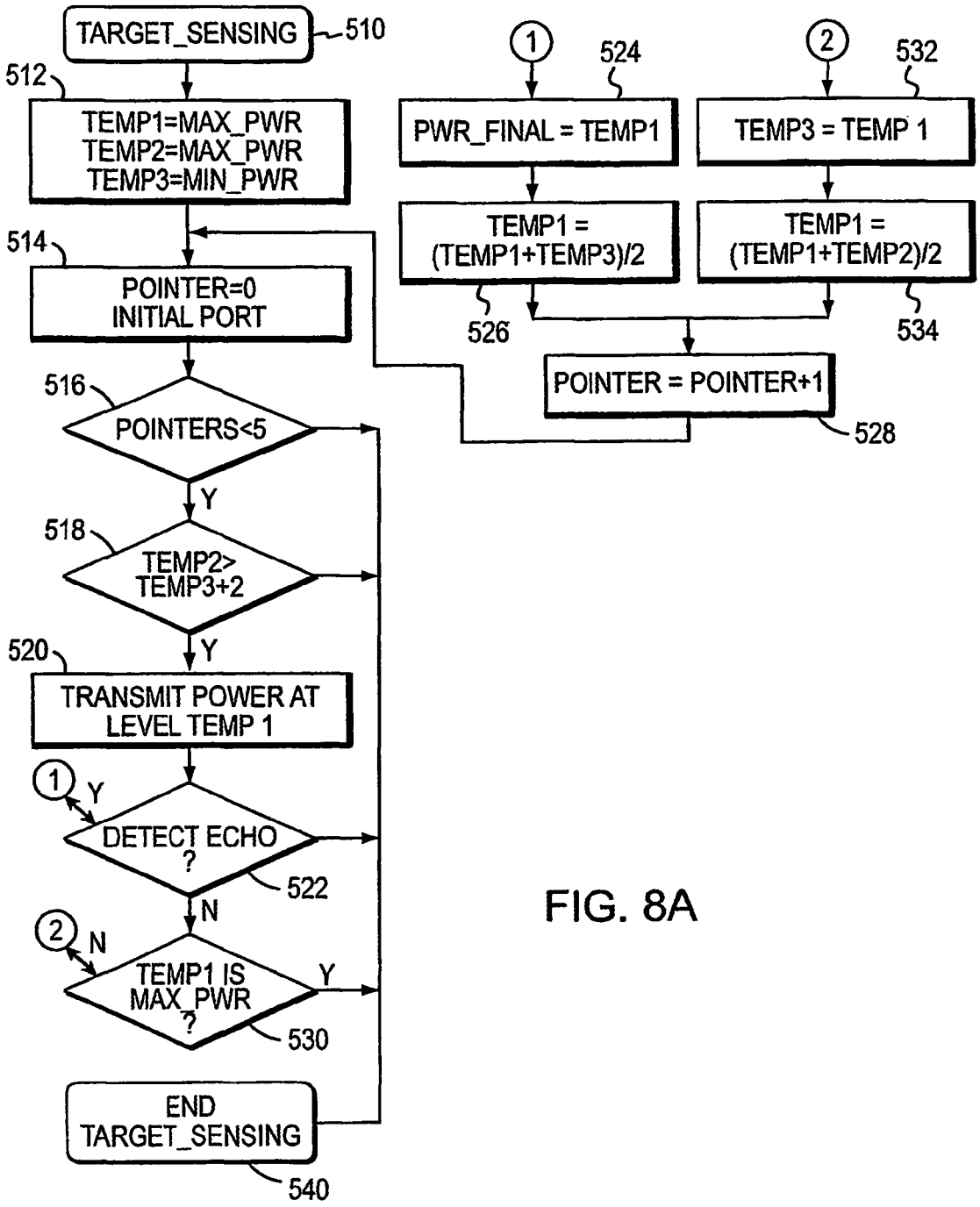
Figure 8B:
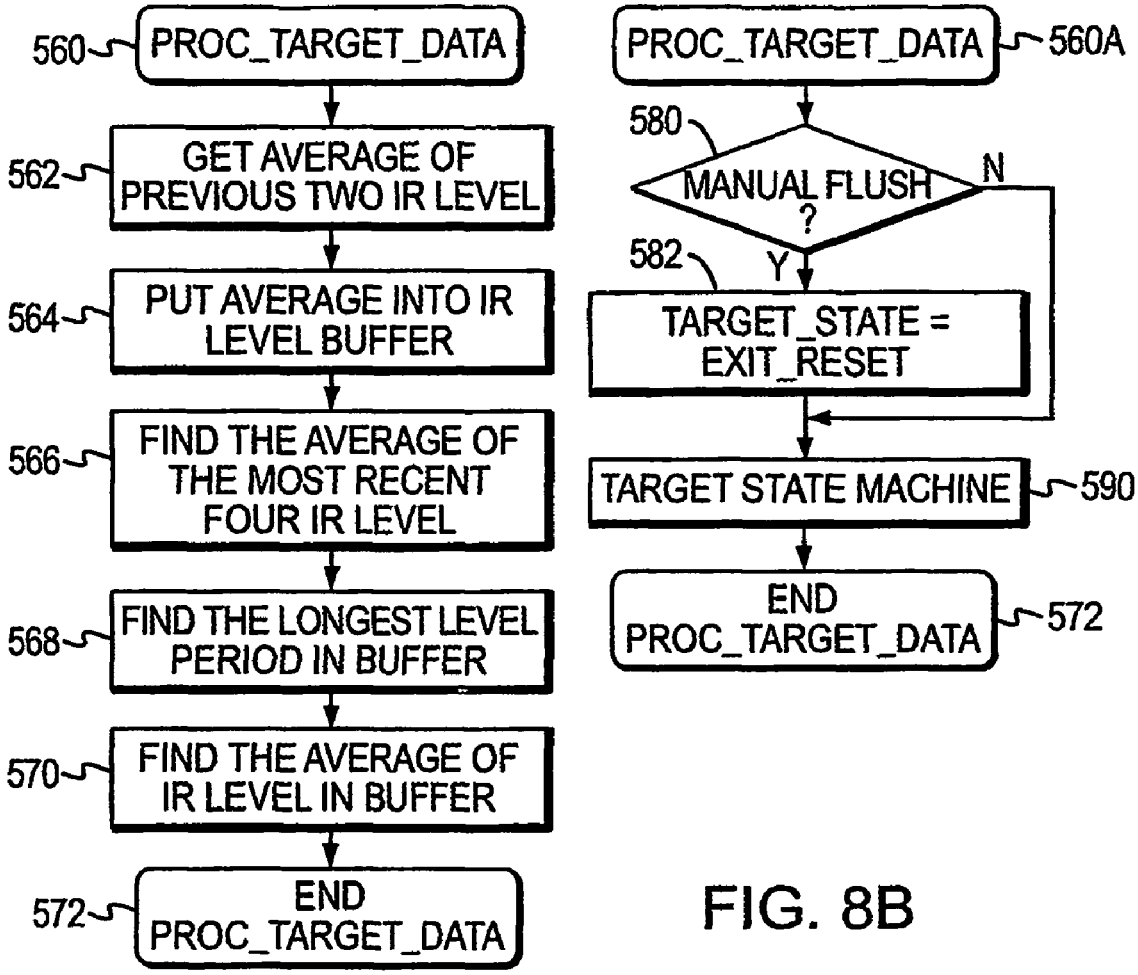
Figure 8C:
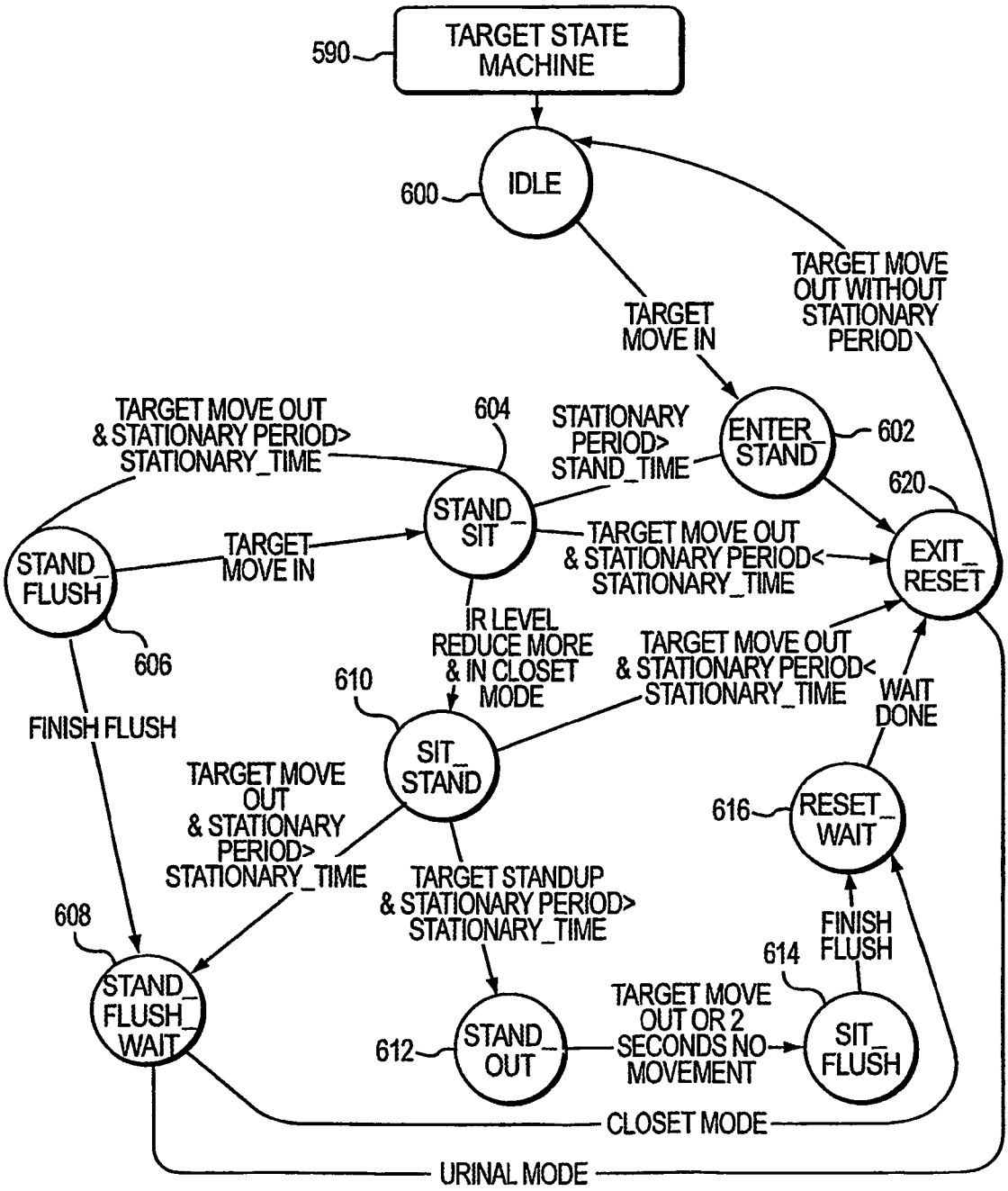

As shown in FIG. 8C, the control logic uses different target states as follows: IDLE 600, ENTER_STAND 602, STAND_SIT 604, SIT_STAND 610, STAND_FLUSH 606 STAND_FLUSH_WAIT 608, STAND_OUT 612, SIT_FLUSH 614, RESET_WAIT 616, and EXIT_RESET 620. All the states are based upon a target or user behavior in the IR sensing field. When a target or user enters the optical field, the state will be set to ENTER_STAND state. The state will be set into STAND_SIT state while a target stops moving after and ENTER_STAND state set, and so on. Following is a closet user handle cycle:

When a user moves toward the sensing field, the state will change from IDLE to ENTER_STAND. If a user spends enough time in front of toilet flusher, the state will be changed to STAND_SIT. If the target following action is sit down, the state will become SIT_STAND. The state will turn to STAND_OUT STATE, along with sitting time is long enough. Then the user stands up and moves out. In this time the control algorithm will go into SIT_FLUSH state to issue a flush command to solenoid to do flush water operation. The unit will turn back to idle state again.

The transition between the individual states is performed initially at, for example, ½× max IR power. In this time, the state machine starts from IDLE and transits to ENTER_STAND. After this transition, the thresholds for all the states changing from one to another are predefined to two IR power steps. The other threshold for changing one state to another is stationary time. The stationary time threshold is selected to be two (2) seconds for all transitions, except for the transition from SIT_STAND to STAND_FLUSH_WAIT and STAND_OUT states. The stationary time threshold is selected to be four (4) seconds for transitions from the SIT_STAND state to the STAND_FLUSH_WAIT state and the STAND_OUT state.

In a typical application, the criteria for a flusher to turn on water is the user standing or sitting in front of detector for at least eight seconds. In other words, if detector unit detects user more than eight seconds (including MOVE IN and STATIONARY_TIME), the flusher controller will change the status to ready to flushing status. Once detecting a user moving out, the controller will issue a flushing command to the solenoid to turn on water. The time thresholds may depend upon applications.

Referring to FIG. 8, the "pants" detection algorithm 500 uses a target sensing sub-routine 510 that cycles through up to 20 different levels of IR light emission intensity emitted from light source 66 (FIG. 1D). For each intensity of the emitted IR pulse, detector 68 detects the corresponding reflected signal. As shown in FIG. 8A, the maximum and minimum light source powers are selected and stored in temporary buffers (steps 512 through 518). IR Light source 66 emits the corresponding optical signal at the power level stored in a temporary buffer 1, and IR light detector 68 detects the corresponding reflected signal. As shown in step 522, if no echo is detected, the power level is cycled one step higher up to maximum power. The power increase is performed according to steps 532 and 534 and the entire process is repeated starting with step 514. In step 522, if the corresponding echo signal is detected, the current power level is assigned the final value (step 524). The next power level is averaged as shown in block 526, and the pointer numbering is increased (step 528). Next, the entire cycle is repeated starting with step 514. This way, the power to light source 66 is increased up to a specific power value, and the increased intensity IR pulse is emitted up to the intensity where the corresponding IR echo is detected by detector 68 (sampled and timed to the emitted pulse).

Referring still to FIG. 8, in steps 550 through and 552, the processor checks the battery status and then proceeds to accumulate sample data as shown in step 554. The accumulated optical data is processed using the algorithm shown in FIG. 8B. In steps 562 through 566, the processor finds the average of the most recent four IR detection levels. Next, the processor finds the longest level period in the buffer (Step 568), and finds the average of the IR level in the buffer (step 570). Before each data is processed, the processor checks if a manual flush was actuated by a user (step 580). If a manual flush was actuated, the processor exits the present target state, as shown in block 582. Alternatively, if no manual flush was actuated, the processor continues determining the individual target states, as shown in FIG. 8C.

In this embodiment, the system determines whether the absolute value of the difference between the current gain and the gain listed in the top stack entry exceeds a threshold gain change. If it does not, the current call of this routine results in no new entries being pushed onto the stack, but the contents of the existing top entry's timer field are incremented. The result is instead that if the gain change's absolute value was indeed greater than the threshold, then the routine pushes a new entry on to the stack, placing the current gain in that entry's gain field and giving the timer field the value of zero. In short, a new entry is added whenever the target's distance changes by a predetermined step size, and it keeps track of how long the user has stayed in roughly the same place without making a movement as great as that step size.

The routine also gives the entry's in/out field an "out" value, indicating that the target is moving away from the toilet, if the current gain exceeds the previous entry's gain, and it gives that field an "in" value if the current gain is less than the previous entry's gain. In either case, the routine then performs the step of incrementing the timer (to a value of "1") and moves from the stack-maintenance part of the routine to the part in which the valve-opening criteria are actually applied.

The processor applies the first criterion, namely, whether the top entry's in/out field indicates that the target is moving away. If the target does not meet this criterion, the routine performs the step of setting the flush flag to the value that will cause subsequent routines not to open the flush valve, and the routine returns. If that criterion is met, on the other hand, the routine performs step of determining whether the top entry and any immediately preceding entries indicating that the target is moving away are preceded by a sequence of a predetermined minimum number of entries that indicated that the target was moving in (toward the toilet). If they were not, then it is unlikely that a user had actually approached the facility, used it, and then moved away from the toilet, so the routine again returns after resetting the flush flag. Note that, in the preferred embodiment, the criterion is independent of absolute reflection percentage; it is based only on reflection-percentage changes, requiring that the reflection percentage traverse a minimum range as it increases.

If the system determines that the requisite number of inward-indicating entries did precede the outward-indicating entries, then the routine imposes the criterion of determining whether the last inward-movement-indicating entry has a timer value representing at least, say, 5 seconds. This criterion is imposed to prevent a flush from being triggered when the facility was not actually used. Again, the routine returns after resetting the flush flag if this criterion is not met.

If it is met, on the other hand, then the routine imposes the criteria of which are intended to determine whether a user has moved away adequately. If the target appears to have moved away by more than a threshold amount, or has moved away slightly less but has appeared to remain at that distance for greater then a predetermined duration, then, the routine sets the flush flag before returning. Otherwise, it resets the flush flag.

Referring to FIGS. 2, 2A and 2B, microcontroller 34 controls the entire flushing cycle for the automatic flusher embodiment. On the other hand, in a manual flusher embodiment, the operation is controlled by depressing a button 18. The manual operation is described in PCT Application PCT/US01/43273, which is incorporated by reference in its entirety. Button 18 actuates a hydraulic mechanism connected to hydraulic line 153 (FIGS. 3 and 3B). The hydraulic mechanism controls flush valve 104 (as described in the PCT Application PCT/US01/43273), while float 109 controls fill valve 102.

Figure 9:
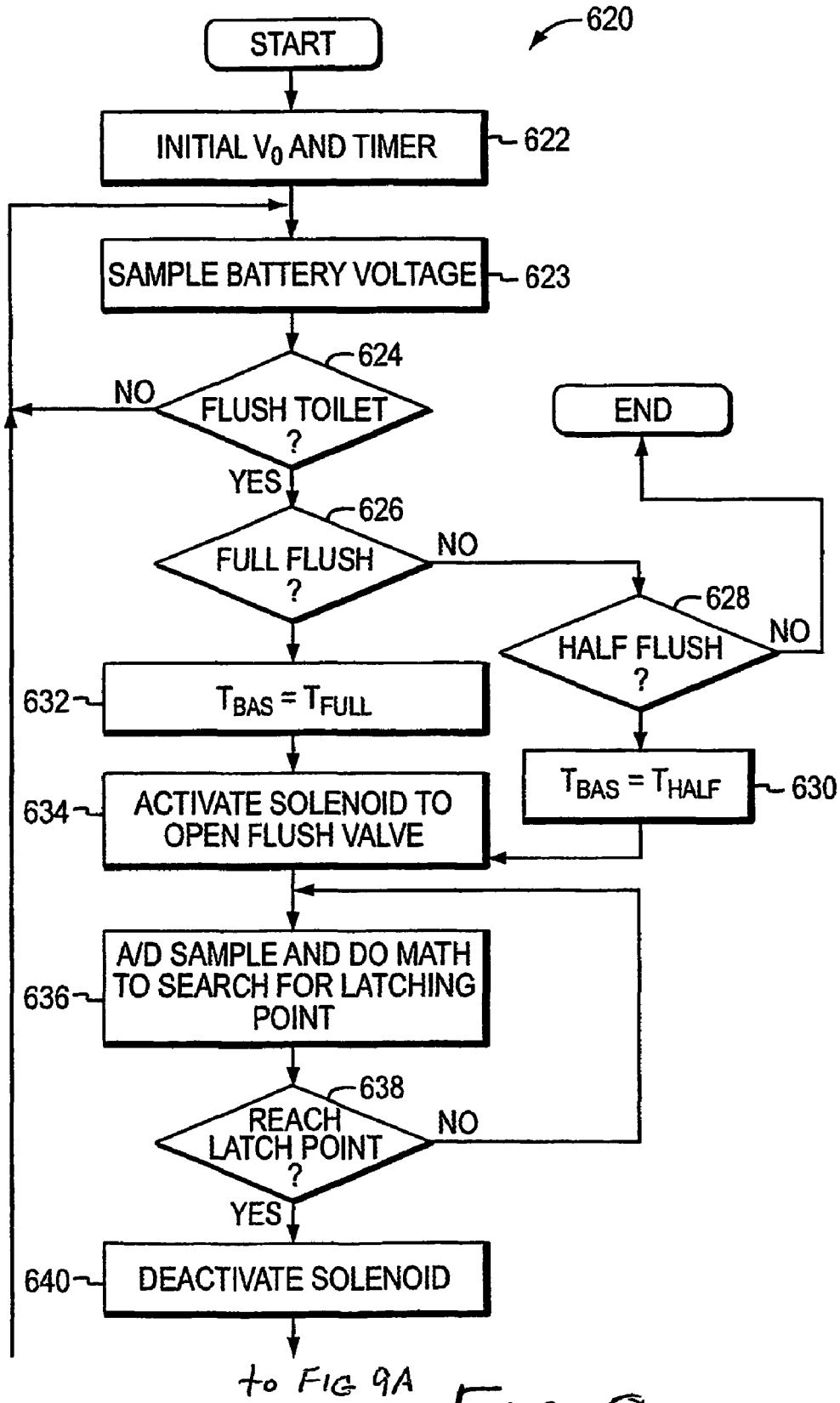
FIGS. 9 and 9A illustrate a flushing algorithm executed by a microcontroller of any one of the systems shown in FIGS. 2, 2A, and 2B.
Figure 9A:
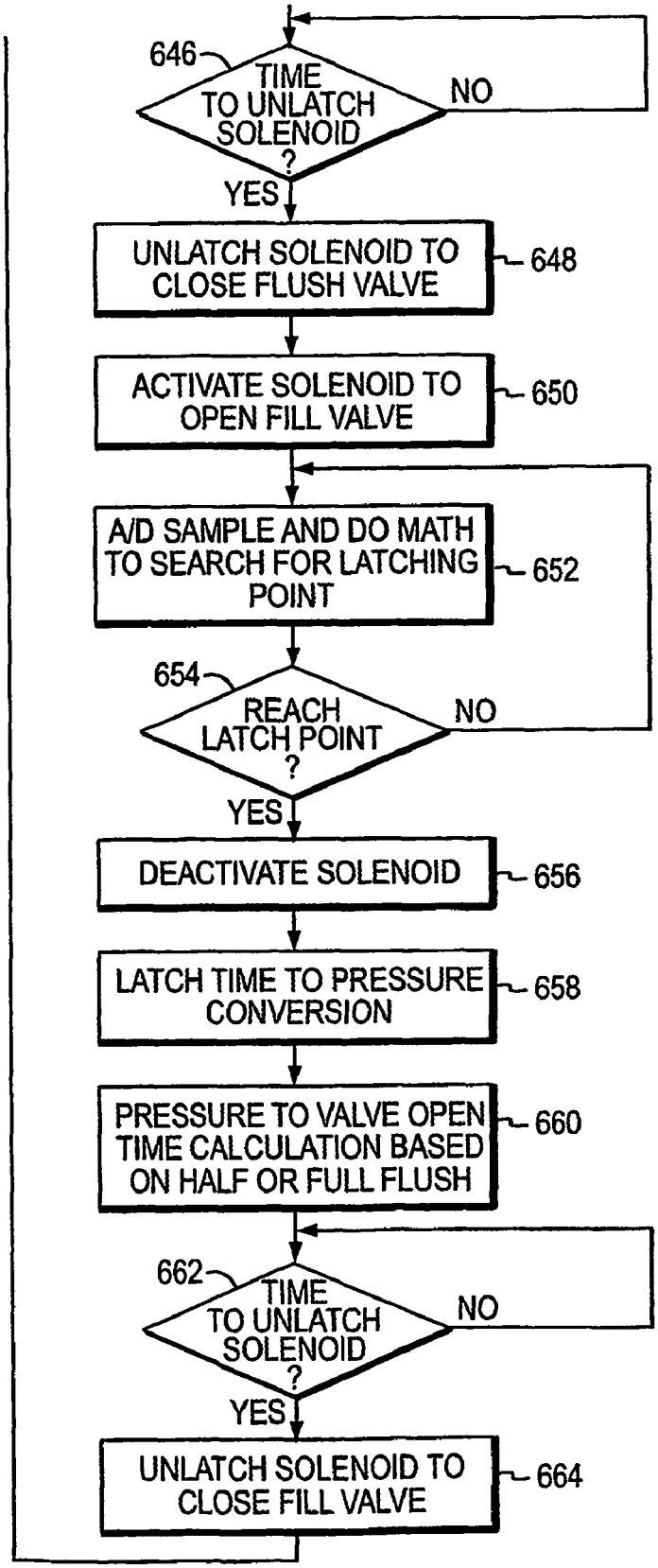

Referring to FIGS. 9 and 9A, in the automatic flusher embodiment, microcontroller 34 controls both the optical sensor operation and the flushing cycle that described in flow diagram 620. Initially, microcontroller 34 is in a sleep mode. Upon an input signal from the input element or external sensor (e.g., active or passive optical sensor), microcontroller 34 is initialed and the timer is set to zero (step 622). In step 623, the battery voltage is checked to assure sufficient power. Microcontroller 34 runs the "pants" detection algorithm described in connection with FIGS. 8-8C. If the flush command is received, in step 624, the algorithm proceeds to execute a flush cycle (step 626). Otherwise, the "pants" detection algorithm continues or the microcontroller 34 goes to the sleep mode.

Referring still to FIGS. 9, in step 624, if the valve actuator performs a full flush, the time T equals $T_{full}$ (step 632). If there is no full flush, the timer is set in step 630 to $T_{bas}$ equals $T_{half}$. In step 634, microcontroller initiates delivery of the drive signal to activate the actuator to open the flush valve. Next, microcontroller 34 searches for the latching point (as described in PCT Application PCT/US 02/38758and PCT Application PCT/US 02/41576, both of which are incorporated by reference). When the timer reaches the latching point (step 638), microcontroller 34 deactivates the solenoid (step 640). After the selected open time (step 646), microcontroller 34 initiates closing of the flush valve (step 648). Next, microcontroller 34 initiates delivery of the drive signal to activate the actuator to open the fill valve (step 650).

Next, microcontroller 34 searches for the latching point (steps 652 and 654) to deactivate the solenoid (step 656). After the solenoid of the actuator is deactivated, based on the latch time, microcontroller 34 calculates the corresponding water pressure in the water line, using the stored calibration data (as described in U.S. Provisional Application 60/362,166, filed on Mar. 5, 2002 or in PCT Application PCT/US 02/38758, both of which are incorporated by reference).

Based on the water pressure the fill valve is kept open for the calculated period of time to deliver a known amount of water inside water tank 16. After the calculated time, the microcontroller unlatches the armature of the actuator (step 656). This closes the fill valve. The opening and closing of the flush valve and fill valve may be performed using two solenoid actuators or using a single solenoid actuator coupled to the three-way valve (described in connection with FIGS. 6-6K) used in the gravity-type flusher shown in FIGS. 5, 5A, and 5B.

Figure 10:
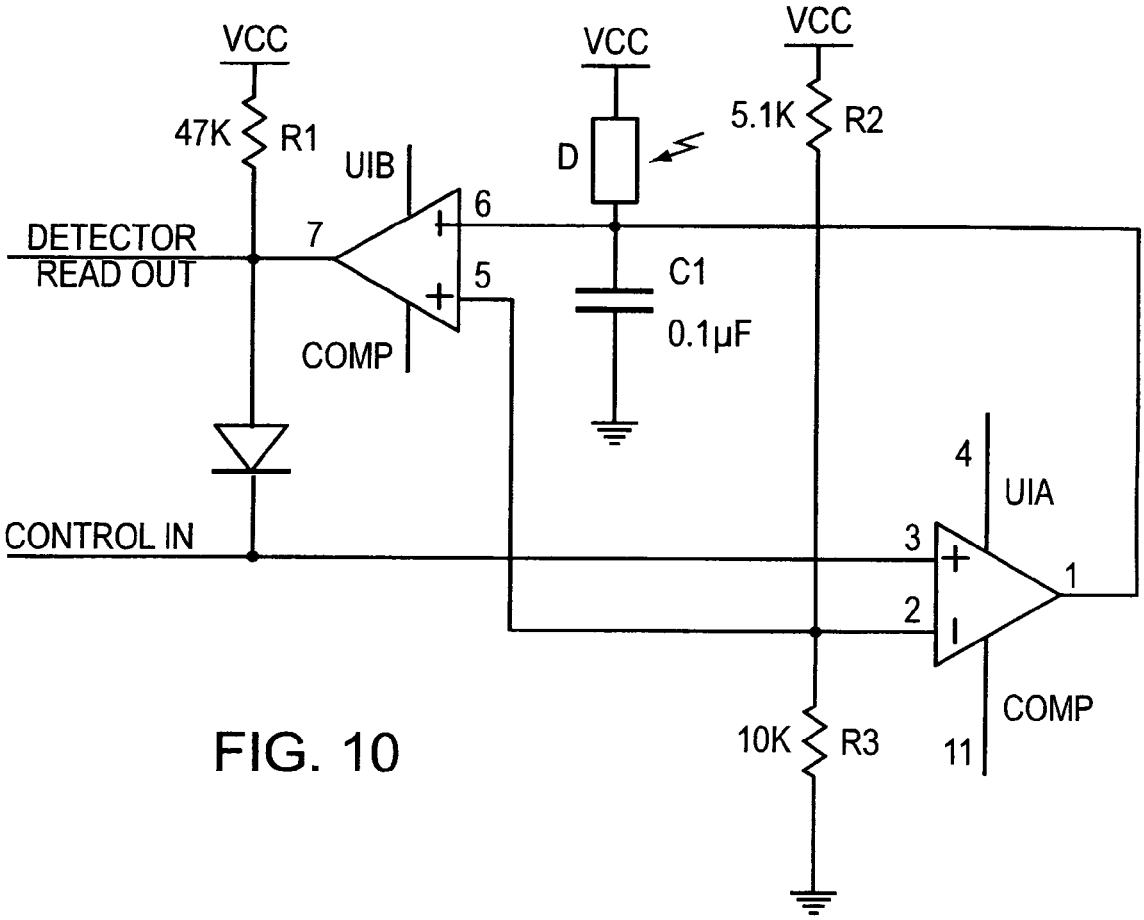
FIG. 10 is a schematic diagram of a detection circuit used in the passive optical detector shown in FIG. 1C.

Importantly, the automatic flusher system may use a passive optical sensor instead of the active optical sensor described above in connection with 1D. The passive optical sensor includes only a light detector providing a detection signal to microcontroller 34 (shown in FIG. 2, 2A or 2B). FIG. 10 provides a schematic diagram of a detection circuit used in the passive optical sensor located in the control module shown in FIG. 1C.

The passive optical sensor does not include a light source (no light emission occurs) and only includes a light detector that detects arriving light. As compared to the active optical sensor, the passive sensor enables reduced power consumption since all power consumption related to the IR emitter is eliminated. The light receiver may be a photodiode, a photo-resistor or some other optical element providing electrical output depending on the intensity or the wavelength of the received light. The light receiver is selected to be active in the range or 350 to 1,500 nanometers and preferably 400 to 1,000 nanometers, and even more preferably, 500 to 950 nanometers. Thus, the light receiver is not sensitive to body heat emitted by the user of toilet 12.

The light receiver provides electrical output to an amplifier or a converter. According to one preferred embodiment, this circuitry has during power-up phase a RC value proportional to a particular light intensity when there are no objects within the field of view and the ambient light is set to a predetermined level. Upon introduction of an object into the field of view, the RC value of the system is altered such that its time constant shifts. Furthermore, the constant shifts in the time domain as the target moves toward the detector or away from the detector; this is an important novel design.

Since the constant shifts in the time domain as the target moves toward the detector or away from the detector, the microcontroller can determine whether an object is present, and whether it is moving toward or away from the optical sensor. When employing this phenomenon in a flusher (or in a faucet) the ability to achieve a more accurate assessment as to whether water flow should commence is significantly enhanced when employing a photo resistor to the amplification circuitry. Circuitry is altered such that the RC constant shifts due to the changing resistant value proportional to the light intensity as compared to the diode arrangement, whereby the voltage change affects the change of time constant of the integrated signal. This use of a fully passive system further reduces the overall energy consumption.

FIG. 10 shows a schematic diagram of the detection circuit used by the passive sensor. The detection circuit includes a detection element D (e.g., a photodiode or a photo-resistor), two comparators (U1A, and U1B) connected to provide a read-out from the detection element upon receipt of a high pulse. The voltage $V_{CC}$ is +5 V (or +3V) received from the power source. Resistors $R_2$ and $R_3$ are voltage dividers between $V_{CC}$ and the ground. Diode D is connected between the pulse input and output line to enable the readout of the capacitance at capacitor $C_1$ charged during the light detection.

Preferably, the detection element D is a photo-resistor receiving light of intensity in the range of 1 lux to 100 lux, by appropriate design of optical window 33. For example, optical window 33 may include a photochromatic material or a variable size aperture. In general, the photo-resistor can receive light of intensity in the range of 0.1 lux to 500 lux for suitable detection. Upon receiving a "high" pulse at the input connection, comparator $U_{1A}$ receives the "high" pulse and provides the "high" pulse to node A. At this point, the corresponding capacitor charge is read out through comparator $U_{1B}$ to the output 7. The output pulse is a square wave having a duration that depends on the photocurrent that charged capacitor $C_1$ during the light detection time period. Thus, microcontroller 34 receives a signal that depends on the detected light.

In the absence of the high signal, comparator $U_{1A}$ provides no signal to node A, and therefore capacitor $C_1$ is being charged by the photocurrent excited at the photo resistor D between $V_{CC}$ and the ground. The charging and reading out (discharging) process is being repeated in a controlled manner by providing a high pulse at the control input. The output receives a high output, i.e., the square wave having duration proportional to the photocurrent excited at the photo resistor. The detection signal can be used in a detection algorithm such as the "pants" algorithm 500 described above.

By virtue of the elimination of the need to employ an energy consuming IR light source, the system can be configured so as to achieve a longer battery life (usually many years or operation without changing the batteries). Furthermore, the passive system enables a more accurate means of determining presence of a user, the user motion, and the direction of user's motion. These are important data as shown in the "pants" algorithm 500 described above.

The preferred embodiment as it relates to which type of optical sensing element is to be used is dependent upon the following factors: The response time of a photo-resistor is on the order or 20-50 milliseconds, whereby a photo-diode is on the order of several microseconds, therefore the use of a photo-resistor will require a significantly longer time form which impacts overall energy use. However, the use of a photodiode requires a little more elaborate amplification circuit since the optimal detection range is in higher light intensities, which may require more energy per unit time (more overall battery power). The cost of the sensing element coupled to the support electronics of the photo resistor approach is likely lower than that of the photodiode.

Furthermore, the active sensor (FIG. 1D) and the passive sensor can be used to determine light or dark in a facility and in turn alter the sensing frequency. That is, in a dark facility the sensing rate is reduced under the presumption that in such a modality the water dispensing device (i.e., a WC, a urinal or a faucet) will not be used, whereby said reduction of sensing frequency is a further means of reducing the overall energy use, and thus this detection enables extension of battery life.

Having described various embodiments and implementations of the present invention, it should be apparent to those skilled in the relevant art that the foregoing is illustrative only and not limiting, having been presented by way of example only. There are other embodiments or elements suitable for the above-described embodiments, described in the above-listed publications, all of which are incorporated by reference as if fully reproduced herein. The functions of any one element may be carried out in various ways in alternative embodiments. Also, the functions of several elements may, in alternative embodiments, be carried out by fewer, or a single, element.

What is claimed is:

1. A flusher for use with a water storage tank, comprising:

an intake valve connected to an external water source and constructed to close water flow to a water storage tank at about a predefined water level in said water tank;

a diaphragm-operated flush valve constructed to control a flush valve member between a seated state and an unseated state allowing water discharge from said water tank into a toilet bowl;

a diaphragm, separating a flush-valve chamber and a pilot chamber, arranged to seal said flush-valve chamber and thereby maintain pressure forcing said flush valve member to said seated state preventing said water discharge from said water storage tank to said toilet bowl;

a pressure control mechanism constructed and arranged, upon actuation, to reduce pressure in said pilot chamber of said diaphragm-operated flush valve to cause deformation of said diaphragm and thereby reduce pressure in said flush-valve chamber causing said water discharge; and a sensor module located at a reference location external to said water storage tank being at an input line coupling said external water source to said water storage tank.

2. The flusher of claim 1 wherein said intake valve inciudes a float constructed and arranged without any fixed coupling to any valve member.

3. The flusher of claim 1 wherein said intake valve includes a float which freely floats within a float cage.

4. The flusher of claim 1 wherein said intake valve is actuated by a water level detector.

5. The flusher of claim 4 wherein said water level detector includes a reed sensor.

6. The flusher of claim 1 wherein said pressure control mechanism is controlled by a solenoid.

7. The flusher of claim 1 wherein said intake valve and said flush valve are located within a single housing.

8. The flusher of claim 1 wherein said water tank is an external water tank.

9. The flusher of claim 1 wherein said water tank is a concealed water tank located behind a wall.

10. The flusher of claim 1 wherein said intake valve enables a variable water level in said tank.

11. The flusher of claim 1 including a vacuum breaker arranged to prevent transfer of water from said tank to a water supply.

12. The flusher of claim 8 including a manual actuator constructed and arranged to actuate said flush valve.

13. The flusher of claim 12 wherein said manual actuator is a push button actuator.

14. The flusher of claim 13 wherein said push button actuator is constructed to actuate said flush valve enabling a dual water volume flush.

15. The flusher of claim 13 wherein said push button actuator is constructed to actuate hydraulically said flush valve.

16. The flusher of claim 1 further including an automatic actuator is constructed to be triggered by a signal from said sensor module.

17. The flusher of claim 16 wherein said sensor module registers presence of an object.

18. The flusher of claim 16 wherein said sensor module registers movement of an object.

19. The flusher of claim 16 wherein said sensor module includes an optical sensor.

20. The flusher of claim 16 wherein said automatic actuator is constructed to actuate said flush valve enabling a dual water volume flush.

* * * * *